US010557185B2

(12) United States Patent
Oishi et al.

(10) Patent No.: US 10,557,185 B2
(45) Date of Patent: Feb. 11, 2020

(54) FREE-CUTTING COPPER ALLOY, AND METHOD FOR PRODUCING FREE-CUTTING COPPER ALLOY

(71) Applicant: Mitsubishi Shindoh Co., Ltd., Tokyo (JP)

(72) Inventors: Keiichiro Oishi, Osaka (JP); Kouichi Suzaki, Osaka (JP); Shinji Tanaka, Osaka (JP); Takayuki Oka, Osaka (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 16/274,622

(22) Filed: Feb. 13, 2019

(65) Prior Publication Data

US 2019/0241999 A1 Aug. 8, 2019

Related U.S. Application Data

(62) Division of application No. 16/325,267, filed as application No. PCT/JP2017/029376 on Aug. 15, 2017.

(30) Foreign Application Priority Data

Aug. 15, 2016 (JP) ..... 2016-159238

(51) Int. Cl.
*C22C 9/04* (2006.01)
*C22F 1/00* (2006.01)
*C22F 1/08* (2006.01)

(52) U.S. Cl.
CPC ..... *C22C 9/04* (2013.01); *C22F 1/002* (2013.01); *C22F 1/08* (2013.01)

(58) Field of Classification Search
CPC ..... C22C 9/04; C22F 1/002; C22F 1/08
See application file for complete search history.

(56) References Cited

U.S. PATENT DOCUMENTS 4,055,445 A 10/1977 Pops
5,865,910 A * 2/1999 Bhargava ..... C22C 9/02 148/433

(Continued)

FOREIGN PATENT DOCUMENTS

CA 2 582 972 A1 4/2006
EP 1 045 041 A1 10/2000

(Continued)

OTHER PUBLICATIONS

Sep. 12, 2005 "Lead-less free-cutting brass bar", Japan Copper and Brass Association technical standard, with computer translation.

(Continued)

*Primary Examiner* — Anthony J Zimmer
*Assistant Examiner* — Ricardo D Morales
(74) *Attorney, Agent, or Firm* — Merchant & Gould, P.C.

(57) ABSTRACT

This free-cutting copper alloy contains 75.0%-78.5% Cu, 2.95%-3.55% Si, 0.07%-0.28% Sn, 0.06%-0.14% P, and 0.022%-0.25% Pb, with the remainder being made up of Zn and inevitable impurities. The composition satisfies the following relations: $76.2 \le f1 = Cu + 0.8 \times Si - 8.5 \times Sn + P + 0.5 \times Pb \le 80.3$, $61.5 \le f2 = Cu - 4.3 \times Si - 0.7 \times Sn - P + 0.5 \times Pb \le 63.3$. The area ratios (%) of the constituent phases satisfy the following relations: $25 \le \kappa \le 65$, $0 \le \gamma \le 1.5$, $0 \le \beta \le 0.2$, $0 \le \mu \le 2.0$, $97.0 \le f3 = \alpha + \kappa$, $99.4 \le f4 = \alpha + \kappa + \gamma + \mu$, $0 \le f5 = \gamma + \mu \le 2.5$, $27 \le f6 = \kappa + 6 \times \gamma^{1/2} + 0.5 \times \mu \le 70$. The long side of the γ phase does not exceed 40 μm, the long side of the μ phase does not exceed 25 μm, and the κ phase is present within the α phase.

6 Claims, 3 Drawing Sheets

(56) References Cited

U.S. PATENT DOCUMENTS

| | | | |
|---|---|---|---|
| 2007/0062615 | A1 | 3/2007 | Oishi |
| 2007/0169854 | A1 | 7/2007 | Oishi |
| 2007/0169855 | A1 | 7/2007 | Oishi |
| 2009/0297390 | A1 | 12/2009 | Hidenobu et al. |
| 2014/0251488 | A1 | 9/2014 | Oishi et al. |
| 2016/0068931 | A1 | 3/2016 | Xu et al. |
| 2017/0211169 | A1 | 7/2017 | Hanaoka et al. |

FOREIGN PATENT DOCUMENTS

| | | | | |
|---|---|---|---|---|
| EP | 2 634 275 | A1 | | 9/2013 |
| JP | 7-508560 | A | | 9/1995 |
| JP | 2000-119774 | A | | 4/2000 |
| JP | 2000-119775 | A | | 4/2000 |
| JP | 2004-263301 | A | | 9/2004 |
| JP | 2008-516081 | A | | 5/2008 |
| JP | 2008-214760 | A | | 9/2008 |
| JP | 2009-509031 | A | | 3/2009 |
| JP | 2013-104071 | A | | 5/2013 |
| JP | 2013104071 | A | * | 5/2013 |
| JP | 2016-511792 | A | | 4/2016 |
| WO | 94/01591 | A1 | | 1/1994 |
| WO | 2006/016442 | A1 | | 2/2006 |
| WO | 2006/016624 | A1 | | 2/2006 |
| WO | 2007/034571 | A1 | | 3/2007 |
| WO | 2008/081947 | A1 | | 7/2008 |
| WO | 2012/057055 | A1 | | 5/2012 |
| WO | 2013/065830 | A1 | | 5/2013 |
| WO | 2015/166998 | A1 | | 11/2015 |
| WO | 2018/034280 | A1 | | 2/2018 |
| WO | 2018/034281 | A1 | | 2/2018 |
| WO | 2018/034282 | A1 | | 2/2018 |
| WO | 2018/034283 | A1 | | 2/2018 |
| WO | 2019/035224 | A1 | | 2/2019 |
| WO | 2019/035225 | A1 | | 2/2019 |
| WO | 2019/035226 | A1 | | 2/2019 |

OTHER PUBLICATIONS

Office Action issued in co-pending Japanese application 2018-5309215, dated Aug. 7, 2018, with Machine translation obtained by Global Dossier on May 8, 2019.
Opposition issued in co-pending Japanese application 2017-567267 dated May 5, 2019 with computer translation.
Opposition issued in co-pending Japanese application 2017-567265 dated May 27, 2019 with computer translation.
Opposition issued in co-pending Japanese application 2017-567266 dated May 27, 2019 with computer translation.
Mima, Genjiro, et al., Journal of the Japan Copper and Brass Research Association, 2 (1963) p. 62-77, with partial translation.
International Search Report issued in application PCT/JP2017/029374, completed Oct. 30, 2017 and dated Nov. 7, 2017.
Office Action issued in Japanese application No. 2017-567262 dated Mar. 26, 2018, with machine translation.
International Search Report issued in application PCT/JP2017/029369, completed Oct. 30, 2017 and dated Nov. 7, 2017.
International Search Report issued in application PCT/JP2017/029376, completed Oct. 30, 2017 and dated Nov. 7, 2017.
Office Action issued in Japanese application No. 2017-567267 dated Mar. 26, 2018, with machine translation.
International Search Report issued in application PCT/JP2017/029371, completed Oct. 30, 2017 and dated Nov. 7, 2017.
Office Action issued in Japanese application No. 2017-567265 dated Mar. 26, 2018, with machine translation.
International Search Report issued in application PCT/JP2017/029373, completed Oct. 30, 2017 and dated Nov. 7, 2017.
International Search Report issued in application PCT/JP2018/006203, completed Apr. 26, 2018 and dated May 15, 2018.
International Search Report issued in application PCT/JP2018/006218, completed Apr. 26, 2018 and dated May 15, 2018.
International Search Report issued in application PCT/JP2018/006245, completed Apr. 26, 2018 and dated May 15, 2018.
Opposition issued in co-pending Japanese application 2017-567267 on Mar. 5, 2019 with computer translation.
Opposition issued in co-pending Japanese application 2017-567265 on Mar. 27, 2019 with computer translation.
Opposition issued in co-pending Japanese application 2017-567266 on Mar. 27, 2019 with computer translation.

* cited by examiner

CROSS-SECTION OF TEST No.T601
AFTER USE IN HARSH WATER ENVIRONMENT FOR 8 YEARS

CROSS-SECTION OF TEST No.T602
AFTER DEZINCIFICATION CORROSION TEST 1

CROSS-SECTION OF TEST No.T28
AFTER DEZINCIFICATION CORROSION TEST 1

FREE-CUTTING COPPER ALLOY, AND METHOD FOR PRODUCING FREE-CUTTING COPPER ALLOY

This is Divisional Application of U.S. Ser. No. 16/325,267, filed Feb. 13, 2019, which is a National Phase Application in the United States of International Patent Application No. PCT/JP2017/029376 filed Aug. 15, 2017, which claims priority on Japanese Patent Application No. 2016-159238, filed Aug. 15, 2016. The entire disclosures of the above patent applications are hereby incorporated by reference.

TECHNICAL FIELD

The present invention relates to a free-cutting copper alloy having excellent corrosion resistance, excellent impact resistance, high strength, and high-temperature strength in which the lead content is significantly reduced, and a method of manufacturing the free-cutting copper alloy. In particular, the present invention relates to a free-cutting copper alloy used in devices such as faucets, valves, or fittings for drinking water consumed by a person or an animal every day as well as valves, fittings and the like for electrical uses, automobiles, machines, and industrial plumbing in various harsh environments, and a method of manufacturing the free-cutting copper alloy.

Priority is claimed on Japanese Patent Application No. 2016-159238, ≤filed on Aug. 15, 2016, the content of which is incorporated herein by reference.

BACKGROUND ART

Conventionally, as a copper alloy that is used in devices for drinking water and valves, fittings and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. In addition, it is said that a regulation for reducing the amount of Pb leaching from the drinking water supply devices to about 5 mass ppm will come into force in the future. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV regulations and RoHS regulations of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength under high temperature (for example, 150° C.), and thus cannot realize a reduction in thickness and weight, for example, in automobile components used under high temperature near the engine room when the sun is blazing, or in plumbing pipes used under high temperature and high pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including an extremely small amount of 0.02 mass % or lower of Pb having excellent machinability that is mainly realized by defining the total area of γ phase and κ phase. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, an extremely small amount of Zr is added in the presence of P, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, β phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle.

Therefore, when a large amount of γ phase is contained, problems arise in corrosion resistance, impact resistance, high-temperature strength (high temperature creep), and the like in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445

Non-Patent Document

[Non-Patent Document 1] Genjiro MIMA, Masaharu HASEGAWA, Journal of the Japan Copper and Brass Research Association, 2 (1963), p. 62 to 77

SUMMARY OF THE INVENTION

Problem that the Invention is to Solve

The present invention has been made in order to solve the above-described problems of the conventional art, and an object thereof is to provide a free-cutting copper alloy having excellent corrosion resistance in a harsh environment, impact resistance, and high-temperature strength, and a method of manufacturing the free-cutting copper alloy. In this specification, unless specified otherwise, corrosion resistance refers to both dezincification corrosion resistance and stress corrosion cracking resistance.

Means for Solving the Problem

In order to achieve the object by solving the problems, a free-cutting copper alloy according to the first aspect of the present invention includes:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.25 mass % of Pb; and a balance including Zn and inevitable impurities, wherein when a Cu content is represented by [Cu] mass %, a Si content is represented by [Si] mass %, a Sn content is represented by [Sn] mass %, a P content is represented by

[P] mass %, and a Pb content is represented by [Pb] mass %, the relations of $$76.25 \leq f1 = [Cu] + 0.8 \times [Si] - 8.5 \times [Sn] + [P] + 0.5 \times [Pb] \leq 80.3 \text{ and}$$

$$61.5 \leq f2 = [Cu] - 4.3 \times [Si] - 0.7 \times [Sn] - [P] + 0.5 \times [Pb] \leq 63.3$$

are satisfied, in constituent phases of metallographic structure, when an area ratio of α phase is represented by (α) %, an area ratio of β phase is represented by ((3) %, an area ratio of γ phase is represented by (γ) %, an area ratio of κ phase is represented by (κ) %, and an area ratio of β phase is represented by (μ) %, the relations of $$25 \leq (\kappa) \leq 65,$$

$$0 \leq (\gamma) \leq 1.5,$$

$$0 \leq (\beta) \leq 0.2,$$

$$0 \leq (\mu) \leq 2.0,$$

$$97.0 \leq f3 = (\alpha) + (\kappa),$$

$$99.4 \leq f4 = (\alpha) + (\kappa) + (\gamma) + (\mu),$$

$$0 \leq f5 = (\gamma) + (\mu) \leq 2.5, \text{ and}$$

$$27 \leq f6 = (\kappa) + 6 \times (\gamma)^{1/2} + 0.5 \times (\mu) \leq 70$$

are satisfied, the length of the long side of γ phase is 40 μm or less, the length of the long side of μ phase is 25 μm or less, and κ phase is present in α phase.

According to the second aspect of the present invention, the free-cutting copper alloy according to the first aspect further includes:

one or more element(s) selected from the group consisting of 0.02 mass % to 0.08 mass % of Sb, 0.02 mass % to 0.08 mass % of As, and 0.02 mass % to 0.30 mass % of Bi.

A free-cutting copper alloy according to the third aspect of the present invention includes:

75.5 mass % to 78.0 mass % of Cu;

3.1 mass % to 3.4 mass % of Si;

0.10 mass % to 0.27 mass % of Sn;

0.06 mass % to 0.13 mass % of P;

0.024 mass % to 0.24 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.6 \leq f1 = [Cu] + 0.8 \times [Si] - 8.5 \times [Sn] + [P] + 0.5 \times [Pb] \leq 79.6 \text{ and}$$

$$61.7 \leq f2 = [Cu] - 4.3 \times [Si] - 0.7 \times [Sn] - [P] + 0.5 \times [Pb] \leq 63.2$$

are satisfied, in constituent phases of metallographic structure, when an area ratio of α phase is represented by (α) %, an area ratio of β phase is represented by (β) %, an area ratio of γ phase is represented by (γ) %, an area ratio of κ phase is represented by (κ) %, and an area ratio of μ phase is represented by (μ) %, the relations of $$30 \leq (\kappa) \leq 56,$$

$$0 \leq (\gamma) \leq 0.8,$$

$$(\beta) = 0,$$

$$0 \leq (\mu) \leq 1.0,$$

$$98.0 \leq f3 = (\alpha) + (\kappa),$$

$$99.6 \leq f4 = (\alpha) + (\kappa) + (\gamma) + (\mu),$$

$$0 \leq f5 = (\gamma) + (\mu) \leq 1.5, \text{ and}$$

$$32 \leq f6 = (\kappa) + 6 \times (\gamma)^{1/2} + 0.5 \times (\mu) \leq 62$$

are satisfied, the length of the long side of γ phase is 30 μm or less, the length of the long side of μ phase is 15 μm or less, and κ phase is present in α phase.

According to the fourth aspect of the present invention, the free-cutting copper alloy according to the third aspect further includes:

one or more element(s) selected from the group consisting of higher than 0.02 mass % and 0.07 mass % or lower of Sb, higher than 0.02 mass % and 0.07 mass % or lower of As, and 0.02 mass % to 0.20 mass % of Bi.

According to the fifth aspect of the present invention, in the free-cutting copper alloy according to any one of the first to fourth aspects of the present invention, a total amount of Fe, Mn, Co, and Cr as the inevitable impurities is lower than 0.08 mass %.

According to the sixth aspect of the present invention, in the free-cutting copper alloy according to any one of the first to fifth aspects of the present invention, the amount of Sn in κ phase is 0.08 mass % to 0.45 mass %, and the amount of P in κ phase is 0.07 mass % to 0.24 mass %.

According to the seventh aspect of the present invention, in the free-cutting copper alloy according to any one of the first to sixth aspects of the present invention, a Charpy impact test value is higher than 14 J/cm$^2$ and lower than 50 J/cm$^2$, a tensile strength is 530 N/mm$^2$ or higher, and a creep strain after holding the material at 150° C. for 100 hours in a state where a load corresponding to 0.2% proof stress at room temperature is applied is 0.4% or lower. The Charpy impact test value is a value of a specimen having an U-shaped notch.

According to the eighth aspect of the present invention, the free-cutting copper alloy according to any one of the first to seventh aspects of the present invention is used in a device for water supply, an industrial plumbing member, a device that comes in contact with liquid, an automobile component, or an electrical appliance component.

The method of manufacturing a free-cutting copper alloy according to the ninth aspect of the present invention is a method of manufacturing the free-cutting copper alloy according to any one of the first to eighth aspects of the present invention which includes:

any one or both of a cold working step and a hot working step; and an annealing step that is performed after the cold working step or the hot working step, wherein in the annealing step, the material is held at a temperature of 510° C. to 575° C. for 20 minutes to 8 hours or is cooled in a temperature range from 575° C. to 510° C. at an average cooling rate of 0.1° C./min to 2.5° C./min, and subsequently the material is cooled in a temperature range from 470° C. to 380° C. at an average cooling rate of higher than 2.5° C./min and lower than 500° C./min.

The method of manufacturing a free-cutting copper alloy according to the tenth aspect of the present invention is a method of manufacturing the free-cutting copper alloy according to any one of the first to eighth aspects of the present invention which includes:

a hot working step, in which the material's temperature during hot working is 600° C. to 740° C., wherein when hot extrusion is performed as the hot working, the material is cooled in a temperature range from 470° C. to 380° C. at an average cooling rate of higher than 2.5° C./min and lower than 500° C./min in the process of cooling, and wherein when hot forging is performed as the hot working, the material is cooled in a temperature range from 575° C. to 510° C. at an average cooling rate of 0.1° C./min to 2.5° C./min and subsequently is cooled in a temperature range from 470° C. to 380° C. at an average cooling rate of higher than 2.5° C./min and lower than 500° C./min in the process of cooling.

The method of manufacturing a free-cutting copper alloy according to the eleventh aspect of the present invention is a method of manufacturing the free-cutting copper alloy according to any one of the first to eighth aspects of the present invention which includes:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

Advantage of the Invention

According to the aspects of the present invention, a metallographic structure in which the amount of μ phase that is effective for machinability is reduced as much as possible while minimizing the amount of γ phase that has an excellent machinability-improving function but has low corrosion resistance, impact resistance and high-temperature strength (high temperature creep) is defined. Further, a composition and a manufacturing method for obtaining this metallographic structure are defined. Therefore, according to the aspects of the present invention, it is possible to provide a free-cutting copper alloy having excellent corrosion resistance in a harsh environment, impact resistance, ductility, wear resistance, normal-temperature strength, and high-temperature strength, and a method of manufacturing the free-cutting copper alloy.

BEST MODE FOR CARRYING OUT THE INVENTION

Figure 1:
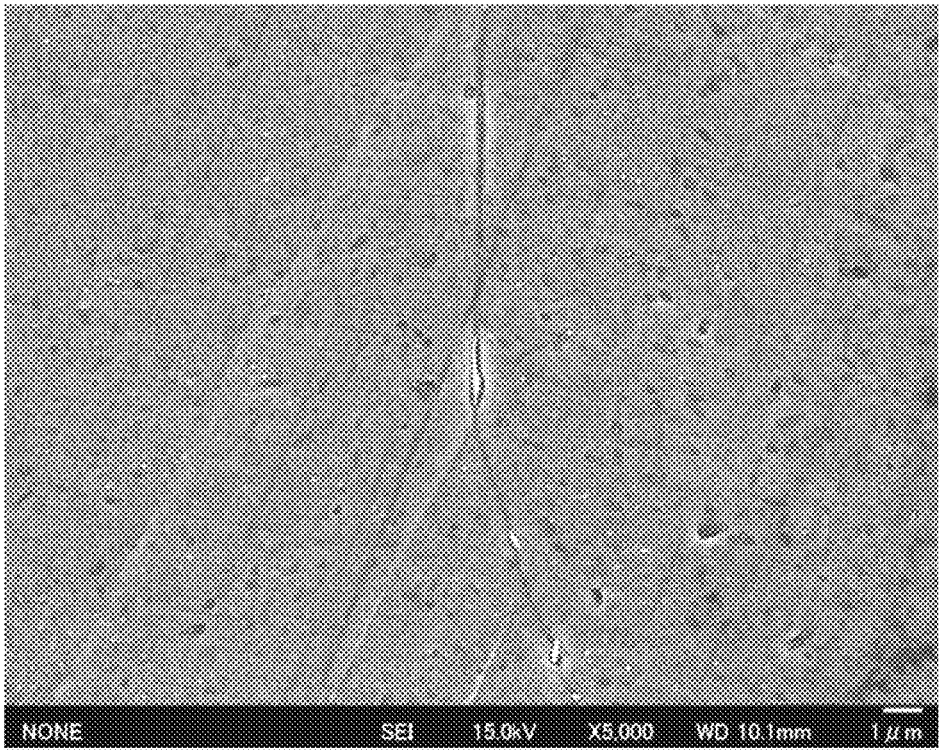
FIG. 1 is an electron micrograph of a metallographic structure of a free-cutting copper alloy (Test No. T05) according to Example 1.

Below is a description of free-cutting copper alloys according to the embodiments of the present invention and the methods of manufacturing the free-cutting copper alloys.

The free-cutting copper alloys according to the embodiments are for use in devices such as faucets, valves, or fittings to supply drinking water consumed by a person or an animal every day, components for electrical uses, automobiles, machines and industrial plumbing such as valves or fittings, and devices and components that contact liquid, or sliding components.

Here, in this specification, an element symbol in parentheses such as [Zn] represents the content (mass %) of the element.

In the embodiment, using this content expressing method, a plurality of composition relational expressions are defined as follows.

Composition Relational Expression $f1=[Cu]+0.8\times[Si]-8.5\times[Sn]+[P]+0.5\times[Pb]$ Composition Relational Expression $f2=[Cu]-4.3\times[Si]-0.7\times[Sn]-[P]+0.5\times[Pb]$ Further, in the embodiments, in constituent phases of metallographic structure, an area ratio of α phase is represented by (α) %, an area ratio of β phase is represented by (β) %, an area ratio of γ phase is represented by (γ) %, an area ratio of κ phase is represented by (κ) %, and an area ratio of μ phase is represented by (μ) %. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. The sum of the area ratios of all the constituent phases is 100%.

In the embodiments, a plurality of metallographic structure relational expressions are defined as follows.

Metallographic Structure Relational Expression $f3=(\alpha)+(\kappa)$

Metallographic Structure Relational Expression $f4=(\alpha)+(\kappa)+(\gamma)+(\mu)$ Metallographic Structure Relational Expression $f5=(\gamma)+(\mu)$ Metallographic Structure Relational Expression $f6=(\kappa)+6\times(\gamma)^{1/2}+0.5\times(\mu)$ A free-cutting copper alloy according to the first embodiment of the present invention includes: 75.0 mass % to 78.5 mass % of Cu; 2.95 mass % to 3.55 mass % of Si; 0.07 mass % to 0.28 mass % of Sn; 0.06 mass % to 0.14 mass % of P; 0.022 mass % to 0.25 mass % of Pb; and a balance including Zn and inevitable impurities. The composition relational expression f1 is in a range of 76.280.3, and the composition relational expression f2 is in a range of 61.5≤f2≤63.3. The area ratio of κ phase is in a range of 25≤(κ)≤65, the area ratio of γ phase is in a range of 0≤(γ)≤1.5, the area ratio of β phase is in a range of 0≤(β)≤0.2, and the area ratio of μ phase is in a range of The metallographic structure relational expression f3 is in a range of f3≤97.0, the metallographic structure relational expression f4 is in a range of f4≤99.4, the metallographic structure relational expression f5 is in a range of 0≤f5≤2.5, and the metallographic structure relational expression f6 is in a range of 27≤f6≤70. The length of the long side of γ phase is 40 μm or less, the length of the long side of μ phase is 25 μm or less, and κ phase is present in α phase.

A free-cutting copper alloy according to the second embodiment of the present invention includes: 75.5 mass % to 78.0 mass % of Cu; 3.1 mass % to 3.4 mass % of Si; 0.10 mass % to 0.27 mass % of Sn; 0.06 mass % to 0.13 mass % of P; 0.024 mass % to 0.24 mass % of Pb; and a balance including Zn and inevitable impurities. The composition relational expression f1 is in a range of 76.6≤f1≤79.6, and the composition relational expression f2 is in a range of 61.7≤f2≤63.2. The area ratio of κ phase is in a range of 30≤(κ)≤56, the area ratio of γ phase is in a range of 0≤(γ)≤0.8, the area ratio of β phase is 0, and the area ratio of β phase is in a range of 0≤(μ)≤1.0. The metallographic structure relational expression f3 is in a range of f3≤98.0, the metallographic structure relational expression f4 is in a range of f4≤99.6, the metallographic structure relational expression f5 is in a range of 0≤f5≤1.5, and the metallographic structure relational expression f6 is in a range of 32≤f6≤62. The length of the long side of γ phase is 30 μm or less, the length of the long side of μ phase is 15 μm or less, and κ phase is present in α phase.

In addition, the free-cutting copper alloy according to the first embodiment of the present invention may further include one or more element(s) selected from the group consisting of 0.02 mass % to 0.08 mass % of Sb, 0.02 mass % to 0.08 mass % of As, and 0.02 mass % to 0.30 mass % of Bi.

In addition, the free-cutting copper alloy according to the second embodiment of the present invention may further include one or more element(s) selected from the group consisting of higher than 0.02 mass % and 0.07 mass % or lower of Sb, higher than 0.02 mass % and 0.07 mass % or lower of As, and 0.02 mass % to 0.20 mass % of Bi.

Further, in the free-cutting copper alloy according to the first and second embodiments of the present invention, it is preferable that the amount of Sn in κ phase is 0.08 mass % to 0.45 mass %, and it is preferable that the amount of P in κ phase is 0.07 mass % to 0.24 mass %.

In addition, in the free-cutting copper alloys according to the first and second embodiments of the present invention, it is preferable that a Charpy impact test value is higher than 14 J/cm$^2$ and lower than 50 J/cm$^2$, it is preferable that a tensile strength is 530 N/mm$^2$ or higher, and it is preferable that a creep strain after holding the copper alloy at 150° C. for 100 hours in a state where 0.2% proof stress (load corresponding to 0.2% proof stress) at room temperature is applied is 0.4% or lower.

The reason why the component composition, the composition relational expressions f1 and f2, the metallographic structure, the metallographic structure relational expressions f3, f4, and f5, and the mechanical properties are defined as above is explained below.

<Component Composition>

(Cu)

Cu is a main element of the alloys according to the embodiments. In order to achieve the object of the present invention, it is necessary to add at least 75.0 mass % or higher of Cu. When the Cu content is lower than 75.0 mass %, the proportion of γ phase is higher than 1.5% although depending on the contents of Si, Zn, and Sn, and the manufacturing process, and dezincification corrosion resistance, stress corrosion cracking resistance, impact resistance, ductility, normal-temperature strength, and high-temperature strength (high temperature creep) deteriorate. In some cases, β phase may also appear. Accordingly, the lower limit of the Cu content is 75.0 mass % or higher, preferably 75.5 mass % or higher, and more preferably 75.8 mass % or higher.

On the other hand, when the Cu content is higher than 78.5 mass %, cost of alloy increases because a large amount of expensive copper is used. Further, the effects on corrosion resistance, normal-temperature strength, and high-temperature strength are saturated, and the proportion of κ phase may become excessively high. In addition, μ phase having a high Cu concentration, in some cases, ζ phase and χ phase are more likely to precipitate. As a result, machinability, impact resistance, and hot workability may deteriorate although depending on the conditions of the metallographic structure. Accordingly, the upper limit of the Cu content is 78.5 mass % or lower, preferably 78.0 mass % or lower, and more preferably 77.5 mass % or lower.

(Si)

Si is an element necessary for obtaining many of the excellent properties of the alloys according to the embodiments. Si contributes to formation of metallic phases such as κ phase, γ phase, or μ phase. Si improves machinability, corrosion resistance, stress corrosion cracking resistance, strength, high-temperature strength, and wear resistance of the alloys according to the embodiments. With respect to machinability, α phase does not substantially improve machinability by containing Si. However, the alloy is able to have excellent machinability without containing a large amount of Pb due to phases harder than α phase such as γ phase, κ phase, and μ phase that are formed by addition of Si. However, as the proportion of the metallic phase such as γ phase or μ phase increases, problems like deterioration of ductility, impact resistance, corrosion resistance in a harsh environment, and high temperature creep properties required for withstanding long-term use arise. Therefore, it is necessary to define appropriate ranges for κ phase, γ phase, μ phase, and β phase.

In addition, Si has an effect of significantly suppressing evaporation of Zn during melting or casting. Further, by increasing the Si content, the specific gravity can be reduced.

In order to solve these problems of a metallographic structure and to have all the desired properties, it is necessary to add 2.95 mass % or higher amount of Si although depending on the contents of Cu, Zn, Sn, and the like. The lower limit of the Si content is preferably 3.05 mass % or higher, more preferably 3.1 mass % or higher, and still more preferably 3.15 mass % or higher. It may look as if the Si content should be reduced in order to reduce the proportion of γ phase or μ phase having a high Si concentration. However, as a result of a thorough study on a mixing ratio between Si and other elements and the manufacturing process, it was found that it is necessary to define the lower limit of the Si content as described above. In addition, although depending on the contents of other elements, the composition relational expressions, and the manufacturing process, once Si content reaches about 2.95 mass %, elongated acicular κ phase starts to appear in α phase, and when the Si content is about 3.1 mass % or higher, the amount of acicular κ phase increases. Due to the presence of κ phase in α phase, tensile strength, machinability, impact resistance, and wear resistance are improved without deterioration in ductility. Hereinafter, κ phase present in α phase will also be referred to as κ1 phase.

On the other hand, when the Si content is excessively high, a problem may arise if the amount of κ phase, which is harder than α phase, is excessively large because ductility and impact resistance are important in the embodiments. Therefore, the upper limit of the Si content is 3.55 mass % or lower, preferably 3.45 mass % or lower, more preferably 3.4 mass % or lower, and still more preferably 3.35 mass % or lower.

(Zn)

Zn is a main element of the alloy according to the embodiments together with Cu and Si and is required for improving machinability, corrosion resistance, strength, and castability. Zn is included in the balance, but to be specific, the upper limit of the Zn content is about 21.7 mass % or lower, and the lower limit thereof is about 17.5 mass % or higher.

(Sn)

Sn significantly improves dezincification corrosion resistance, in particular, in a harsh environment and improves stress corrosion cracking resistance, machinability, and wear resistance. In a copper alloy including a plurality of metallic phases (constituent phases), there is a difference in corrosion resistance between the respective metallic phases. Even in a case where the two phases that remain in the metallographic structure are α phase and κ phase, corrosion begins from a phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.4 times the amount of Sn distributed in α phase. That is, the amount of Sn distributed in κ phase is about 1.4 times the amount of Sn distributed in a phase. As the amount of Sn in κ phase is more than a phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase. Sn itself does not have any excellent machinability improvement function, but improves the machinability of the alloy by forming γ phase having excellent machinability. On the other hand, γ phase deteriorates alloy corrosion resistance, ductility, impact resistance, and high-temperature strength. The amount of Sn distributed in γ phase is about 10 times to 17 times the amount of Sn distributed in α phase. That is, the amount of Sn distributed in γ phase is about 10 times to 17 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. In addition, a large amount of Sn is distributed in γ phase. Therefore, unless a mixing ratio between the essential elements of Cu, Si, P, and Pb is appropriately adjusted and the metallographic structure is put into an appropriate state by means including adjustment of the manufacturing process, addition of Sn merely slightly improves the corrosion resistance of κ phase and α phase. Instead, an increase in γ phase causes deterioration in alloy corrosion resistance, ductility, impact resistance, and high temperature properties. In addition, when κ phase contains Sn, its machinability improves. This effect is further improved by addition of P together with Sn.

By performing a control of a metallographic structure including the relational expressions and the manufacturing process described below, a copper alloy having excellent properties can be prepared. In order to exhibit the above-described effect, the lower limit of the Sn content needs to be 0.07 mass % or higher, preferably 0.10 mass % or higher, and more preferably 0.12 mass % or higher.

On the other hand, when the Sn content is higher than 0.28 mass %, the proportion of γ phase increases. As a countermeasure, it is necessary to metallographically increase κ phase by increasing Cu concentration. Therefore, higher impact resistance may not be obtained. The upper limit of the Sn content is 0.28 mass % or lower, preferably 0.27 mass % or lower, and more preferably 0.25 mass % or lower.

(Pb)

Addition of Pb improves the machinability of copper alloy. About 0.003 mass % of Pb is solid-solubilized in the matrix, and the amount of Pb in excess of 0.003 mass % is present in the form of Pb particles having a diameter of about 1 μm. Pb has an effect of improving machinability even with a small amount of addition. In particular, when the Pb content is higher than 0.02 mass %, a significant effect starts to be exhibited. In the alloy according to the embodiment, the proportion of γ phase having excellent machinability is limited to be 1.5% or lower. Therefore, a small amount of Pb works in place of γ phase.

Therefore, the lower limit of the Pb content is 0.022 mass % or higher, preferably 0.024 mass % or higher, and more preferably 0.025 mass % or higher. In particular, when the value of the metallographic structure relational expression f6 relating to machinability is lower than 32, it is preferable that the Pb content is 0.024 mass % or higher.

On the other hand, Pb is harmful to a human body and influences impact resistance and high-temperature strength. Therefore, the upper limit of the Pb content is 0.25 mass % or lower, preferably 0.24 mass % or lower, more preferably 0.20 mass % or lower, and most preferably 0.10 mass % or lower.

(P)

As in the case of Sn, P significantly improves dezincification corrosion resistance and stress corrosion cracking resistance, in particular, in a harsh environment.

As in the case of Sn, the amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, the effect of improving the corrosion resistance of κ phase is low. However, in cases where P is present together with Sn, the corrosion resistance of κ phase can be improved. P scarcely improves the corrosion resistance of γ phase. In addition, P contained in κ phase slightly improves the machinability of κ phase. By adding P together with Sn, machinability can be more effectively improved.

In order to exhibit the above-described effects, the lower limit of the P content is 0.06 mass % or higher, preferably 0.065 mass % or higher, and more preferably 0.07 mass % or higher.

On the other hand, in cases where the P content is higher than 0.14 mass %, the effect of improving corrosion resistance is saturated. In addition, a compound of P and Si is more likely to be formed, impact resistance and ductility deteriorates, and machinability becomes adversely affected also. Therefore, the upper limit of the P content is 0.14 mass % or lower, preferably 0.13 mass % or lower, and more preferably 0.12 mass % or lower.

(Sb, As, Bi)

As in the case of P and Sn, Sb and As significantly improve dezincification corrosion resistance and stress corrosion cracking resistance, in particular, in a harsh environment.

In order to improve corrosion resistance by addition of Sb, it is necessary to add 0.02 mass % or higher of Sb, and it is preferable to add higher than 0.02 mass % of Sb. On the other hand, even if Sb content is higher than 0.08 mass %, the effect of improving corrosion resistance is saturated, and the proportion of γ phase increases instead. Therefore, Sb content is 0.08 mass % or lower and preferably 0.07 mass % or lower.

In order to improve corrosion resistance due to addition of As, it is necessary to add 0.02 mass % or higher of As, and it is preferable to add higher than 0.02 mass % of As. On the other hand, even if As content is higher than 0.08 mass %, the effect of improving corrosion resistance is saturated. Therefore, the As content is 0.08 mass % or lower and preferably 0.07 mass % or lower.

By adding Sb alone, the corrosion resistance of a phase is improved. Sb is a metal of low melting point although it has a higher melting point than Sn, and exhibits similar behavior to Sn. The amount of Sn distributed in γ phase or κ phase is larger than the amount of Sn distributed in α phase. By adding Sn together, Sb has an effect of improving the corrosion resistance of κ phase. However, regardless of whether Sb is added alone or added together with Sn and P, the effect of improving the corrosion resistance of γ phase is low. Rather, addition of an excessive amount of Sb may increase the proportion of γ phase.

Among Sn, P, Sb, and As, As strengthens the corrosion resistance of α phase. Even in cases where κ phase is corroded, the corrosion resistance of α phase is improved, and thus As functions to prevent α phase from corroding in a chain reaction. However, regardless of whether As is added alone or added together with Sn, P, and Sb, the effect of improving the corrosion resistance of κ phase and γ phase is low.

In cases where both Sb and As are added, even when the total content of Sb and As is higher than 0.10 mass %, the effect of improving corrosion resistance is saturated, and ductility and impact resistance deteriorate. Therefore, the total content of Sb and As is preferably 0.10 mass % or lower. As in the case of Sn, Sb has an effect of improving the corrosion resistance of κ phase. Therefore, when the amount of [Sn]+0.7×[Sb] is higher than 0.12 mass %, the corrosion resistance of the alloy is further improved.

Bi further improves the machinability of the copper alloy. For Bi to exhibits the effect, it is necessary to add 0.02 mass % or higher of Bi, and it is preferable to add 0.025 mass % or higher of Bi. On the other hand, whether Bi is harmfulness to human body is uncertain However, considering the influence on impact resistance and high-temperature strength, the upper limit of the Bi content is 0.30 mass % or lower, preferably 0.20 mass % or lower, more preferably 0.15 mass % or lower, and still more preferably 0.10 mass % or lower.

(Inevitable Impurities)

Examples of the inevitable impurities in the embodiment include Al, Ni, Mg, Se, Te, Fe, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, machining step) of the related art, almost all the members and components are machined, and a large amount of copper alloy is wasted at a proportion of 40 to 80% in the process. Examples of the wasted copper alloy include chips, ends of an alloy material, burrs, runners, and products having manufacturing defects. This wasted copper alloy is the main raw material. When chips and the like are insufficiently separated, alloy becomes contaminated by Pb, Fe, Se, Te, Sn, P, Sb, As, Ca, Al, Zr, Ni, or rare earth elements of other free-cutting copper alloys. In addition, the cutting chips include Fe, W, Co, Mo, and the like that originate in tools. The wasted materials include plated product, and thus are contaminated with Ni and Cr, Mg, Fe, Cr, Ti, Co, In, and Ni are mixed into pure copper-based scrap. From the viewpoints of reuse of resources and costs, scrap such as chips including these elements is used as a raw material to the extent that such use does not have any adverse effects to the properties. Empirically speaking, a large part of Ni that is mixed into the alloy comes from the scrap and the like, and Ni may be contained in the amount lower than 0.06 mass %, but it is preferable if the content is lower than 0.05 mass %. Fe, Mn, Co, Cr, or the like forms an intermetallic compound with Si and, in some cases, forms an intermetallic compound with P and affect machinability. Therefore, each amount of Fe, Mn, Co, and Cr is preferably lower than 0.05 mass % and more preferably lower than 0.04 mass %. The total content of Fe, Mn, Co, and Cr is also preferably lower than 0.08 mass %, more preferably lower than 0.07 mass %, and still more preferably lower than 0.06 mass %. With respect to other elements such as Al, Mg, Se, Te, Ca, Zr, Ti, In, W, Mo, B, Ag, and rare earth elements, each amount is preferably lower than 0.02 mass % and more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

(Composition Relational Expression f1)

The composition relational expression f1 is an expression indicating a relation between the composition and the metallographic structure. Even if the amount of each of the elements is in the above-described defined range, unless this composition relational expression f1 is satisfied, the properties that the embodiment targets cannot be obtained. In the composition relational expression f1, a large coefficient of −8.5 is assigned to Sn. When the value of the composition relational expression f1 is lower than 76.2, the proportion of γ phase increases, the long side of γ phase becomes longer, and corrosion resistance, impact resistance, and high temperature properties deteriorate, no matter how the manufacturing process is devised. Accordingly, the lower limit of the composition relational expression f1 is 76.2 or higher, preferably 76.4 or higher, more preferably 76.6 or higher, and still more preferably 76.8 or higher. The more preferable the value of the composition relational expression f1 is, the smaller the area ratio of γ phase is. Even in cases where γ phase is present, γ phase tends to break, and corrosion resistance, impact resistance, ductility, normal temperature strength, and high temperature properties further improve. When the value of the composition relational expression f1 is 76.6 or higher, elongated acicular κ phase (κ1 phase)

comes to appear more clearly in α phase by adjusting the manufacturing process, and tensile strength, machinability, and impact resistance are improved without causing deterioration in ductility.

On the other hand, the upper limit of the composition relational expression f1 mainly influences the proportion of κ phase. When the value of the composition relational expression f1 is higher than 80.3, the proportion of κ phase is excessively high from the viewpoints of ductility and impact resistance. In addition, μ phase is more likely to precipitate. When the proportion of κ phase or μ phase is excessively high, impact resistance, ductility, high temperature properties, hot workability, and corrosion resistance deteriorate. Accordingly, the upper limit of the composition relational expression f1 is 80.3 or lower, preferably 79.6 or lower, and more preferably 79.3 or lower.

This way, by defining the composition relational expression f1 to be in the above-described range, a copper alloy having excellent properties can be obtained. As, Sb, and Bi that are selective elements and the inevitable impurities that are separately defined scarcely affect the composition relational expression f1 because the contents thereof are low, and thus are not defined in the composition relational expression f1.

(Composition Relational Expression f2)

The composition relational expression f2 is an expression indicating a relation between the composition and workability, various properties, and the metallographic structure. When the composition relational expression f2 is lower than 61.5, the proportion of γ phase in the metallographic structure increases, and other metallic phases including β phase are more likely to appear and remain. Therefore, corrosion resistance, impact resistance, cold workability, and high temperature creep properties deteriorate. In addition, during hot forging, crystal grains are coarsened, and cracking is more likely to occur. Accordingly, the lower limit of the composition relational expression f2 is 61.5 or higher, preferably 61.7 or higher, more preferably 61.8 or higher, and still more preferably 62.0 or higher.

On the other hand, when the value of the composition relational expression f2 is higher than 63.3, hot deformation resistance is improved, hot deformability deteriorates, and surface cracking may occur in a hot extruded material or a hot forged product. Partly depending on the hot working ratio or the extrusion ratio, but it is difficult to perform hot working such as hot extrusion or hot forging, for example, at about 630° C. (material's temperature immediately after hot working). In addition, coarse α phase having a length of more than 300 μm and a width of more than 100 μm in a direction parallel to a hot working direction are more likely to appear. When coarse α phase is present, machinability deteriorates, the length of the long side of γ phase that is present at a boundary between α phase and κ phase increases, and strength and wear resistance also deteriorate. In addition, the range of solidification temperature, that is, (from the liquidus temperature to the solidus temperature) becomes higher than 50° C., shrinkage cavities during casting become significant, and sound casting can no longer be obtained. Accordingly, the upper limit of the composition relational expression f2 is 63.3 or lower, preferably 63.2 or lower, and more preferably 63.0 or lower.

This way, by defining the composition relational expression f2 to be in the above-described narrow range, a copper alloy having excellent properties can be manufactured with a high yield. As, Sb, and Bi that are selective elements and the inevitable impurities that are separately defined scarcely affect the composition relational expression f2 because the contents thereof are low, and thus are not defined in the composition relational expression f2.

(Comparison to Patent Documents)

Here, the results of comparing the compositions of the Cu—Zn—Si alloys described in Patent Documents 3 to 9 and the composition of the alloy according to the embodiment are shown in Table 1.

The embodiment and Patent Document 3 are different from each other in the Pb content and the Sn content which is a selective element. The embodiment and Patent Document 4 are different from each other in the Sn content which is a selective element. The embodiment and Patent Document 5 are different from each other in the Pb content.

The embodiment and Patent Documents 6 and 7 are different from each other as to whether or not Zr is added. The embodiment and Patent Document 8 are different from each other as to whether or not Fe is added. The embodiment and Patent Document 9 are different from each other as to whether or not Pb is added and also whether or not Fe, Ni, and Mn are added.

As described above, the alloy according to the embodiment and the Cu—Zn—Si alloys described in Patent Documents 3 to 9 are different from each other in the composition ranges.

TABLE 1

| | Cu | Si | Pb | Sn | P | Fe | Zr | Other Essential Elements |
|---|---|---|---|---|---|---|---|---|
| First Embodiment | 75.0-78.5 | 2.95-3.55 | 0.022-0.25 | 0.07-0.28 | 0.06-0.14 | — | — | |
| Second Embodiment | 75.5-78.0 | 3.1-3.4 | 0.024-0.24 | 0.10-0.27 | 0.06-0.13 | — | — | |
| Patent Document 3 | 69-79 | 2.0-4.0 | — | 0.3-3.5 | 0.02-0.25 | — | — | |
| Patent Document 4 | 69-79 | 2.0-4.0 | 0.02-0.4 | 0.3-3.5 | 0.02-0.25 | — | — | |
| Patent Document 5 | 71.5-78.5 | 2.0-4.5 | 0.005-0.02 | 0.1-1.2 | 0.01-0.2 | 0.5 or lower | — | |
| Patent Document 6 | 69-88 | 2-5 | 0.004-0.45 | 0.1-2.5 | 0.01-0.25 | — | 5 ppm-400 ppm | |
| Patent Document 7 | 69-88 | 2-5 | 0.005-0.45 | 0.05-1.5 | 0.01-0.25 | 0.3 or lower | 5 ppm-400 ppm | |
| Patent Document 8 | 74.5-76.5 | 3.0-3.5 | 0.01-0.25 | 0.05-0.2 | 0.04-0.10 | 0.11-0.2 | — | |
| Patent Document 9 | 70-83 | 1-5 | — | 0.01-2 | 0.1 or lower | 0.01-0.3 | 0.5 or lower | Ni: 0.01-0.3<br>Mn: 0.01-0.3 |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between α phase having low corrosion resistance and a phase adjacent to such phase. In the case of Cu—Zn—Si alloys including three elements of Cu, Zn, and Si, for example, when corrosion resistances of α phase, α' phase, β phase (including β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

With respect to the Si concentration of each phase, that of μ phase is the highest, followed by γ phase, κ phase, α phase, α' phase, and β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

The Cu concentration ranking is: μ phase>κ phase≥α phase>α' phase≥γ phase>β phase from highest to lowest. The Cu concentration in β phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction.

The water quality of drinking water varies across the world including Japan, and this water quality is becoming one where corrosion is more likely to occur to copper alloys. For example, the concentration of residual chlorine used for disinfection for the safety of human body is increasing although the upper limit of chlorine level is regulated. That is to say, the environment where copper alloys that compose water supply devices are used is becoming one in which alloys are more likely to be corroded. The same is true of corrosion resistance in a use environment where a variety of solutions are present, for example, those where component materials for automobiles, machines, and industrial plumbing described above are used.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including three phases of α phase, α' phase, and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, when a large load is applied to a copper alloy member, the γ phase microscopically becomes a stress concentration source. Therefore, γ phase makes the alloy more vulnerable to stress corrosion cracking, deteriorates impact resistance, and further deteriorates high-temperature strength (high temperature creep strength) due to a high-temperature creep phenomenon. μ phase is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase makes the alloy more vulnerable to stress corrosion cracking, deteriorates impact resistance, and deteriorates high-temperature strength. In some cases, the presence of μ phase deteriorates these properties more than γ phase.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and three phases of α phase, α' phase, and κ phase. Therefore, providing that the alloy with a small amount of Pb has excellent machinability, it is necessary that constituent phases of a metallographic structure (metallic phases or crystalline phases) are defined as follows in order to improve corrosion resistance, ductility, impact resistance, strength, and high-temperature strength in a harsh use environment.

Hereinafter, the unit of the proportion of each of the phases is area ratio (area %).

(γ Phase)

γ phase is a phase that contributes most to the machinability of Cu—Zn—Si alloys. In order to improve corrosion resistance, strength, high temperature properties, and impact resistance in a harsh environment, it is necessary to limit γ phase. In order to improve corrosion resistance, it is necessary to add Sn, and addition of Sn further increases the proportion of γ phase. In order to obtain sufficient machinability and corrosion resistance at the same time when Sn has such contradicting effects, the Sn content, the P content, the composition relational expressions f1 and f2, metallographic structure relational expressions described below, and the manufacturing process are limited.

(β Phase and Other Phases)

In order to obtain excellent corrosion resistance and high ductility, impact resistance, strength, and high-temperature strength, the proportions of β phase, γ phase, μ phase, and other phases such as ζ phase in a metallographic structure are particularly important.

The proportion of β phase needs to be at least 0% to 0.2% and is preferably 0.1% or lower, and it is most preferable that β phase is not present.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, it is necessary that the proportion of γ phase is 0% to 1.5% and the length of the long side of γ phase is 40 μm or less.

The length of the long side of γ phase is measured using the following method. Using a metallographic micrograph of, for example, 500-fold or 1000-fold, the maximum length of the long side of γ phase is measured in one visual field. This operation is performed in a plurality of visual fields, for example, five arbitrarily chosen visual fields as described below. The average maximum length of the long side of γ phase calculated from the lengths measured in the respective visual fields is regarded as the length of the long side of γ phase. Therefore, the length of the long side of γ phase can be referred to as the maximum length of the long side of γ phase.

The proportion of γ phase is preferably 1.0% or lower, more preferably 0.8% or lower, and most preferably 0.5% or lower. For example, in cases where the Pb content is 0.03 mass % or lower or the proportion of κ phase is 33% or lower, machinability can be better improved if the amount of γ phase is 0.05% or higher and lower than 0.5% because the properties such as corrosion resistance and machinability will be less affected although depending on the Pb content or the proportion of κ phase.

Since the length of the long side of γ phase affects corrosion resistance, the length of the long side of γ phase is 40 μm or less, preferably 30 μm or less, and more preferably 20 μm or less.

As the amount of γ phase increases, γ phase is more likely to be selectively corroded. In addition, the longer the lengths of γ phase and a series of γ phases are, the more likely γ phase is to be selectively corroded, and the progress of corrosion in the direction away from the surface is accelerated. In addition, the larger the corroded portion is, the more affected the corrosion resistance of α' phase and κ phase or α phase present around the corroded γ phase is.

The proportion of γ phase and the length of the long side of γ phase are closely related to the contents of Cu, Sn, and Si and the composition relational expressions f1 and f2.

As the proportion of γ phase increases, ductility, impact resistance, high-temperature strength, and stress corrosion cracking resistance deteriorate. Therefore, the proportion of γ phase needs to be 1.5% or lower, is preferably 1.0% or lower, more preferably 0.8% or lower, and most preferably 0.5% or lower. γ phase present in a metallographic structure becomes a stress concentration source when put under high stress. In addition, crystal structure of γ phase is BCC, which is also a cause of deterioration in high-temperature strength, impact resistance, and stress corrosion cracking resistance. However, when the proportion of κ phase is 30% or lower, there is a little problem in machinability, and about 0.1% of γ phase (an amount of γ phase which does not affect corrosion resistance, impact resistance, ductility, and high-temperature strength) may be present. In addition, presence of 0.1% to 1.2% of γ phase improves wear resistance.

(μ Phase)

μ phase is effective to improve machinability and affects corrosion resistance, ductility, impact resistance, and high temperature properties. Therefore, it is necessary that the proportion of μ phase is at least 0% to 2.0%. The proportion of μ phase is preferably 1.0% or lower and more preferably 0.3% or lower, and it is most preferable that μ phase is not present. μ phase is mainly present at a grain boundary or α phase boundary. Therefore, in a harsh environment, grain boundary corrosion occurs at a grain boundary where μ phase is present. In addition, when impact is applied, cracks are more likely to develop from hard μ phase present at a grain boundary. In addition, for example, when a copper alloy is used in a valve used around the engine of a vehicle or in a high-temperature, high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 25 μm or less. The length of the long side of μ phase is preferably 15 μm or less, more preferably 5 μm or less, still more preferably 4 μm or less, and most preferably 2 μm or less.

The length of the long side of μ phase is measured using the same method as the method of measuring the length of the long side of γ phase. That is, by using, for example, a 500-fold or 1000-fold metallographic micrograph or using a 2000-fold or 5000-fold secondary electron micrograph (electron micrograph) according to the size of μ phase, the maximum length of the long side of μ phase in one visual field is measured. This operation is performed in a plurality of visual fields, for example, five arbitrarily chosen visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(κ Phase)

Under recent high-speed machining conditions, the machinability of a material including cutting resistance and chip dischargeability is important. However, in order to obtain excellent machinability when the proportion of γ phase which has the highest machinability improvement function is limited to be 1.5% or lower, it is necessary that the proportion of κ phase is at least 25% or higher. The proportion of κ phase is preferably 30% or higher, more preferably 32% or higher, and most preferably 34% or higher. In addition, when the proportion of κ phase is the necessary minimum amount for obtaining satisfy machinability, the material exhibits excellent ductility and impact resistance, and good corrosion resistance, high temperature properties, and wear resistance.

As the proportion of hard κ phase increases, machinability and tensile strength improve. However, on the other hand, as the proportion of κ phase increases, ductility and impact resistance gradually deteriorate. When the proportion of κ phase reaches a certain level, the effect of improving machinability is saturated, and as the proportion of κ phase further increases, machinability deteriorates. In addition, when the proportion of κ phase reaches a certain level, ductility declines, which in turn causes tensile strength to be saturated, and cold workability and hot workability to deteriorate. In consideration of deterioration in ductility or impact resistance and machinability, it is necessary that the proportion of κ phase is 65% or lower. That is, it is necessary that the proportion of κ phase in a metallographic structure is about ⅔ or lower. The proportion of κ phase is preferably 56% or lower, more preferably 52% or lower, and most preferably 48% or lower.

In order to obtain excellent machinability in a state where the area ratio of γ phase having excellent machinability is limited to be 1.5% or lower, it is necessary to improve the machinability of κ phase and a phase themselves. That is, the machinability of κ phase is improved if Sn and P are contained in κ phase. By making acicular κ phase to be present in α phase, the machinability of α phase is improved, and in turn, the machinability of the alloy is improved without significant deterioration in ductility. It is most preferable that the proportion of κ phase in a metallographic structure is about 33% to about 52% from the viewpoints of obtaining ductility, strength, impact resistance, corrosion resistance, high temperature properties, machinability, and wear resistance.

(Presence of Elongated Acicular κ Phase (κ1 phase) in α Phase)

When the above-described requirements of the composition, the composition relational expressions, and the process are satisfied, acicular κ phase starts to appear in α phase. This κ phase is harder than α phase. In addition, the thickness of κ phase (κ1 phase) in a phase is about 0.1 μm to about 0.2 μm (about 0.05 μm to about 0.5 μm), and this κ phase (κ1 phase) is thin, elongated, and acicular. Due to the presence of the thin, elongated, and acicular κ phase (κ1 phase) in α phase, the following effects are obtained.

1) α phase is strengthened, and the tensile strength of the alloy is improved.

2) The machinability of α phase is improved, and machinability such as cutting resistance or chip partibility is improved.

3) Since κ1 phase is present in α phase, there is no adverse effect on corrosion resistance.

4) α phase is strengthened, and wear resistance is improved.

The acicular κ phase present in α phase is affected by a constituent element such as Cu, Zn, or Si or a relational expression. In particular, when the Si content is about 2.95% or higher, the acicular κ phase (κ1 phase) starts to be present in α phase. When the Si content is about 3.05% or about 3.1% or higher, a more significant amount of κ1 phase is present in α phase. When the value of the composition relational expression f2 is 63.0 or lower and further 62.5 or lower, κ1 phase is more likely to be present.

The thin, elongated, and acicular κ phase (κ1 phase) precipitated in α phase can be observed using a metallographic microscope at a magnification of about 500-fold or 1000-fold. However, since it is difficult to calculate the area ratio of κ1 phase, it should be noted that the area ratio of κ1 phase in α phase is included in the area ratio of α phase.

(Metallographic Structure Relational Expressions f3, f4, f5, and f6)

In addition, in order to obtain excellent corrosion resistance, impact resistance, and high-temperature strength, it is necessary that the total proportions of α phase and κ phase (the value of metallographic structure relational expression f3=(α)+(κ)) is 97.0% or higher. The value of f3 is preferably 98.0% or higher, more preferably 98.5% or higher, and most preferably 99.0% or higher. Likewise, the total proportion of α phase, κ phase, γ phase, and μ phase (the value of metallographic structure relational expression f4=(α)+(κ)+(γ)+(μ)) is 99.4% or higher and preferably 99.6% or higher.

Further, it is necessary that the total proportion of γ phase and μ phase (f5=(γ)+(μ)) is 2.5% or lower. The value of f5 is preferably 1.5% or lower, more preferably 1.0% or lower, and most preferably 0.5% or lower. However, when the proportion of κ phase is low, there is a little problem in machinability. Therefore, γ phase may be added in an amount which scarcely affect impact resistance like 0.05% to 0.5%.

The metallographic structure relational expressions f3 to f6 are directed to 10 kinds of metallic phases including α phase, β phase, γ phase, δ phase, ε phase, ζ phase, η phase, κ phase, μ phase, and χ phase, and are not directed to intermetallic compounds, Pb particles, oxides, non-metallic inclusion, non-melted materials, and the like. In addition, acicular κ phase present in α phase is included in α phase, and μ phase that cannot be observed with a metallographic microscope is excluded. Intermetallic compounds that are formed by Si, P, and elements that are inevitably mixed in (for example, Fe, Co, and Mn) are excluded from the area ratio calculation of metallic phase. However, these intermetallic compounds affect machinability, and thus it is necessary to pay attention to the inevitable impurities.

(Metallographic Structure Relational Expression f6)

In the alloy according to the embodiment, it is necessary that machinability is excellent while minimizing the Pb content in the Cu—Zn—Si alloy, and it is necessary that the alloy has particularly excellent corrosion resistance, impact resistance, ductility, normal-temperature strength, and high-temperature strength. However, γ phase improves machinability, but for obtaining excellent corrosion resistance and impact resistance, presence of γ phase has an adverse effect.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 1.5% or lower, it is necessary that the value of the metallographic structure relational expression f6 is in an appropriate range in order to obtain excellent machinability.

γ phase has the highest machinability. However, in particular, when the amount of γ phase is small, that is, the proportion of γ phase is 1.5% or lower, a coefficient that is six times the proportion of κ phase ((κ)) is assigned to the square root value of the proportion of γ phase ((γ) (%)). In order to obtain excellent machinability, it is necessary that the value of the metallographic structure relational expression f6 is 27 or higher. The value of f6 is preferably 32 or higher and more preferably 34 or higher. When the value of the metallographic structure relational expression f6 is 28 to 32, in order to obtain excellent machinability, it is preferable that the Pb content is 0.024 mass % or higher or the amount of Sn in κ phase is 0.11 mass % or higher.

On the other hand, when the value of the metallographic structure relational expression f6 is higher than 62 or 70, machinability deteriorates, and deterioration of impact resistance and ductility becomes more evident. Therefore, it is necessary that the value of the metallographic structure relational expression f6 is 70 or lower. The value of f6 is preferably 62 or lower and more preferably 56 or lower.

(Amounts of Sn and P in κ phase)

In order to improve the corrosion resistance of κ phase, it is preferable if the alloy contains 0.07 mass % to 0.28 mass % of Sn and 0.06 mass % to 0.14 mass % of P.

In the alloy according to the embodiment, when the Sn content is 0.07 to 0.28 mass % and the amount of Sn distributed in α phase is 1, the amount of Sn distributed in κ phase is about 1.4, the amount of Sn distributed in γ phase is about 10 to about 17, and the amount of Sn distributed in μ phase is about 2 to about 3. By devising the manufacturing process, the amount of Sn distributed in γ phase can be reduced to be about 10 times the amount of Sn distributed in α phase. For example, in the case of the alloy according to the embodiment, in a Cu—Zn—Si—Sn alloy including 0.2 mass % of Sn, when the proportion of α phase is 50%, the proportion of κ phase is 49%, and the proportion of γ phase is 1%, the Sn concentration in a phase is about 0.15 mass %, the Sn concentration in κ phase is about 0.22 mass %, and the Sn concentration in γ phase is about 1.8 mass %. When the area ratio of γ phase is high, the amount of Sn consumed by γ phase is large, and the amounts of Sn distributed in κ phase and α phase are small. Accordingly, if the amount of γ phase is small, Sn is effectively used for corrosion resistance and machinability as described below.

On the other hand, assuming that the amount of P distributed in α phase is 1, the amount of P distributed in κ phase is about 2, the amount of P distributed in γ phase is about 3, and the amount of P distributed in μ phase is about 3. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.12 mass %, and the P concentration in γ phase is about 0.18 mass %.

Both Sn and P improve the corrosion resistance of α phase and κ phase, and the amount of Sn and the amount of P in κ phase are about 1.4 times and about 2 times the amount of Sn and the amount of P in α phase, respectively. That is, the amount of Sn in κ phase is about 1.4 times the amount of Sn in α phase, and the amount of P in κ phase is about 2 times the amount of P in α phase. Therefore, the degree of corrosion resistance improvement of κ phase is higher than that of α phase. As a result, the corrosion resistance of κ phase approaches the corrosion resistance of α phase. By adding both Sn and P, in particular, the corrosion resistance of κ phase can be improved. However, even though there is a difference in content, the contribution of Sn to corrosion resistance is higher than that of P.

When the Sn content is lower than 0.07 mass %, the corrosion resistance and dezincification corrosion resistance of κ phase are lower than the corrosion resistance and dezincification corrosion resistance of a phase. Therefore, when used in water of bad quality, κ phase is selectively corroded. Due to a large amount of Sn being distributed to κ phase, corrosion resistance of κ phase, which is lower than the corrosion resistance of α phase, improves, and when κ phase contains a certain concentration of Sn (or higher than that), the corrosion resistance of κ phase and that of α phase narrow. When Sn is contained in κ phase, machinability and wear resistance of κ phase also improve. To that end, the Sn concentration in κ phase is preferably 0.08 mass % or higher, more preferably 0.11 mass % or higher, and still more preferably 0.14 mass % or higher.

On the other hand, a large amount of Sn is distributed in γ phase. However, even if a large amount of Sn is contained in γ phase, the corrosion resistance of γ phase scarcely improves mainly because the crystal structure of γ phase is a BCC structure. On the contrary, if the proportion of γ phase is high, the corrosion resistance of κ phase scarcely improves because the amount of Sn distributed in κ phase is low. If the proportion of γ phase is reduced, the amount of Sn distributed in κ phase increases. When a large amount of Sn is distributed in κ phase, the corrosion resistance and machinability of κ phase are improved, and the loss of the machinability of γ phase can be compensated for by that. It is presumed that, by having a predetermined amount or more of Sn in κ phase, the machinability improvement function of κ phase itself and chip partibility are improved. However, even though the machinability of the alloy improves when the Sn concentration in κ phase is higher than 0.45 mass %, the toughness of κ phase starts to deteriorate. If a higher importance is placed on toughness, the upper limit of the Sn concentration in κ phase is preferably 0.45 mass % or lower, more preferably 0.40 mass % or lower, and still more preferably 0.35 mass % or lower.

On the other hand, as the Sn content increases, it becomes difficult to reduce the amount of γ phase due to a relation between Sn content and contents of other elements such as Cu or Si. In order to adjust the proportion of γ phase to be 1.5% or lower and further 0.8% or lower, the Sn content in the alloy needs to be 0.28 mass % or lower and preferably 0.27 mass % or lower.

As in the case of Sn, when a large amount of P is distributed in κ phase, corrosion resistance is improved, and the machinability of κ phase is also improved. However, when an excessive amount of P is added, P is consumed by formation of an intermetallic compound with Si such that the properties deteriorate, or if excessively solid-solubilized, impact resistance and ductility are impaired. The lower limit of the P concentration in κ phase is preferably 0.07 mass % or higher and more preferably 0.08 mass % or higher. The upper limit of the P concentration in κ phase is preferably 0.24 mass % or lower, more preferably 0.20 mass % or lower, and still more preferably 0.16 mass % or lower.

<Properties>

(Normal-Temperature Strength and High-Temperature Strength)

As strength required in various fields such as valves and devices for drinking water and automobiles, tensile strength that is breaking stress applied to pressure vessel is being made much of. In addition, for example, a valve used in an environment close to the engine room of a vehicle or a high-temperature and high-pressure valve is used in an environment where the temperature can reach maximum 150° C. And the alloy, of course, is required to remain intact without deformation or fracture when a pressure or a stress is applied. In the case of pressure vessels, the allowable stress is affected by the tensile strength.

For this reason, it is preferable that a hot extruded material or a hot forged material, which is a hot worked material, is a high strength material having a tensile strength of 530 $N/mm^2$ or higher under normal temperature. Tensile strength under normal temperature is preferably 550 $N/mm^2$ or higher. In general, cold working is not performed on hot forged materials in practice.

On the other hand, strength of hot worked materials can improve when drawn or wire-drawn in a cold state. When cold working is performed on the alloy according to the embodiment, at a cold working ratio of 15% or lower, the tensile strength increases by 12 $N/mm^2$ per 1% of cold working ratio. On the other hand, the impact resistance decreases by about 4% or 5% per 1% of cold working ratio. For example, when an alloy material having a tensile strength of 560 $N/mm^2$ and an impact value of 30 $J/cm^2$ is cold-drawn at a cold working ratio of 5% to prepare a cold worked material, the tensile strength of the cold worked material is about 620 $N/mm^2$, and the impact value is about 23 $J/cm^2$. If the cold working ratio varies, the tensile strength and the impact value also vary and cannot be determined.

On the other hand, when cold working of drawing or wire-drawing is performed and then a heat treatment is performed under appropriate conditions, tensile strength and impact resistance are both better as compared to merely hot extruded material. By cold working, strength is improved and impact resistance deteriorates. Due to the heat treatment, the proportion of γ phase decreases, the proportion of κ phase increases, and acicular κ phase comes to be present in α phase. In addition, α phase matrix and κ phase recover. As a result, as compared to the merely hot extruded material, corrosion resistance, tensile strength, and impact value significantly improve, and an alloy having higher strength and higher toughness can be obtained.

Regarding the high-temperature strength, it is preferable that a creep strain after holding the copper alloy at 150° C. for 100 hours in a state where a stress corresponding to 0.2% proof stress at room temperature is applied is 0.4% or lower. This creep strain is more preferably 0.3% or lower and still more preferably 0.2% or lower. In this case, even if the copper alloy is exposed to a high temperature as in the case of, for example, a high-temperature and high-pressure valve or a valve used close to the engine room of a vehicle, deformation is not likely to occur, and high-temperature strength is excellent.

Incidentally, in the case of free-cutting brass including 60 mass % of Cu, 3 mass % of Pb with a balance including Zn and inevitable impurities, tensile strength at a normal temperature is 360 N/mm$^2$ to 400 N/mm$^2$ when formed into a hot extruded material or a hot forged product. In addition, even after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are higher than those of conventional free-cutting brass including Pb. That is, the alloy according to the embodiment has high strength at room temperature and scarcely deforms even after being exposed to a high temperature for a long period of time. Therefore, a reduction in thickness and weight can be realized using the high strength. In particular, in the case of a forged material such as a high-pressure valve, cold working cannot be performed. Therefore, high performance and a reduction in thickness and weight can be realized using the high strength.

In the case of the alloy according to the embodiment, there is little difference in the properties under high temperature between an extruded material and a cold worked material. That is, the 0.2% proof stress increases due to cold working, but even if a load corresponding to a high 0.2% proof stress is applied, creep strain after exposing the alloy to 150° C. for 100 hours is 0.4% or lower, and the alloy has high heat resistance. Properties under high temperature are mainly affected by the area ratios of β phase, γ phase, and μ phase, and the higher the area ratios are, the worse high temperature properties are. In addition, the longer the length of the long side of μ phase or γ phase present at a grain boundary of α phase or at a phase boundary is, the worse high temperature properties are.

(Impact Resistance)

In general, a material having high strength, is brittle. It is said that a material having excellent chip partibility has some kind of brittleness. Impact resistance is a property that is contrary to machinability or strength in some aspect.

However, if the copper alloy is for use in various members including drinking water devices such as valves or fittings, automobile components, mechanical components, and industrial plumbing components, the copper alloy needs to have not only high strength but also properties to resist impact. Specifically, when a Charpy impact test is performed using a U-notched specimen, the resultant test value is preferably higher than 14 J/cm$^2$ and more preferably 17 J/cm$^2$ or higher. In particular, when a Charpy impact test is performed using a U-notched specimen of heat treated materials, specifically, a hot forged material and an extruded material on which cold working is not performed, the resultant test value is preferably 17 J/cm$^2$ or higher, more preferably 20 J/cm$^2$ or higher, and still more preferably 24 J/cm$^2$ or higher. As the alloy according to the embodiment relates to an alloy having excellent machinability, it is not necessary that its Charpy impact test value is higher than 50 J/cm$^2$ even though its application is considered. Conversely, if the Charpy impact test value is higher than 50 J/cm$^2$, machinability deteriorates as cutting resistance increases due to improved toughness. Consequently, unseparated chips are more likely to be generated. Therefore, it is preferable that the Charpy impact test value is lower than 50 J/cm$^2$.

When the amount of hard κ phase increases or the Sn concentration in κ phase increases, strength and machinability are improved, but toughness, that is, impact resistance deteriorates. Therefore, strength and machinability are contrary to toughness (impact resistance). Using the following expression, a strength index indicating impact resistance in addition to strength is defined.

$$(\text{Strength Index})=(\text{Tensile Strength})+25\times(\text{Charpy Impact Test Value})^{1/2}$$

Regarding a hot worked material (hot extruded material, hot forged material) and a cold worked material on which light cold working is performed at a working ratio of about 10%, if the strength index is 670 or higher, it can be said that the material has high strength and toughness. The strength index is preferably 680 or higher and more preferably 690 or higher.

Impact resistance has a close relation with a metallographic structure, and γ phase deteriorates impact resistance. In addition, if μ phase is present at a grain boundary of α phase or α phase boundary between α phase, κ phase, and γ phase, the grain boundary and the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, and most preferably 2 μm or less. In addition, in a harsh environment, μ phase present at a grain boundary is more likely to corrode than α phase or κ phase, thus causes grain boundary corrosion and deteriorate properties under high temperature.

In the case of μ phase, if the occupancy ratio is low and the length is short and the width is narrow, it is difficult to detect the μ phase using a metallographic microscope at a magnification of about 500-fold or 1000-fold. When observing μ phase whose length is 5 μm or less, the μ phase may be observed at a grain boundary or a phase boundary using an electron microscope at a magnification of about 2000-fold or 5000-fold, μ phase can be found at a grain boundary or a phase boundary.

<Manufacturing Process>

Next, the method of manufacturing the free-cutting copper alloy according to the first or second embodiment of the present invention is described below.

The metallographic structure of the alloy according to the embodiment varies not only depending on the composition but also depending on the manufacturing process. The metallographic structure of the alloy is affected not only by hot working temperature during hot extrusion and hot forging, heat treatment temperature, and heat treatment conditions but also by an average cooling rate in the process of cooling during hot working or heat treatment. As a result of a thorough study, it was found that the metallographic structure is largely affected by an average cooling rate in a temperature range from 470° C. to 380° C. and an average cooling rate in a temperature range from 575° C. to 510° C., in particular, from 570° C. to 530° C. in the process of cooling during hot working or a heat treatment.

The manufacturing process according to the embodiment is a process required for the alloy according to the embodiment. Basically, the manufacturing process has the following important roles although they are affected by composition.

1) Reduce the amount of γ phase that deteriorates corrosion resistance and impact resistance and shorten the length of the long side of γ phase.

2) Control μ phase that deteriorates corrosion resistance and impact resistance as well as the length of the long side of μ phase.

3) Precipitate acicular κ phase in α phase.

4) Increase the amount (concentration) of Sn that is solid-solubilized in κ phase and α phase by reducing the amount of γ phase and the amount of Sn that is solid-solubilized in γ phase at the same time.

(Melt Casting)

Melting is performed at a temperature of about 950° C. to about 1200° C. that is higher than the melting point (liquidus temperature) of the alloy according to the embodiment by about 100° C. to about 300° C. Casting is performed at about 900° C. to about 1100° C. that is higher than the melting point by about 50° C. to about 200° C. The alloy is cast into a predetermined mold and is cooled by some cooling means such as air cooling, slow cooling, or water cooling. After solidification, constituent phase(s) changes in various ways.

(Hot Working)

Examples of hot working include hot extrusion and hot forging.

Although depending on production capacity of the equipment used, it is preferable that hot extrusion is performed when the temperature of the material during actual hot working, specifically, immediately after the material passes through an extrusion die, is 600° C. to 740° C. If hot working is performed when the material temperature is higher than 740° C., a large amount of β phase is formed during plastic working, and β phase may remain. In addition, a large amount of γ phase remains and has an adverse effect on constituent phase(s) after cooling. In addition, even when a heat treatment is performed in the next step, the metallographic structure of a hot worked material is affected. Specifically, when hot working is performed at a temperature of higher than 740° C., the amount of γ phase is larger than when hot working is performed at a temperature of 740° C. or lower. In addition, in some cases, β phase may remain, or hot working cracking may occur. The hot working temperature is preferably 670° C. or lower and more preferably 645° C. or lower. When hot extrusion is performed at 645° C. or lower, the amount of γ phase in the hot extruded material is reduced. When hot forging or a heat treatment is performed subsequently on the hot extruded material to prepare a hot forged material or a heat treated material, the amount of γ phase in the hot forged material or the heat treated material is further reduced.

During cooling, the material is cooled at an average cooling rate higher than 2.5° C./min and lower than 500° C./min in the temperature range from 470° C. to 380° C. The average cooling rate in the temperature range from 470° C. to 380° C. is preferably 4° C./min or higher and more preferably 8° C./min or higher. As a result, an increase in the amount of μ phase is prevented.

In addition, when the hot working temperature is low, hot deformation resistance increases. From the viewpoint of deformability, the lower limit of the hot working temperature is preferably 600° C. or higher and more preferably 605° C. or higher. When the extrusion ratio is 50 or lower, or when the material is hot forged into a relatively simple shape, hot working can be performed at 600° C. or higher. To be safe, the lower limit of the hot working temperature is preferably 605° C. Although depending on the production capacity of the equipment used, it is preferable to perform hot working at a lowest possible temperature from the viewpoint of the constituent phase(s) of the metallographic structure.

In consideration of feasibility of measurement position, the hot working temperature is defined as a temperature of a hot worked material that can be measured three seconds after hot extrusion or hot forging. The metallographic structure is affected by a temperature immediately after working where large plastic deformation occurs.

Most of extruded materials are made of a brass alloy including 1 to 4 mass % of Pb. Typically, this kind of brass alloy is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the average cooling rate is relatively high. Although depending on the weight of the coil and the like, the wound coil is cooled in a temperature range from 470° C. to 380° C. at a relatively low average cooling rate of about 2° C./min due to a heat keeping effect. After the material's temperature reaches about 300° C., the average cooling rate further declines. Therefore, water cooling is sometimes performed to facilitate the production. In the case of a brass alloy including Pb, hot extrusion is performed at about 600° C. to 800° C. In the metallographic structure immediately after extrusion, a large amount of β phase having excellent hot workability is present. When the average cooling rate after extrusion is high, a large amount of β phase remains in the cooled metallographic structure such that corrosion resistance, ductility, impact resistance, and high temperature properties deteriorate. In order to avoid the deterioration, by cooling at a relatively low average cooling rate using the heat keeping effect of the extruded coil and the like, β phase is made to transform into α phase so that the metallographic structure has abundant α phase. As described above, the average cooling rate of the extruded material is relatively high immediately after extrusion. Therefore, by performing the subsequent cooling at a slower cooling rate, a metallographic structure that is rich in α phase is obtained. Patent Document 1 does not describe the average cooling rate but discloses that, in order to reduce the amount of β phase and to isolate β phase, slow cooling is performed until the temperature of an extruded material is 180° C. lower.

As described above, the alloy according to the embodiment is manufactured with a cooling rate that is completely different from that in the method of manufacturing a conventional brass alloy including Pb.

(Hot Forging)

As a material for hot forging, a hot extruded material is mainly used, but a continuously cast rod is also used. Since a more complex shape is formed in hot forging than in hot extrusion, the temperature of the material before forging is made high. However, the temperature of a hot forged material on which plastic working is performed to create a large, main portion of a forged product, that is, the material's temperature about three seconds after forging is preferably 600° C. to 740° C. as in the case of the extruded material.

If the extrusion temperature during the manufacturing of the hot extruded rod is lowered to obtain a metallographic structure including a small amount of γ phase, when hot forging is performed on the hot extruded rod, a hot forged metallographic structure including a small amount of γ phase can be obtained even if hot forging is performed at a high temperature.

Further, by adjusting the average cooling rate after forging, a material having various properties such as corrosion resistance or machinability can be obtained. That is, the temperature of the forged material three seconds after hot forging is 600° C. to 740° C. When cooling is performed in a temperature range from 575° C. to 510° C., in particular, 570° C. to 530° C. at an average cooling rate of 0.1° C./min to 2.5° C./min in the subsequent process of cooling, the amount of γ phase is reduced. The lower limit of the average cooling rate in a temperature range from 575° C. to 510° C. is set to be 0.1° C./min or higher in consideration of economic efficiency, and when the average cooling rate is higher than 2.5° C./min, the amount of γ phase is not sufficiently reduced. The average cooling rate in a temperature range from 575° C. to 510° C. is preferably 1.5° C./min or lower and more preferably 1° C./min or lower. The average cooling rate in a temperature range from 470° C. to 380° C. is higher than 2.5° C./min and lower than 500° C./min. The average cooling rate in a temperature range from 470° C. to 380° C. is preferably 4° C./min or higher and more preferably 8° C./min or higher. As a result, an increase in the amount of μ phase is prevented. This way, in the temperature range from 575° C. to 510° C., cooling is performed at an average cooling rate of 2.5° C./min or lower and preferably 1.5° C./min or lower. In addition, in the temperature range from 470° C. to 380° C., cooling is performed at an average cooling rate of higher than 2.5° C./min and preferably 4° C./min or higher. This way, by adjusting the average cooling rate to be low in the temperature range from 575° C. to 510° C. and adjusting the average cooling rate to be high in the temperature range from 470° C. to 380° C., a more satisfactory material can be manufactured.

(Cold Working Step)

In order to improve the dimensional accuracy or to straighten the extruded coil, cold working may be performed on the hot extruded material. Specifically, the hot extruded material or the heat treated material is cold-drawn at a working ratio of about 2% to about 20%, preferably about 2% to about 15% and more preferably about 2% to about 10% and then is corrected (combined operation of drawing and straightness correction). In addition, the hot extruded material or the heat treated material is wire-drawn in a cold state at a working ratio of about 2% to about 20%, preferably about 2% to about 15%, and more preferably about 2% to about 10%. Although the cold working ratio is substantially zero, the straightness of the rod material can be improved using a straightness correction facility.

(Heat Treatment (Annealing))

When producing a small product which cannot be made by, for example, hot extrusion, a heat treatment is performed as necessary after cold drawing or cold wire drawing such that the material recrystallizes, that is, is softened. In addition, in the case of hot worked materials, if the material is desired to have substantially no work strain, or if an appropriate metallographic structure is required, a heat treatment is performed as necessary after hot working.

In the case of a brass alloy including Pb, a heat treatment is performed as necessary. In the case of the brass alloy including Bi disclosed in Patent Document 1, a heat treatment is performed under conditions of 350° C. to 550° C. and 1 to 8 hours.

When the alloy according to the embodiment is held at a temperature of 510° C. to 575° C. for 20 minutes to 8 hours, corrosion resistance, impact resistance, and high temperature properties are improved. However, if a heat treatment is performed under a condition where the material's temperature is higher than 620° C., a large amount of γ phase or β phase is formed, and α phase is coarsened. As the heat treatment condition, the heat treatment temperature is preferably 575° C. or lower and more preferably 570° C. or lower. When a heat treatment is performed at a temperature of lower than 510° C., a reduction in the amount of γ phase is small, and μ phase appears. Accordingly, the heat treatment temperature is preferably 510° C. or higher and more preferably 530° C. or higher. Regarding the heat treatment time (the time for which the material is held at the heat treatment temperature), it is necessary to hold the material at a temperature of 510° C. to 575° C. for at least 20 minutes or longer. The holding time contributes to a reduction in the amount of γ phase. Therefore, the holding time is preferably 30 minutes or longer, more preferably 50 minutes or longer, and most preferably 80 minutes or longer. The upper limit of the holding time is 480 minutes or shorter and preferably 240 minutes or shorter from the viewpoint of economic efficiency.

The heat treatment temperature is preferably 530° C. to 570° C. If a heat treatment is performed at 510° C. or higher and lower than 530° C., in order to reduce the amount of γ phase, it is necessary to spend twice or more times the heat treatment time that is required when a heat treatment is performed at 530° C. to 570° C.

A value relating to the heat treatment is defined by the following mathematical formula in which heat treatment time is represented by (t) (min) and the heat treatment temperature is represented by (T) (° C.).

$$\text{(Value relating to Heat Treatment)}=(T-500)\times t$$

Note that when T is 540° C. or higher, T is regarded as 540.

The above value relating to the heat treatment is preferably 800 or higher and more preferably 1200 or higher.

As described above, taking advantage of the high temperature state after hot extrusion or hot forging, cooling is performed under conditions corresponding to holding in a temperature range of 510° C. to 575° C. for 20 minutes or longer by adjusting the average cooling rate, that is, cooling is performed in a temperature range from 575° C. to 510° C. at an average cooling rate of 0.1° C./min to 2.5° C./min in the process of cooling. As a result, the metallographic structure can be improved. Cooling in a temperature range from 575° C. to 510° C. at 2.5° C./min is substantially equivalent to holding in a temperature range of 510° C. to 575° C. for 20 minutes in terms of time. In simple calculation, the material is heated at a temperature of 510° C. to 575° C. for 26 minutes. The average cooling rate is preferably 1.5° C./min or lower and more preferably 1° C./min or lower. The lower limit of the average cooling rate is set to be 0.1° C./min or higher in consideration of economic efficiency.

As another heat treatment method, in the case of a continuous heat treatment furnace where a hot extruded material, a hot forged product, or a cold drawn or cold wire-drawn material moves in a heat source, the above-described problems occur at a temperature higher than 620° C. However, by cooling under conditions corresponding to increasing the material's temperature to 575° C. to 620° C. and subsequently holding in a temperature range of 510° C. to 575° C. for 20 minutes or longer, that is, cooling in a temperature range of 510° C. to 575° C. at an average cooling rate of 0.1° C./min to 2.5° C./min, the metallographic structure can be improved. The average cooling rate in a temperature range from 575° C. to 510° C. is preferably 2° C./min or lower, more preferably 1.5° C./min or lower, and still more preferably 1° C./min or lower. Of course, the temperature is not necessarily set to be 575° C. or higher. For example, in a case where the maximum reaching temperature is 540° C., there is no problem to have the material pass through the furnace so that cooling is performed in the temperature range from 540° C. to 510° C. for at least 20 minutes, preferably, under conditions where the value of (T−500)×t is 800 or higher. When the maximum reaching temperature is 550° C. or higher, which is slightly higher than 540° C., the productivity can be secured, and a desired metallographic structure can be obtained.

Advantages of the heat treatment are not limited to the improvement of corrosion resistance and high temperature properties. If cold working (for example, cold drawing or cold wire drawing) is performed on a hot worked material at a working ratio of 3% to 20% followed by a heat treatment at a temperature of 510° C. to 575° C., or a heat treatment in a continuous annealing furnace on the corresponding conditions is performed, the tensile strength becomes 550 $N/mm^2$ or higher, which is higher than the tensile strength of the hot worked material. Concurrently, the impact resistance of the heat treated material is higher than the impact resistance of the hot worked material. Specifically, the impact resistance of the heat treated material is at least 14$J/cm^2$ or higher and may be 17 $J/cm^2$ or higher or 20 $J/cm^2$ or higher. The strength index is higher than 690. The principle is presumed to be as follows. When the cold working ratio is 3% to 20% and the heating temperature is 510° C. to 575° C., both α phase and κ phase sufficiently recover, but work strain remains in α phase and κ phase to some extent. In the metallographic structure, the amount of hard γ phase is reduced, the amount of κ phase is increased, and acicular κ phase is present in α phase such that α phase is strengthened. As a result, ductility, impact resistance, tensile strength, high temperature properties, and strength index all exceed those of the hot worked material. In the case of a copper alloy that is widely put to general use as a free-cutting copper alloy, if cold-worked at 3% to 20% and then heated to 510° C. to 575° C., the copper alloy is softened by recrystallization.

Of course, if cold working is performed at a cold working ratio of 15% or lower after a predetermined heat treatment, the impact resistance slightly declines, but the material can obtain higher strength with a strength index higher than 690.

By adopting the manufacturing process, an alloy having excellent corrosion resistance and having excellent impact resistance, ductility, strength, and machinability is prepared.

In these heat treatments, the material is cooled to normal temperature. In the process of cooling, it is necessary that the average cooling rate in the temperature range from 470° C. to 380° C. is higher than 2.5° C./min and lower than 500° C./min. The average cooling rate in the temperature range from 470° C. to 380° C. is preferably 4° C./min or higher. That is, from about 500° C. or higher, it is necessary to increase the average cooling rate. In general, when cooling a heat treated item after taking out of the furnace, the lower the temperature of the item is, the lower the average cooling rate is.

Regarding the metallographic structure of the alloy according to the embodiment, one important thing in the manufacturing step is the average cooling rate in the temperature range from 470° C. to 380° C. in the process of cooling after heat treatment or hot working. If the average cooling rate is 2.5° C./min or lower, the proportion of μ phase increases. μ phase is mainly formed around a grain boundary or α phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the average cooling rate in the temperature range from 470° C. to 380° C. is higher than 2.5° C./min, preferably 4° C./min or higher, more preferably 8° C./min or higher, and still more preferably 12° C./min or higher. When rapid cooling from a high material's temperature of 580° C. or higher is performed after hot working at an average cooling rate of, for example, 500° C./min or higher, a large amount of β phase or γ phase may remain. Therefore, the upper limit of the average cooling rate is preferably lower than 500° C./min and more preferably 300° C./min or lower.

When the metallographic structure is observed using a 2000-fold or 5000-fold electron microscope, it can be seen that the average cooling rate in a temperature range from 470° C. to 380° C., which decides whether μ phase appears or not, is about 8° C./min. In particular, the critical average cooling rate that significantly affect the properties is 2.5° C./min or 4° C./min in a temperature range from 470° C. to 380° C. Of course, whether or not μ phase appears depends on the composition, and the formation of μ phase rapidly progresses as the Cu concentration increases, the Si concentration increases, the value of the metallographic structure relational expression f1 increases, and the value of f2 decreases.

That is, when the average cooling rate in a temperature range from 470° C. to 380° C. is lower than 8° C./min, the length of the long side of μ phase precipitated at a grain boundary is longer than about 1 μm, and μ phase further grows as the average cooling rate becomes lower. When the average cooling rate is about 5° C./min, the length of the long side of μ phase is about 3 μm to 10 μm. When the average cooling rate is about 2.5° C./min or lower, the length of the long side of μ phase is higher than 15 μm and, in some cases, is higher than 25 μm. When the length of the long side of μ phase reaches about 10 μm, μ phase can be distinguished from a grain boundary and can be observed using a 1000-fold metallographic microscope. On the other hand, the upper limit of the average cooling rate varies depending on the hot working temperature or the like. If the average cooling rate is excessively high, constituent phase(s) that is formed at a high temperature is maintained as it is even at normal temperature, the amount of κ phase increases, and the amounts of β phase and γ phase that affect corrosion resistance and impact resistance increase. Therefore, mainly, the average cooling rate in a temperature range of 580° C. or higher is important. It is preferable that cooling is performed at an average cooling rate of preferably lower than 500° C./min, and more preferably 300° C./min or lower.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At the upper limit of 550° C., the recrystallization ends. In addition, heat treatment at a higher temperature causes a problem in relation to energy.

In addition, when a heat treatment is performed at a temperature of higher than 550° C., the amount of β phase significantly increases. It is presumed that this is the reason the upper limit is disclosed as 550° C. As a common manufacturing facility, a batch furnace or a continuous furnace is used, and the material is held at a predetermined temperature for 1 to 8 hours. In the case a batch furnace is used, air cooling is performed after furnace cooling or after the material's temperature decreases to about 300° C. In the case a continuous furnace is used, cooling is performed at a relatively low rate until the material's temperature decreases to about 300° C. Specifically, in a temperature range from 470° C. to 380° C., cooling is performed at an average cooling rate of about 0.5 to about 4° C./min (excluding the time during which the material is held at a predetermined temperature from the calculation of the average cooling rate). Cooling is performed at a cooling rate that is different from that of the method of manufacturing the alloy according to the embodiment.

(Low-Temperature Annealing)

A rod material or a forged product may be annealed at a low temperature which is lower than the recrystallization temperature in order to remove residual stress or to correct the straightness of rod material. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted (measured) from when the temperature is 10° C. lower (T−10) than a predetermined temperature T (° C.).

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or α phase boundary. When the low-temperature annealing time is shorter than 10 minutes, residual stress is not removed sufficiently. When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature strength deteriorate. However, as long as low-temperature annealing is performed, precipitation of μ phase is not avoidable. Therefore, how precipitation of μ phase can be minimized while removing residual stress is the key.

The lower limit of the value of $(T-220) \times (t)^{1/2}$ is 150, preferably 180 or higher, and more preferably 200 or higher. In addition, the upper limit of the value of $(T-220) \times (t)^{1/2}$ is 1200, preferably 1100 or lower, and more preferably 1000 or lower.

Using this manufacturing method, the free-cutting copper alloys according to the first and second embodiments of the present invention are manufactured.

The hot working step, the heat treatment (annealing) step, and the low-temperature annealing step are steps of heating the copper alloy. When the low-temperature annealing step is not performed, or the hot working step or the heat treatment (annealing) step is performed after the low-temperature annealing step (when the low-temperature annealing step is not the final step among the steps of heating the copper alloy), the step that is performed later among the hot working steps and the heat treatment (annealing) steps is important, regardless of whether cold working is performed. When the hot working step is performed after the heat treatment (annealing) step, or the heat treatment (annealing) step is not performed after the hot working step (when the hot working step is the final step among the steps of heating the copper alloy), it is necessary that the hot working step satisfies the above-described heating conditions and cooling conditions. When the heat treatment (annealing) step is performed after the hot working step, or the hot working step is not performed after the heat treatment (annealing) step (a case where the heat treatment (annealing) step is the final step among the steps of heating the copper alloy), it is necessary that the heat treatment (annealing) step satisfies the above-described heating conditions and cooling conditions. For example, in cases where the heat treatment (annealing) step is not performed after the hot forging step, it is necessary that the hot forging step satisfies the above-described heating conditions and cooling conditions for hot forging. In cases where the heat treatment (annealing) step is performed after the hot forging step, it is necessary that the heat treatment (annealing) step satisfies the above-described heating conditions and cooling conditions for heat treatment (annealing). In this case, it is not necessary that the hot forging step satisfies the above-described heating conditions and cooling conditions for hot forging.

In the low-temperature annealing step, the material's temperature is 240° C. to 350° C. This temperature relates to whether or not μ phase is formed, and does not relate to the temperature range (575° C. to 510° C.) where the amount of γ phase is reduced. This way, the material's temperature in the low-temperature annealing step does not relate to an increase or decrease in the amount of γ phase. Therefore, when the low-temperature annealing step is performed after the hot working step or the heat treatment (annealing) step (the low-temperature annealing step is the final step among the steps of heating the copper alloy), the conditions of the low-temperature annealing step and the heating conditions and cooling conditions of the step before the low-temperature annealing step (the step of heating the copper alloy immediately before the low-temperature annealing step) are both important, and it is necessary that the low-temperature annealing step and the step before the low-temperature annealing step satisfy the above-described heating conditions and the cooling conditions. Specifically, the heating conditions and cooling conditions of the step that is performed last among the hot working steps and the heat treatment (annealing) steps performed before the low-temperature annealing step are important, and it is necessary that the above-described heating conditions and cooling conditions are satisfied. When the hot working step or the heat treatment (annealing) step is performed after the low-temperature annealing step, as described above, the step that is performed last among the hot working steps and the heat treatment (annealing) steps is important, and it is necessary that the above-described heating conditions and cooling conditions are satisfied. The hot working step or the heat treatment (annealing) step may be performed before or after the low-temperature annealing step.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, impact resistance, and high-temperature strength are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed. Table 2 shows alloy compositions. Since the equipment used was the one on the actual production line, impurities were also measured in the alloys shown in Table 2. In addition, manufacturing steps were performed under the conditions shown in Tables 5 to 10.

(Steps No. A1 to A12 and AH1 to AH9)

Using the low-frequency melting furnace and the semi-continuous casting machine on the actual production line, a billet having a diameter of 240 mm was manufactured. As to raw materials, those used for actual production were used. The billet was cut into a length of 800 mm and was heated. Then hot extruded into a round bar shape having a diameter of 25.6 mm, and the rod bar was wound into a coil (extruded material). Next, using the heat keeping effect of the coil and adjustment of a fan, the extruded material was cooled in temperature ranges from 575° C. to 510° C. and from 470° C. to 380° C. at an average cooling rate of 20° C./min. In a temperature range of 380° C. or lower also, the extruded material was cooled at an average cooling rate of 20° C./min. The temperature was measured using a radiation thermometer placed mainly around the final stage of hot extrusion about three seconds after being extruded from an extruder. The radiation thermometer used was DS-06DF (manufactured by Daido Steel Co., Ltd.).

It was verified that the average temperature of the extruded material was within ±5° C. of a temperature shown in Table 5 (in a range of (temperature shown in Table 5)−5° C. to (temperature shown in Table 5)+5° C.)

In Steps No. AH2, A9, and AH9, the extrusion temperatures were 760° C., 680° C., and 580° C., respectively. In steps other than Steps No. AH2, A9, and AH9, the extrusion temperature was 640° C. In Step No. AH9 in which the extrusion temperature was 580° C., three kinds of prepared materials were not able to be extruded to the end, and the extrusion was given up.

After the extrusion, in Steps No. AH1 and AH2, only straightness correction was performed.

In Steps No. A10 and A11, a heat treatment was performed on an extruded material having a diameter of 25.6 mm. Next, in Steps No. A10 and A11, the extruded materials were cold-drawn at cold working ratios of about 5% and about 9%, respectively, and their straightness was corrected to obtain diameters of 25 mm and 24.4 mm, respectively (combined operation of drawing and straightness correction after heat treatment).

In Step No. A12, the extruded material was cold-drawn at a cold working ratio of about 9% and its straightness was corrected to obtain a diameter of 24.4 mm (combined operation of drawing and straightness correction). Next, a heat treatment was performed.

In Steps other than the above-described steps, the extruded materials were cold-drawn at a cold working ratio of about 5% and their straightness was corrected to obtain a diameter of 25 mm (combined operation of drawing and straightness correction). Next, a heat treatment was performed.

Regarding heat treatment conditions, as shown in Table 5, the heat treatment temperature was made to vary in a range of 500° C. to 635° C., and the holding time was made to vary in a range of 5 minutes to 180 minutes.

In Steps No. A1 to A6, A9 to A12, AH3, AH4, and AH6, a batch furnace was used, and the average cooling rate in a temperature range from 575° C. to 510° C. or the average cooling rate in a temperature range from 470° C. to 380° C. in the process of cooling was made to vary.

In Steps No. A7, A8, AH5, AH7, and AH8, heating was performed at a high temperature for a short period of time using a continuous annealing furnace, and subsequently the average cooling rate in a temperature range from 575° C. to 510° C. or the average cooling rate in a temperature range from 470° C. to 380° C. in the process of cooling was made to vary.

In the following tables, if the combined operation of drawing and straightness correction was performed before the heat treatment, "O" is indicated, and if the combined operation of drawing and straightness correction was not performed before the heat treatment, "-" is indicated.

(Steps No. B1 to B3 and BH1 to BH3)

A material (rod material) having a diameter of 25 mm obtained in Step No. A10 was cut into a length of 3 m. Next, this rod material was set in a mold and was annealed at a low temperature for straightness correction. The conditions of this low-temperature annealing are shown in Table 7.

The conditional expression indicated in Table 7 is as follows:

(Conditional Expression)$=(T-220)\times(t)^{1/2}$

T: temperature (material's temperature) (° C.)

t: heating time (min)

The result was that straightness was poor only in Step No. BH1.

(Steps No. C0, C1, C2, CH1, and CH2)

Using the low-frequency melting furnace and the semi-continuous casting machine used on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded onto an extrusion table in a straight rod shape. The temperature was measured using a radiation thermometer mainly at the final stage of extrusion about three seconds after extrusion from an extruder. It was verified that the average temperature of the extruded material was within ±5° C. of a temperature shown in Table 8 (in a range of (temperature shown in Table 8)−5° C. to (temperature shown in Table 8)+5° C.). The average cooling rate from 575° C. to 510° C. and the average cooling rate from 470° C. to 380° C. after extrusion were 15° C./min (extruded material). In steps described below, extruded materials (round bars) obtained in Steps No. C0 and CH2 were used as materials for forging. In Steps No. C1, C2, and CH1, heating was performed at 560° C. for 60 minutes, and subsequently the average cooling rate from 470° C. to 380° C. was made to vary.

(Steps No. D1 to D8 and DH1 to DH5)

A round bar having a diameter of 50 mm obtained in Step No. C0 was cut into a length of 180 mm. This round bar was horizontally set and was forged into a thickness of 16 mm using a press machine having a hot forging press capacity of 150 ton. About three seconds immediately after hot forging the material into a predetermined thickness, the temperature was measured using the radiation thermometer. It was verified that the hot forging temperature (hot working temperature) was within ±5° C. of a temperature shown in Table 9 (in a range of (temperature shown in Table 9)−5° C. to (temperature shown in Table 9)+5° C.)

In Steps No. D6 and DH5, after hot forging, the average cooling rate in a temperature range from 575° C. to 510° C. was changed. In steps other than Steps No. D6 and DH5, after hot forging, cooling was performed at an average cooling rate of 20° C./min.

In Steps No. DH1, D6, and DH5, the preparation of the samples ended upon completion of cooling after hot forging. In steps other than Steps No. DH1, D6, and DH5, the following heat treatment was performed after hot forging.

In Steps No. D1 to D4 and DH2, a heat treatment was performed in a batch furnace at various heat treatment temperatures and average cooling rates in temperature ranges from 575° C. to 510° C., and from 470° C. to 380° C. in the process of cooling. In Steps No. D5, DH3, and DH4, heating was performed in a continuous furnace at 600° C. for 3 minutes or 2 minutes, with various average cooling rates.

The heat treatment temperature was the same as the maximum reaching temperature, and holding time refers to a period of time in which the material was held in a temperature range from the maximum reaching temperature to (maximum reaching temperature—10° C.).

<Laboratory Experiment>

Using a laboratory facility, a trial manufacture test of copper alloy was performed. Tables 3 and 4 show alloy compositions. The balance refers to Zn and inevitable impurities. The copper alloys having the compositions shown in Table 2 were also used in the laboratory experiment. In addition, manufacturing steps were performed under the conditions shown in Tables 11 to 12.

(Steps No. E1 to E3 and EH1)

In a laboratory, raw materials were mixed at a predetermined component ratio and melted. The melt was cast into a mold having a diameter of 100 mm and a length of 180 mm to prepare a billet. This billet was heated and, in Steps No. E1 and EH1, was extruded into a round bar having a diameter of 25 mm, then the bar's straightness was corrected. In Steps No. E2 and E3, the billet was extruded into a round bar having a diameter of 40 mm, then the straightness was corrected. In Table 11, if straightness correction was performed, "O" is indicated.

Immediately after stopping the extrusion test machine, the temperature was measured using a radiation thermometer. In effect, this temperature corresponds to the temperature of the extruded material about three seconds after being extruded from the extruder.

In Steps No. EH1 and E2, the preparation operations of the samples ended with the extrusion. An extruded material obtained in Step No. E2 was used as a material for hot forging in the steps described below.

In addition, a continuously cast rod having a diameter of 40 mm was prepared by continuous casting and was used as a material for hot forging in the steps described below.

In Steps No. E1 and E3, a heat treatment (annealing) was performed under the conditions shown in Table 11 after extrusion.

(Steps No. F1 to F5, FH1, and FH2)

A round bar having a diameter of 40 mm obtained in Step No. E2 was cut into a length of 180 mm. This round bar obtained in Step No. E2 or the continuously cast rod was horizontally set and was forged to a thickness of 15 mm using a press machine having a hot forging press capacity of 150 ton. About three seconds immediately after hot forging the material to the predetermined thickness, the temperature was measured using a radiation thermometer. It was verified that the hot forging temperature (hot working temperature) was within ±5° C. of a temperature shown in Table 12 (in a range of (temperature shown in Table 12)−5° C. to (temperature shown in Table 12)+5° C.).

The hot-forged material was cooled at the average cooling rate of 20° C./min for a temperature range from 575° C. to 510° C. and at the average cooling rate of 18° C./min for a temperature range from 470° C. to 380° C. respectively. In Step No. FH1, hot forging was performed on the round bar obtained in Step No. E2, and the preparation operation of the sample ended upon cooling the material after hot forging.

In Steps No. F1, F2, and FH2, hot forging was performed on the round bar obtained in Step No. E2, and a heat treatment was performed after hot forging. The heat treatment (annealing) was performed with varied heating conditions, average cooling rates for a temperature range from 575° C. to 510° C., and average cooling rate for a temperature range from 470° C. to 380° C.

In Steps No. F3 and F4, hot forging was performed by using a continuously cast rod as a material for forging. After hot forging, a heat treatment (annealing) was performed with varied heating conditions and average cooling rates.

TABLE 2

| Alloy | Component Composition (mass %) | | | | | | Impurities (mass %) | | | | Composition Relational Expression | |
|---|---|---|---|---|---|---|---|---|---|---|---|---|
| No. | Cu | Si | Pb | Sn | P | Zn | Element | Amount | Element | Amount | f1 | f2 |
| S01 | 76.4 | 3.12 | 0.050 | 0.16 | 0.08 | Balance | Fe | 0.03 | Ni | 0.03 | 77.6 | 62.8 |
| | | | | | | | Al | 0.005 | Ag | 0.02 | | |
| | | | | | | | Cr | 0.006 | B | 0.005 | | |

TABLE 2-continued

| Alloy | Component Composition (mass %) | | | | | | Impurities (mass %) | | | | Composition Relational Expression | |
|---|---|---|---|---|---|---|---|---|---|---|---|---|
| No. | Cu | Si | Pb | Sn | P | Zn | Element | Amount | Element | Amount | f1 | f2 |
| | | | | | | | Se | 0.001 | Co | 0.003 | | |
| | | | | | | | W | 0.002 | | | | |
| S02 | 77.2 | 3.34 | 0.036 | 0.24 | 0.11 | Balance | Fe | 0.04 | Ni | 0.01 | 78.0 | 62.6 |
| | | | | | | | Al | 0.001 | Ag | 0.009 | | |
| | | | | | | | Zr | 0.003 | Mg | 0.001 | | |
| | | | | | | | Bi | 0.007 | Rare Earth Element | 0.001 | | |
| | | | | | | | Te | 0.001 | S | 0.0004 | | |
| S03 | 76.0 | 3.20 | 0.050 | 0.11 | 0.09 | Balance | Fe | 0.02 | Ni | 0.04 | 77.7 | 62.1 |
| | | | | | | | Al | 0.002 | Ag | 0.01 | | |
| | | | | | | | Zr | 0.001 | Cr | 0.006 | | |
| | | | | | | | Bi | 0.007 | Rare Earth Element | 0.001 | | |
| | | | | | | | Te | 0.001 | S | 0.0004 | | |

TABLE 3

| Alloy | Component Composition (mass %) | | | | | | | Composition Relational Expression | |
|---|---|---|---|---|---|---|---|---|---|
| No. | Cu | Si | Pb | Sn | P | Others | Zn | f1 | f2 |
| S11 | 77.5 | 3.42 | 0.040 | 0.19 | 0.08 | | Balance | 78.7 | 62.6 |
| S12 | 76.2 | 3.15 | 0.046 | 0.26 | 0.08 | | Balance | 76.6 | 62.4 |
| S13 | 76.8 | 3.17 | 0.032 | 0.17 | 0.09 | | Balance | 78.0 | 63.0 |
| S14 | 75.4 | 3.15 | 0.036 | 0.14 | 0.11 | | Balance | 76.9 | 61.7 |
| S15 | 76.4 | 3.14 | 0.035 | 0.07 | 0.06 | | Balance | 78.4 | 62.8 |
| S16 | 75.9 | 3.13 | 0.050 | 0.25 | 0.08 | | Balance | 76.4 | 62.2 |
| S17 | 76.4 | 3.12 | 0.050 | 0.27 | 0.08 | | Balance | 76.7 | 62.7 |
| S18 | 76.0 | 3.25 | 0.050 | 0.13 | 0.10 | | Balance | 77.6 | 61.9 |
| S19 | 75.8 | 3.24 | 0.042 | 0.13 | 0.11 | | Balance | 77.4 | 61.7 |
| S20 | 76.4 | 3.26 | 0.045 | 0.27 | 0.08 | | Balance | 76.8 | 62.1 |
| S21 | 77.1 | 3.39 | 0.036 | 0.26 | 0.14 | | Balance | 77.8 | 62.2 |
| S22 | 77.2 | 3.36 | 0.040 | 0.23 | 0.10 | | Balance | 78.1 | 62.5 |
| S23 | 77.6 | 3.35 | 0.045 | 0.27 | 0.07 | | Balance | 78.1 | 63.0 |
| S24 | 77.2 | 3.30 | 0.036 | 0.25 | 0.08 | | Balance | 77.8 | 62.8 |
| S25 | 77.1 | 3.28 | 0.038 | 0.24 | 0.07 | | Balance | 77.8 | 62.8 |
| S26 | 77.5 | 3.36 | 0.033 | 0.16 | 0.08 | | Balance | 78.9 | 62.9 |
| S27 | 77.2 | 3.31 | 0.040 | 0.11 | 0.10 | | Balance | 79.0 | 62.8 |
| S28 | 77.3 | 3.35 | 0.042 | 0.08 | 0.09 | | Balance | 79.4 | 62.8 |
| S29 | 77.2 | 3.34 | 0.033 | 0.24 | 0.10 | | Balance | 77.9 | 62.6 |
| S30 | 78.4 | 3.54 | 0.029 | 0.15 | 0.11 | | Balance | 80.1 | 63.0 |
| S31 | 75.2 | 3.01 | 0.035 | 0.14 | 0.09 | | Balance | 76.5 | 62.1 |
| S32 | 75.4 | 3.06 | 0.035 | 0.16 | 0.09 | | Balance | 76.6 | 62.1 |
| S33 | 75.1 | 3.00 | 0.041 | 0.11 | 0.10 | | Balance | 76.7 | 62.0 |
| S41 | 77.2 | 3.23 | 0.044 | 0.11 | 0.09 | Sb: 0.04, As: 0.04 | Balance | 79.0 | 63.2 |
| S42 | 75.9 | 3.20 | 0.050 | 0.11 | 0.09 | Sb: 0.04, As: 0.04 | Balance | 77.6 | 62.0 |
| S43 | 76.5 | 3.16 | 0.050 | 0.22 | 0.12 | Sb: 0.03, Bi: 0.02 | Balance | 77.3 | 62.7 |
| S44 | 76.4 | 3.13 | 0.050 | 0.16 | 0.09 | Sb: 0.04, As: 0.03 | Balance | 77.7 | 62.8 |
| S45 | 76.1 | 3.21 | 0.036 | 0.12 | 0.10 | Sb: 0.04 | Balance | 77.8 | 62.1 |

TABLE 4

| Alloy | Component Composition (mass %) | | | | | | | Composition Relational Expression | |
|---|---|---|---|---|---|---|---|---|---|
| No. | Cu | Si | Pb | Sn | P | Others | Zn | f1 | f2 |
| S101 | 75.0 | 2.99 | 0.036 | 0.16 | 0.08 | | Balance | 76.1 | 62.0 |
| S102 | 75.1 | 3.03 | 0.028 | 0.19 | 0.11 | | Balance | 76.0 | 61.8 |
| S103 | 75.8 | 3.39 | 0.033 | 0.19 | 0.11 | | Balance | 77.0 | 61.0 |
| S104 | 77.5 | 3.16 | 0.032 | 0.12 | 0.11 | | Balance | 79.1 | 63.7 |
| S105 | 76.6 | 3.00 | 0.028 | 0.09 | 0.08 | | Balance | 78.3 | 63.6 |

TABLE 4-continued

| Alloy | Component Composition (mass %) | | | | | | | Composition Relational Expression | |
|---|---|---|---|---|---|---|---|---|---|
| No. | Cu | Si | Pb | Sn | P | Others | Zn | f1 | f2 |
| S106 | 77.7 | 3.45 | 0.035 | 0 | 0 | | Balance | 80.5 | 62.9 |
| S107 | 75.4 | 2.85 | 0.044 | 0.15 | 0.09 | | Balance | 76.5 | 63.0 |
| S108 | 74.4 | 2.85 | 0.042 | 0.18 | 0.10 | | Balance | 75.3 | 61.9 |
| S109 | 76.8 | 3.39 | 0.050 | 0.26 | 0.19 | | Balance | 77.5 | 61.9 |
| S110 | 75.5 | 3.05 | 0.036 | 0.24 | 0.11 | | Balance | 76.0 | 62.1 |
| S111 | 75.8 | 3.13 | 0.043 | 0.34 | 0.08 | | Balance | 75.5 | 62.0 |
| S112 | 75.8 | 3.14 | 0.035 | 0.33 | 0.09 | | Balance | 75.6 | 62.0 |
| S113 | 76.3 | 3.19 | 0.036 | 0.18 | 0.04 | | Balance | 77.4 | 62.4 |
| S114 | 75.9 | 3.12 | 0.036 | 0.04 | 0.11 | | Balance | 78.2 | 62.4 |
| S115 | 77.6 | 3.45 | 0.050 | 0.04 | 0.03 | | Balance | 80.1 | 62.7 |
| S116 | 75.8 | 3.02 | 0.036 | 0.02 | 0.01 | | Balance | 78.1 | 62.8 |
| S117 | 76.2 | 3.14 | 0.036 | 0.03 | 0 | | Balance | 78.5 | 62.7 |
| S118 | 73.8 | 2.98 | 0.015 | 0.13 | 0.07 | | Balance | 75.2 | 60.8 |
| S119 | 74.4 | 3.00 | 0.026 | 0.22 | 0.09 | | Balance | 75.0 | 61.3 |
| S120 | 74.0 | 3.22 | 0.030 | 0.15 | 0.10 | | Balance | 75.4 | 60.0 |
| S121 | 77.6 | 3.63 | 0.042 | 0.17 | 0.11 | | Balance | 79.2 | 61.8 |
| S122 | 78.9 | 3.83 | 0.033 | 0.24 | 0.11 | | Balance | 80.1 | 62.2 |
| S123 | 76.8 | 3.03 | 0.038 | 0.19 | 0.06 | | Balance | 77.7 | 63.6 |
| S124 | 76.3 | 3.20 | 0 | 0.14 | 0.07 | Fe: 0.18 | Balance | 77.7 | 62.4 |
| S125 | 75.0 | 3.04 | 0 | 0.08 | 0.07 | Fe: 0.12 | Balance | 76.8 | 61.8 |
| S126 | 75.6 | 3.10 | 0.032 | 0.26 | 0.08 | | Balance | 76.0 | 62.0 |
| S127 | 76.1 | 3.28 | 0.024 | 0.24 | 0.08 | Sb: 0.10, As: 0.03 | Balance | 76.8 | 61.8 |

TABLE 5

| | Hot Extrusion | | | Combined Operation of Drawing and | Diameter of Extruded | Heat Treatment (Annealing) | | | | |
|---|---|---|---|---|---|---|---|---|---|---|
| Step No. | Temperature (° C.) | Cooling Rate from 575° C. to 510° C. (° C./min) | Cooling Rate from 470° C. to 380° C. (° C./min) | Straightness Correction before Heat Treatment | Material before Heat Treatment (mm) | Kind of Furnace | Temperature (° C.) | Time (min) | Cooling Rate from 575° C. to 510° C. (° C./min) | Cooling Rate from 470° C. to 380° C. (° C./min) |
| A1 | 640 | 20 | 20 | ○ | 25.0 | Batch Furnace | 540 | 180 | 15 | 20 |
| A2 | 640 | 20 | 20 | ○ | 25.0 | Batch Furnace | 540 | 180 | 15 | 14 |
| A3 | 640 | 20 | 20 | ○ | 25.0 | Batch Furnace | 540 | 180 | 15 | 7 |
| A4 | 640 | 20 | 20 | ○ | 25.0 | Batch Furnace | 540 | 180 | 15 | 3.6 |
| A5 | 640 | 20 | 20 | ○ | 25.0 | Batch Furnace | 520 | 180 | 15 | 20 |
| A6 | 640 | 20 | 20 | ○ | 25.0 | Batch Furnace | 520 | 30 | 15 | 20 |
| A7 | 640 | 20 | 20 | ○ | 25.0 | Continuous Furnace | 590 | 3 | 1.8 | 10 |
| A8 | 640 | 20 | 20 | ○ | 25.0 | Continuous Furnace | 590 | 3 | 1.2 | 10 |
| A9 | 680 | 20 | 20 | ○ | 25.0 | Batch Furnace | 540 | 80 | 15 | 20 |
| A10 | 640 | 20 | 20 | — | 25.6 | Batch Furnace | 540 | 80 | 15 | 20 |
| A11 | 640 | 20 | 20 | — | 25.6 | Batch Furnace | 540 | 80 | 15 | 20 |
| A12 | 640 | 20 | 20 | ○ (Cold Working Ratio 9%) | 24.4 | Batch Furnace | 540 | 80 | 15 | 20 |
| AH1 | 640 | 20 | 20 | Only Correction | 25.6 | — | — | — | — | — |
| AH2 | 760 | 20 | 20 | Only Correction | 25.6 | — | — | — | — | — |
| AH3 | 640 | 20 | 20 | ○ | 25.0 | Batch Furnace | 540 | 180 | 2.4 | 1.8 |
| AH4 | 640 | 20 | 20 | ○ | 25.0 | Batch Furnace | 540 | 180 | 1.5 | 1 |
| AH5 | 640 | 20 | 20 | ○ | 25.0 | Continuous Furnace | 635 | 60 | 15 | 10 |
| AH6 | 640 | 20 | 20 | ○ | 25.0 | Batch Furnace | 500 | 180 | — | 20 |
| AH7 | 640 | 20 | 20 | ○ | 25.0 | Continuous Furnace | 590 | 5 | 8 | 10 |
| AH8 | 640 | 20 | 20 | ○ | 25.0 | Continuous Furnace | 590 | 10 | 1.8 | 1.6 |
| AH9 | 580 | 20 | 20 | Extrusion not Able to be Performed to End | | | | | | |

TABLE 6

| Step No. | Note |
|---|---|
| A1 | |
| A2 | |
| A3 | |
| A4 | The cooling rate from 470° C. to 380° C. was close to 2.5° C./min |
| A5 | The heat treatment temperature was relatively low, but heating was performed for a relatively long period of time |
| A6 | The heat treatment temperature was relatively low, but the holding time was relatively short |
| A7 | The heat treatment temperature was high, but the cooling rate from 575° C. to 510° C. was relatively low |
| A8 | The heat treatment temperature was high, but the cooling rate from 575° C. to 510° C. was relatively low |
| A9 | |
| A10 | By performing a combined operation of drawing and straightness correction at a cold working ratio of 5% after a heat treatment, the diameter was adjusted to 25 mm |
| A11 | By performing a combined operation of drawing and straightness correction at a cold working ratio of 9% after a heat treatment, the diameter was adjusted to 24.4 mm |
| A12 | This step was the same as A1. However, the diameter in A1 was 25 mm, whereas the diameter in A12 was 24.4 mm |
| AH1 | |
| AH2 | |
| AH3 | Due to furnace cooling, the cooling rate from 470° C. to 380° C. was low |

TABLE 6-continued

| Step No. | Note |
|---|---|
| AH4 | Due to furnace cooling, the cooling rate from 470° C. to 380° C. was low |
| AH5 | α phase coarsened because the heat treatment temperature was high |
| AH6 | The heat treatment temperature was low |
| AH7 | The heat treatment temperature was 15° C. higher, and the cooling rate from 575° C. to 510° C. was high |
| AH8 | The cooling rate from 470° C. to 380° C. was low |
| AH9 | |

TABLE 7

| | | Low-Temperature Annealing | | |
|---|---|---|---|---|
| Step No. | Material | Temperature (° C.) | Time (min) | Value of Conditional Expression |
| B1 | Rod Material obtained in Step A10 | 275 | 180 | 738 |
| B2 | | 320 | 75 | 866 |
| B3 | | 290 | 75 | 606 |
| BH1 | | 220 | 120 | — |
| BH2 | | 370 | 20 | — |
| BH3 | | 320 | 180 | 1342 |

Conditional Expression: $(T-220) \times (t)^{1/2}$
T: Temperature (° C.),
t: Time (min)

TABLE 8

| | Hot Extrusion | | | | | Heat Treatment (Annealing) | | | |
|---|---|---|---|---|---|---|---|---|---|
| Step No. | Temperature (° C.) | Cooling Rate from 575° C. to 510° C. (° C./min) | Cooling Rate from 470° C. to 380° C. (° C./min) | Combined operation of Drawing and Straightness Correction | Diameter of Extruded Material (mm) | Temperature (° C.) | Time (min) | Cooling Rate from 575° C. to 510° C. (° C./min) | Cooling Rate from 470° C. to 380° C. (° C./min) |
| C0 | 640 | 15 | 15 | — | 50 | — | — | — | — |
| C1 | 640 | 15 | 15 | — | 50 | 560 | 60 | 15 | 12 |
| C2 | 640 | 15 | 15 | — | 50 | 560 | 60 | 15 | 5.5 |
| CH1 | 640 | 15 | 15 | — | 50 | 560 | 60 | 15 | 1.6 |
| CH2 | 760 | 15 | 15 | — | 50 | — | — | — | — |

TABLE 9

| | | Hot Forging | | | Heat Treatment (Annealing) | | | | |
|---|---|---|---|---|---|---|---|---|---|
| Step No. | Material | Temperature (° C.) | Cooling Rate from 575° C. to 510° C. (° C./min) | Cooling Rate from 470° C. to 380° C. (° C./min) | Kind of Furnace | Temperature (° C.) | Time (min) | Cooling Rate from 575° C. to 510° C. (° C./min) | Cooling Rate from 470° C. to 380° C. (° C./min) |
| D1 | C0 | 690 | 20 | 20 | Batch Furnace | 540 | 60 | 15 | 15 |
| D2 | C0 | 690 | 20 | 20 | Batch Furnace | 540 | 60 | 15 | 8 |
| D3 | C0 | 690 | 20 | 20 | Batch Furnace | 540 | 60 | 6 | 4.5 |
| D4 | C0 | 690 | 20 | 20 | Batch Furnace | 520 | 30 | 15 | 15 |
| D5 | C0 | 690 | 20 | 20 | Continuous Furnace | 600 | 3 | 1.8 | 15 |
| D6 | C0 | 690 | 1.5 | 10 | | — | — | — | — |
| D7 | C0 | 690 | 20 | 20 | Continuous Furnace | 565 | 3 | 1 | 15 |
| D8 | CH2 | 690 | 20 | 20 | Continuous Furnace | 600 | 3 | 1.8 | 15 |

TABLE 9-continued

| Step No. | Material | Hot Forging: Temperature (° C.) | Hot Forging: Cooling Rate from 575° C. to 510° C. (° C./min) | Hot Forging: Cooling Rate from 470° C. to 380° C. (° C./min) | Heat Treatment (Annealing): Kind of Furnace | Heat Treatment (Annealing): Temperature (° C.) | Heat Treatment (Annealing): Time (min) | Heat Treatment (Annealing): Cooling Rate from 575° C. to 510° C. (° C./min) | Heat Treatment (Annealing): Cooling Rate from 470° C. to 380° C. (° C./min) |
|---|---|---|---|---|---|---|---|---|---|
| DH1 | C0 | 690 | 20 | 20 | | — | — | — | — |
| DH2 | C0 | 690 | 20 | 20 | Batch Furnace | 540 | 60 | 6 | 2 |
| DH3 | C0 | 690 | 20 | 20 | Continuous Furnace | 600 | 3 | 2.4 | 1.8 |
| DH4 | C0 | 690 | 20 | 20 | Continuous Furnace | 600 | 2 | 5 | 15 |
| DH5 | C0 | 690 | 3.5 | 10 | | — | — | — | — |

TABLE 10

| Step No. | Note |
|---|---|
| D1 | — |
| D2 | — |
| D3 | — |
| D4 | The temperature was relatively low, and the holding time was relatively short |
| D5 | The cooling rate from 575° C. to 510° C. was relatively low |
| D6 | The cooling rate from 575° C. to 510° C. in hot forging was relatively low |
| D7 | The cooling rate from 575° C. to 510° C. was relatively low |

TABLE 10-continued

| Step No. | Note |
|---|---|
| D8 | The cooling rate from 575° C. to 510° C. was relatively low |
| DH1 | — |
| DH2 | Due to furnace cooling, the cooling rate from 470° C. to 380° C. was low |
| DH3 | The cooling rate from 470° C. to 380° C. was low |
| DH4 | The cooling rate from 575° C. to 510° C. was high |
| DH5 | The cooling rate from 575° C. to 510° C. in hot forging was high |

TABLE 11

| Step No. | Hot Extrusion: Temperature (° C.) | Hot Extrusion: Cooling Rate from 575° C. to 510° C. (° C./min) | Hot Extrusion: Cooling Rate from 470° C. to 380° C. (° C./min) | Straightness Correction | Diameter of Extruded Material after Correction (mm) | Heat Treatment (Annealing): Temperature (° C.) | Heat Treatment (Annealing): Time (min) | Heat Treatment (Annealing): Cooling Rate from 575° C. to 510° C. (° C./min) | Heat Treatment (Annealing): Cooling Rate from 470° C. to 380° C. (° C./min) | Note |
|---|---|---|---|---|---|---|---|---|---|---|
| E1 | 640 | 20 | 20 | ○ | 25 | 540 | 80 | 15 | 15 | |
| E2 | 640 | 20 | 20 | ○ | 40 | — | — | — | — | Used as Material for Forging Abrasion Test also Performed |
| E3 | 640 | 20 | 20 | ○ | 40 | 540 | 80 | 15 | 15 | Abrasion Test also Performed |
| EH1 | 640 | 20 | 20 | ○ | 25 | — | — | — | — | — |

TABLE 12

| Step No. | Material | Hot Forging: Temperature (° C.) | Hot Forging: Cooling Rate from 575° C. to 510° C. (° C./min) | Hot Forging: Cooling Rate from 470° C. to 380° C. (° C./min) | Heat Treatment (Annealing): Kind of Furnace | Heat Treatment (Annealing): Temperature (° C.) | Heat Treatment (Annealing): Time (min) | Heat Treatment (Annealing): Cooling Rate from 575° C. to 510° C. (° C./min) | Heat Treatment (Annealing): Cooling Rate from 470° C. to 380° C. (° C./min) | Note |
|---|---|---|---|---|---|---|---|---|---|---|
| F1 | E2 | 690 | 20 | 18 | Batch Furnace | 560 | 30 | 50 | 10 | |
| F2 | E2 | 690 | 20 | 18 | Continuous Furnace | 590 | 5 | 1.8 | 10 | |
| F3 | Continuously Cast Rod | 690 | 20 | 18 | Batch Furnace | 560 | 30 | 20 | 20 | |
| F4 | Continuously Cast Rod | 690 | 20 | 18 | Continuous Furnace | 600 | 5 | 1.8 | 10 | |

TABLE 12-continued

| | | Hot Forging | | | Heat Treatment (Annealing) | | | | | |
|---|---|---|---|---|---|---|---|---|---|---|
| Step No. | Material | Temperature (° C.) | Cooling Rate from 575° C. to 510° C. (° C./min) | Cooling Rate from 470° C. to 380° C. (° C./min) | Kind of Furnace | Temperature (° C.) | Time (min) | Cooling Rate from 575° C. to 510° C. (° C./min) | Cooling Rate from 470° C. to 380° C. (° C./min) | Note |
| F5 | E2 | 690 | 20 | 18 | Continuous Furnace | 565 | 5 | 1.2 | 10 | |
| FH1 | E2 | 690 | 20 | 18 | | — | — | — | — | |
| FH2 | E2 | 690 | 20 | 18 | Continuous Furnace | 590 | 5 | 1.9 | 1.5 | Cooling Rate from 470° C. to 380° C. was Low |

Regarding the above-described test materials, the metallographic structure observed, corrosion resistance (dezincification corrosion test/dipping test), and machinability were evaluated in the following procedure.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image processing software "Photoshop CC". Next, the micrographs were binarized using image processing software "WinROOF 2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Using a 500-fold or 1000-fold metallographic micrograph, the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify α phase, the phase was identified using an electron backscattering diffraction pattern (FE-SEM-EBSP) method at a magnification of 500-fold or 2000-fold.

In addition, in Examples in which the average cooling rates were made to vary, in order to determine whether or not μ phase, which mainly precipitates at a grain boundary, was present, a secondary electron image was obtained using JSM-7000F (manufactured by JEOL Ltd.) under the conditions of acceleration voltage: 15 kV and current value (set value: 15), and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range of 470° C. to 380° C. at an average cooling rate of 8° C./min or lower or 15° C./min or lower after hot extrusion or heat treatment, the presence of μ phase was able to be identified. FIG. 1 shows an example of a secondary electron image of Test No. T05 (Alloy No. S01/Step No. A3). It was verified that μ phase was precipitated at a grain boundary of α phase (elongated grayish white phase).

[0123]

(Acicular κ Phase Present in a Phase)

Acicular κ phase (κ1 phase) present in α phase has a width of about 0.05 μm to about 0.5 μm and had an elongated linear shape or an acicular shape. When the width was 0.1 μm or more, the presence of κ1 phase can be identified using a metallographic microscope.

Figure 2:
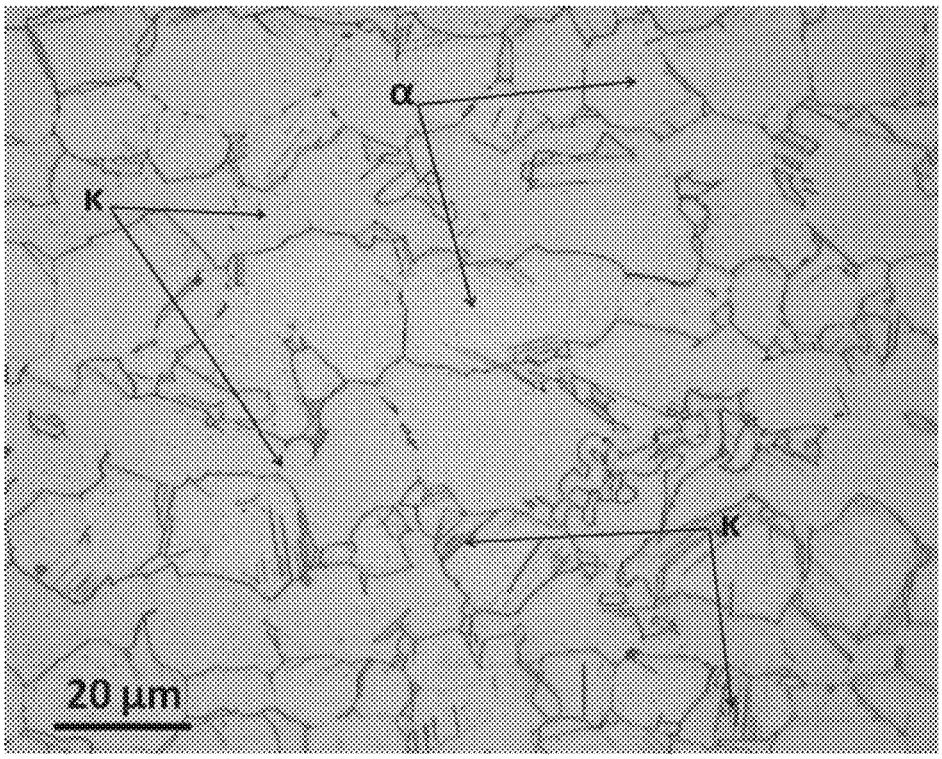
FIG. 2 is a metallographic micrograph of a metallographic structure of a free-cutting copper alloy (Test No. T53) according to Example 1.
Figure 3:
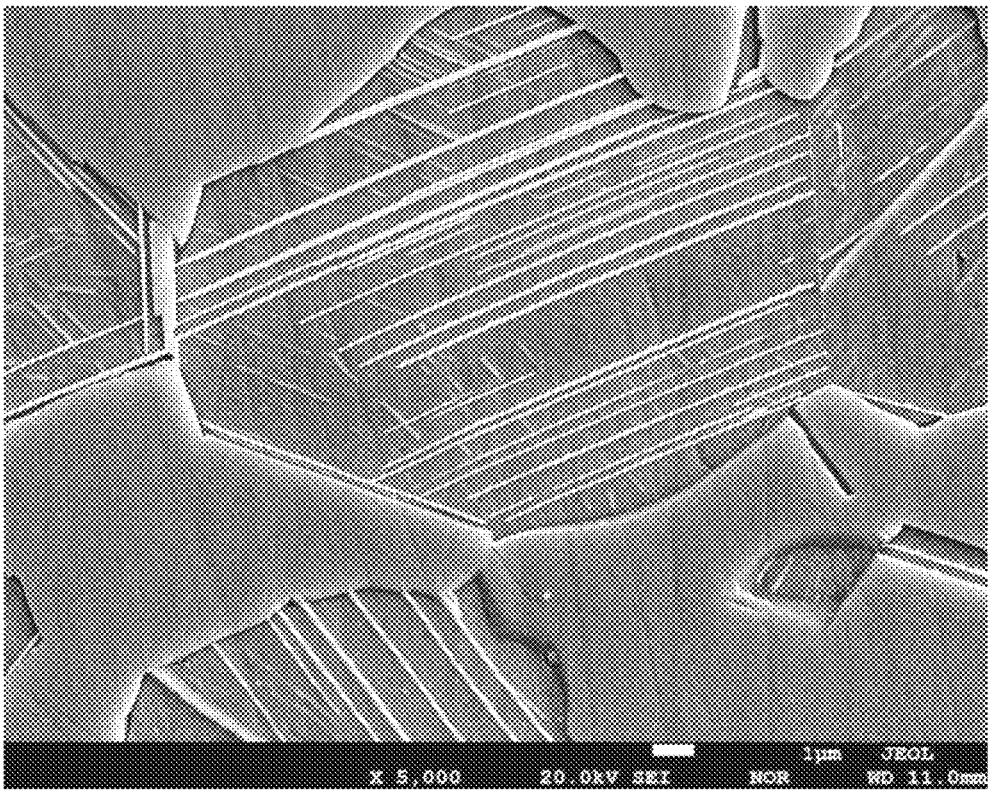
FIG. 3 is an electron micrograph of a metallographic structure of a free-cutting copper alloy (Test No. T53) according to Example 1.

FIG. 2 shows a metallographic micrograph of Test No. T53 (Alloy No. S02/Step No. A1) as a representative metallographic micrograph. FIG. 3 shows an electron micrograph of Test No. T53 (Alloy No. S02/Step No. A1) as a representative electron micrograph of acicular κ phase present in α phase. Observation points of FIGS. 2 and 3 were not the same. In a copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, α phase having an elongated, linear, and acicular pattern is observed in α phase. In the secondary electron image (electron micrograph) of FIG. 3, the pattern present in α phase can be clearly identified as κ phase. The thickness of κ phase was about 0.1 to about 0.2 μm.

The amount (number) of acicular κ phase in α phase was determined using the metallographic microscope. The micrographs of the five visual fields taken at a magnification of 500-fold or 1000-fold for the determination of the metallographic structure constituent phases (metallographic structure observation) were used. In an enlarged visual field having a length of about 70 mm and a width of about 90 mm, the number of acicular κ phases was counted, and the average value of five visual fields was obtained. When the average number of acicular κ phase in the five visual fields is 5 or more and less than 49, it was determined that acicular κ phase was present, and "Δ" was indicated. When the average number of acicular κ phase in the five visual fields was more than 50, it was determined that a large amount of acicular κ phase was present, and "O" was indicated. When the average number of acicular κ phase in the five visual fields was 4 or less, it was determined that almost no acicular κ phase was present, and "X" was indicated. The number of acicular κ1 phases that was unable to be observed using the images was not counted.

(Amounts of Sn and P in κ Phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T03 (Alloy No. S01/Step No. A1), Test No. T25 (Alloy No. S01/Step No. BH3), Test No. T229 (Alloy No. S20/Step No. EH1), and Test No. T230 (Alloy No. S20/Step No. E1), the quantitative analysis of the concentrations of Sn, Cu, Si, and P in the respective phases was performed using the X-ray microanalyzer, and the results thereof are shown in Tables 13 to 16.

Regarding μ phase, a portion in which the length of the short side in the visual field was long was measured using an EDS, an accessory of JSM-7000F.

TABLE 13

Test No. T03 (Alloy No. S01: 76.4Cu—3.12Si—0.16Sn—0.08P/Step No. A1) (mass %)

| | Cu | Si | Sn | P | Zn |
|---|---|---|---|---|---|
| α Phase | 76.5 | 2.6 | 0.13 | 0.06 | Balance |
| κ Phase | 77.0 | 4.1 | 0.19 | 0.11 | Balance |
| γ Phase | 75.0 | 6.2 | 1.5 | 0.17 | Balance |
| μ Phase | — | — | — | — | — |

TABLE 14

Test No. T25 (Alloy No. S01: 76.4Cu—3.12Si—0.16Sn—0.08P/Step No. BH3) (mass %)

| | Cu | Si | Sn | P | Zn |
|---|---|---|---|---|---|
| α Phase | 76.5 | 2.7 | 0.13 | 0.06 | Balance |
| κ Phase | 77.0 | 4.1 | 0.19 | 0.12 | Balance |
| γ Phase | 75.0 | 6.0 | 1.4 | 0.16 | Balance |
| μ Phase | 82.0 | 7.5 | 0.25 | 0.22 | Balance |

TABLE 15

Test No. T229 (Alloy No. S20: 76.4Cu—3.26Si—0.27Sn—0.08P/Step No. EH1) (mass %)

| | Cu | Si | Sn | P | Zn |
|---|---|---|---|---|---|
| α Phase | 76.5 | 2.5 | 0.13 | 0.06 | Balance |
| α' Phase | 75.5 | 2.4 | 0.12 | 0.05 | Balance |
| κ Phase | 77.0 | 4.0 | 0.18 | 0.10 | Balance |
| γ Phase | 74.5 | 5.8 | 2.1 | 0.16 | Balance |

TABLE 16

Test No. T230 (Alloy No. S20: 76.4Cu—3.26Si—0.27Sn—0.08P/Step No. E1) (mass %)

| | Cu | Si | Sn | P | Zn |
|---|---|---|---|---|---|
| α Phase | 76.0 | 2.6 | 0.22 | 0.06 | Balance |
| κ Phase | 77.0 | 4.1 | 0.31 | 0.10 | Balance |
| γ Phase | 75.0 | 5.8 | 2.1 | 0.16 | Balance |

Based on the above-described measurement results, the following findings were obtained.

1) The concentrations of the elements distributed in the respective phases vary depending on the alloy compositions.

2) The amount of Sn distributed in κ phase is about 1.4 times that in α phase.

3) The Sn concentration in γ phase is about 10 to about 15 times the Sn concentration in α phase.

4) The Si concentrations in κ phase, γ phase, and μ phase are about 1.5 times, about 2.2 times, and about 2.7 times the Si concentration in α phase, respectively.

5) The Cu concentration in μ phase is higher than that in α phase, κ phase, γ phase, or μ phase.

6) As the proportion of γ phase increases, the Sn concentration in κ phase necessarily decreases.

7) The amount of P distributed in κ phase is about 2 times that in α phase.

8) The P concentrations in γ phase and μ phase are about 3 times and about 4 times the P concentration in α phase respectively.

9) Even with the same composition, as the proportion of γ phase decreases, the Sn concentration in α phase increases 1.7 times from 0.13 mass % to 0.22 mass % (Alloy No. S20).

Likewise, the Sn concentration in κ phase increases 1.7 times from 0.18 mass % to 0.31 mass %. In addition, as the proportion of γ phase decreases, the Sn concentration in α phase increases from 0.13 mass % to 0.18 mass % by 0.05 mass %, and the Sn concentration in κ phase increases from 0.22 mass % to 0.31 mass % by 0.09 mass %. The increase in the Sn concentration in κ phase is more than the increase in the Sn concentration in α phase.

(Mechanical Properties)

(Tensile Strength)

Each of the test materials was processed into a No. specimen according to JIS Z 2241, and the tensile strength thereof was measured. If the tensile strength of a hot extruded material or hot forged material is 530 N/mm$^2$ or higher and preferably 550 N/mm$^2$ or higher, the material can be regarded as a free-cutting copper alloy of the highest quality, and with such a material, a reduction in the thickness and weight of members used in various fields can be realized.

The finished surface roughness of the tensile test specimen affects elongation and tensile strength. Therefore, the tensile test specimen was prepared so as to satisfy the following conditions.

(Conditions of Finished Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where a load corresponding to 0.2% plastic deformation is applied, the specimen is regarded to have good high-temperature creep. In the case where this creep strain is 0.3% or lower, the alloy is regarded to be of the highest quality among copper alloys, and such material can be used as a highly reliable material in, for example, valves used under high temperature or in automobile components used in a place close to the engine room.

(Impact Resistance)

In an impact test, an U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is substantially as follows.

$$(V\text{-Notch Impact Value})=0.8\times(U\text{-Notch Impact Value})-3$$

(Machinability)

The machinability was evaluated as follows in a machining test using a lathe.

Hot extruded rod materials having a diameter of 50 mm, 40 mm, or 25.6 mm and a cold drawn material having a diameter of 25 mm (24.4 mm) were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or a diameter of 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "O" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10% to about 20%, the cutting resistance is sufficiently acceptable for practical use. In the embodiment, the cutting resistance was evaluated based on whether it had 130 N (boundary value). Specifically, when the cutting resistance was lower than 130 N, the machinability was evaluated as excellent (evaluation: O). When the cutting resistance was 130 N or higher and lower than 150 N, the machinability was evaluated as "acceptable (Δ)". When the cutting resistance was 150 N or higher, the cutting resistance was evaluated as "unacceptable (X)". Incidentally, when Step No. F1 was performed on a 58 mass % Cu-42 mass % Zn alloy to prepare a sample and this sample was evaluated, the cutting resistance was 185 N.

As an overall evaluation of machinability, a material whose chip shape was excellent (evaluation: O) and the cutting resistance was low (evaluation: O), the machinability was evaluated as excellent. When either the chip shape or the cutting resistance is evaluated as Δ or acceptable, the machinability was evaluated as good under some conditions. When either the chip shape or cutting resistance was evaluated as Δ or acceptable and the other was evaluated as X or unacceptable, the machinability was evaluated as unacceptable (poor).

(Hot Working Test)

The rod materials having a diameter of 50 mm, 40 mm, 25.6 mm, or 25.0 mm were machined to prepare test materials having a diameter of 15 mm and a length of 25 mm. The test materials were held at 740° C. or 635° C. for 20 minutes. Next, the test materials were horizontally set and compressed to a thickness of 5 mm at a high temperature using an Amsler testing machine having a hot compression capacity of 10 ton and equipped with an electric furnace at a strain rate of 0.02/sec and a working ratio of 80%.

Hot workability was evaluated using a magnifying glass at a magnification of 10-fold, and when cracks having an opening of 0.2 mm or more were observed, it was regarded that cracks occurred. When cracking did not occur under two conditions of 740° C. and 635° C., it was evaluated as "O" (good). When cracking occurred at 740° C. but did not occur at 635° C., it was evaluated as "Δ" (fair). When cracking did not occur at 740° C. and occurred at 635° C., it was evaluated as "▲" (fair). When cracking occurred at both of the temperatures, 740° C. and 635° C., it was evaluated as "X" (poor).

When cracking did not occur under two conditions of 740° C. and 635° C., even if the material's temperature decreases to some extent during actual hot extrusion or hot forging, or even if the material comes into contact with a mold or a die even for a moment and the material's temperature decreases, there is no problem in practical use as long as hot extrusion or hot forging is performed at an appropriate temperature. When cracking occurred at either temperature of 740° C. or 635° C., although there is a restriction in practical use, it is determined that hot working is possible if it is performed in a more narrowly controlled temperature range. When cracking occurred at both temperatures of 740° C. and 635° C., it is determined that there is a problem in practical use.

(Dezincification Corrosion Tests 1 and 2)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 75 to 100 times accelerated test performed in such a harsh corrosion environment. If the maximum corrosion depth is 70 μm or less, corrosion resistance is excellent. In a case where excellent corrosion resistance is required, it is presumed that the maximum corrosion depth is preferably 50 μm or less and more preferably 30 μm or less.

The test solution 2 is a solution for performing an accelerated test in a harsh corrosion environment, for simulating water quality that makes corrosion advance fast in which the chloride ion concentration is high and pH is low. When this solution is used, it is presumed that corrosion is accelerated about 30 to 50 times in such a harsh corrosion environment. If the maximum corrosion depth is 40 μm or less, corrosion resistance is good. If excellent corrosion resistance is required, it is presumed that the maximum corrosion depth is preferably 30 μm or less and more preferably 20 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 17 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 17

(Units of Items other than pH: mg/L)

| Mg | Ca | Na | K | $NO^{3-}$ | $SO_4^{2-}$ | Cl | Alkalinity | Hardness | pH |
|---|---|---|---|---|---|---|---|---|---|
| 10.1 | 7.3 | 55 | 19 | 30 | 40 | 80 | 30 | 60 | 6.3 |

Dezincification Corrosion Test 3: Dezincification Corrosion Test According to ISO 6509

This test is adopted in many countries as a dezincification corrosion test method and is defined by JIS H 3250 of JIS Standards.

As in the case of the dezincification corrosion tests 1 and 2, the test material was embedded in a phenol resin material. For example, the test material was embedded in a phenol resin material such that the exposed sample surface was perpendicular to the extrusion direction of the extruded material. The sample surface was polished with emery paper up to grit 1200, was ultrasonically cleaned in pure water, and then was dried.

Each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces were maintained to be perpendicular to the extrusion direction, the longitudinal direction, or the flowing direction of forging. Next, the samples were cut such that the longest possible cross-section of a corroded portion could be obtained. Next, the samples were polished.

Using a metallographic microscope, corrosion depth was observed in 10 visual fields of the microscope at a magnification of 100-fold to 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "O" (good). In the embodiment, a strict evaluation criterion was adopted because the alloy was assumed to be used in a harsh corrosion environment, and only when the evaluation was "O", it was determined that corrosion resistance was excellent.

(Abrasion Test)

In two tests including an Amsler abrasion test under a lubricating condition and a ball-on-disk abrasion test under a dry condition, wear resistance was evaluated. As samples, alloys prepared in Steps No. C0, C1, CH1, E2, and E3 were used.

The Amsler abrasion test was performed using the following method. At room temperature, each of the samples was machined to prepare an upper specimen having a diameter 32 mm. In addition, a lower specimen (surface hardness: HV184) having a diameter of 42 mm formed of austenitic stainless steel (SUS304 according to JIS G 4303) was prepared. By applying 490 N of load, the upper specimen and the lower specimen were brought into contact with each other. For an oil droplet and an oil bath, silicone oil was used. In a state where the upper specimen and the lower specimen were brought into contact with the load being applied, the upper specimen and the lower specimen were rotated under the conditions that the rotation speed of the upper specimen was 188 rpm and the rotation speed of the lower specimen was 209 rpm. Due to a difference in circumferential speed between the upper specimen and the lower specimen, a sliding speed was 0.2 m/sec. By making the diameters and the rotation speeds of the upper specimen and the lower specimen different from each other, the specimen was made to wear. The upper specimen and the lower specimen were rotated until the number of times of rotation of the lower specimen reached 250000.

After the test, the change in the weight of the upper specimen was measured, and wear resistance was evaluated based on the following criteria. When the decrease in the weight of the upper specimen caused by abrasion was 0.25 g or less, it was evaluated as "◎" (excellent). When the decrease in the weight of the upper specimen was more than 0.25 g and 0.5 g or less, it was evaluated as "O" (good). When the decrease in the weight of the upper specimen was more than 0.5 g and 1.0 g or less, it was evaluated as "Δ" (fair). When the decrease in the weight of the upper specimen was more than 1.0 g, it was evaluated as "X" (poor). The wear resistance was evaluated in these four grades. In addition, when the weight of the lower specimen decreased by 0.025 g or more, it was evaluated as "X".

Incidentally, the abrasion loss (a decrease in weight caused by abrasion) of a free-cutting brass 59Cu-3Pb-38Zn including Pb under the same test conditions was 12 g.

The ball-on-disk abrasion test was performed using the following method. A surface of the specimen was polished with a #2000 sandpaper. A steel ball having a diameter of 10 mm formed of austenitic stainless steel (SUS304 according to JIS G 4303) was pressed against the specimen and was slid thereon under the following conditions.

(Conditions)

Room temperature, no lubrication, load: 49 N, sliding diameter: 10 mm, sliding speed: 0.1 m/sec, sliding distance: 120 m After the test, the change in the weight of the specimen was measured, and wear resistance was evaluated based on the following criteria. When a decrease in the weight of the specimen caused by abrasion was 4 mg or less, it was evaluated as "◎" (excellent). When a decrease in the weight of the specimen was more than 4 mg and 8 mg or less, it was evaluated as "O" (good). When a decrease in the weight of the specimen was more than 8 mg and 20 mg or less, it was evaluated as "Δ" (fair). When a decrease in the weight of the specimen was more than 20 mg, it was evaluated as "X" (poor). The wear resistance was evaluated in these four grades.

Incidentally, the abrasion loss of a free-cutting brass 59Cu-3Pb-38Zn including Pb under the same test conditions was 80 mg.

The evaluation results are shown in Tables 18 to 47.

Tests No. T01 to T98 and T101 to T150 are the results of the experiment performed on the actual production line. Tests No. T201 to T258 and T301 to T308 are the results corresponding to Examples in the laboratory experiment. Tests No. T501 to T546 are the results corresponding to Comparative Examples in the laboratory experiment.

"*1" described in the "Step No." of the tables represents the following matter.

*1) hot workability was evaluated using the EH1 material.

In addition, regarding the tests indicated as "EH1, E2" or "E1, E3" in the "Step No." column, the abrasion test was performed using the sample prepared in Step No. E2 or E3. All the corrosion tests other than the abrasion test and the tests to examine mechanical properties and the like, and the investigation of the metallographic structure were performed using the samples prepared in Step No. EH1 or E1.

TABLE 18

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T01 | S01 | AH1 | 28.1 | 3.1 | 0 | 0 | 96.9 | 100 | 3.1 | 38.7 | 56 | 0 | X | 0.14 | 0.11 |
| T02 | S01 | AH2 | 28.0 | 3.3 | 0 | 0 | 96.7 | 100 | 3.3 | 38.9 | 64 | 0 | X | 0.14 | 0.11 |
| T03 | S01 | A1 | 33.8 | 0.1 | 0 | 0 | 99.9 | 100 | 0.1 | 35.7 | 16 | 0 | ○ | 0.19 | 0.11 |
| T04 | S01 | A2 | 33.4 | 0.2 | 0 | 0 | 99.8 | 100 | 0.2 | 36.1 | 18 | 0 | ○ | 0.19 | 0.11 |
| T05 | S01 | A3 | 33.5 | 0.1 | 0 | 0 | 99.9 | 100 | 0.1 | 35.4 | 16 | 3 | ○ | 0.19 | 0.11 |
| T06 | S01 | A4 | 34.0 | 0.1 | 0 | 0.6 | 99.3 | 100 | 0.7 | 36.2 | 14 | 16 | ○ | 0.19 | 0.11 |
| T07 | S01 | AH3 | 32.8 | 0.1 | 0 | 2.3 | 97.6 | 100 | 2.4 | 35.8 | 16 | 34 | ○ | 0.20 | 0.12 |
| T08 | S01 | AH4 | 31.2 | 0.2 | 0 | 5.5 | 94.3 | 100 | 5.7 | 36.6 | 18 | 40 or more | ○ | 0.20 | 0.12 |
| T09 | S01 | A5 | 34.0 | 0.3 | 0 | 0 | 99.7 | 100 | 0.3 | 37.2 | 18 | 0 | ○ | 0.19 | 0.11 |
| T10 | S01 | A6 | 33.0 | 1.1 | 0 | 0 | 98.9 | 100 | 1.1 | 39.3 | 38 | 0 | Δ | 0.18 | 0.11 |
| T11 | S01 | AH5 | 32.5 | 1.0 | 0 | 0 | 99.0 | 100 | 1.0 | 38.5 | 38 | 0 | Δ | 0.18 | 0.11 |
| T12 | S01 | AH6 | 32.0 | 1.5 | 0 | 0 | 98.5 | 100 | 1.5 | 39.3 | 42 | 0 | Δ | 0.17 | 0.11 |
| T13 | S01 | AH7 | 33.0 | 1.3 | 0 | 0 | 98.7 | 100 | 1.3 | 39.8 | 42 | 0 | Δ | 0.18 | 0.11 |
| T14 | S01 | A7 | 33.1 | 0.7 | 0 | 0 | 99.3 | 100 | 0.7 | 38.1 | 30 | 0 | ○ | 0.18 | 0.11 |
| T15 | S01 | A8 | 33.9 | 0.4 | 0 | 0 | 99.6 | 100 | 0.4 | 37.7 | 20 | 0 | ○ | 0.19 | 0.11 |
| T16 | S01 | AH8 | 33.9 | 0.5 | 0 | 2.7 | 96.8 | 100 | 3.2 | 39.5 | 16 | 40 or more | ○ | 0.19 | 0.11 |
| T17 | S01 | A9 | 33.1 | 0.3 | 0 | 0 | 99.7 | 100 | 0.3 | 36.4 | 24 | 0 | ○ | 0.19 | 0.11 |
| T18 | S01 | AH9 | Extrusion not able to be Performed to End | | | | | | | | | | | | |

TABLE 19

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T01 | S01 | AH1 | 118 | ○ | ○ | 102 | 68 | ○ | 24.1 | 540 | 663 | 0.36 |
| T02 | S01 | AH2 | 117 | ○ | ○ | 114 | 76 | ○ | 20.1 | 591 | 703 | 0.38 |
| T03 | S01 | A1 | 126 | ○ | — | 26 | 18 | ○ | 32.4 | 610 | 753 | 0.06 |
| T04 | S01 | A2 | 125 | ○ | — | 30 | 20 | ○ | 32.3 | 609 | 752 | 0.07 |
| T05 | S01 | A3 | 126 | ○ | — | 34 | 26 | ○ | 31.8 | 610 | 751 | 0.11 |
| T06 | S01 | A4 | 124 | ○ | — | 52 | 40 | ○ | 29.8 | 597 | 733 | 0.19 |
| T07 | S01 | AH3 | 124 | ○ | — | 78 | 50 | ○ | 27.0 | 583 | 713 | 0.30 |
| T08 | S01 | AH4 | 122 | ○ | — | 102 | 62 | ○ | 21.6 | 555 | 671 | 0.46 |
| T09 | S01 | A5 | 124 | ○ | — | 34 | 20 | ○ | 31.5 | 609 | 749 | 0.08 |
| T10 | S01 | A6 | 126 | ○ | — | 68 | 38 | ○ | 28.8 | 583 | 717 | 0.18 |
| T11 | S01 | AH5 | 125 | ○ | — | 66 | 38 | ○ | 29.8 | 558 | 694 | 0.19 |
| T12 | S01 | AH6 | 124 | ○ | — | 78 | 48 | ○ | 28.1 | 576 | 708 | 0.22 |
| T13 | S01 | AH7 | 124 | ○ | — | 74 | 44 | ○ | 28.2 | 590 | 723 | 0.18 |
| T14 | S01 | A7 | 122 | ○ | — | 50 | 34 | ○ | 30.0 | 596 | 733 | 0.16 |
| T15 | S01 | A8 | 122 | ○ | — | 34 | 24 | ○ | 31.1 | 598 | 737 | 0.09 |
| T16 | S01 | AH8 | 120 | ○ | — | 78 | 48 | ○ | 25.1 | 589 | 714 | 0.39 |
| T17 | S01 | A9 | 125 | ○ | — | 36 | 26 | ○ | 32.1 | 609 | 750 | 0.08 |
| T18 | S01 | AH9 | Extrusion not able to be Performed to End | | | | | | | | | |

TABLE 20

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T19 | S01 | A10 | 34.0 | 0.1 | 0 | 0 | 99.9 | 100 | 0.1 | 35.9 | 16 | 0 | ○ | 0.19 | 0.11 |
| T20 | S01 | B1 | 33.8 | 0.2 | 0 | 0 | 99.8 | 100 | 0.2 | 36.5 | 18 | 2 | ○ | 0.19 | 0.11 |
| T21 | S01 | B2 | 34.0 | 0.2 | 0 | 0 | 99.8 | 100 | 0.2 | 36.7 | 22 | 3 | ○ | 0.19 | 0.11 |
| T22 | S01 | B3 | 33.5 | 0.1 | 0 | 0 | 99.9 | 100 | 0.1 | 35.4 | 16 | 2 | ○ | 0.19 | 0.11 |
| T23 | S01 | BH1 | 34.0 | 0.2 | 0 | 0 | 99.8 | 100 | 0.2 | 36.7 | 20 | 0 | ○ | 0.19 | 0.11 |
| T24 | S01 | BH2 | 33.0 | 0.2 | 0 | 2.4 | 97.4 | 100 | 2.6 | 36.9 | 18 | 38 | ○ | 0.20 | 0.12 |
| T25 | S01 | BH3 | 32.5 | 0.1 | 0 | 2.8 | 97.1 | 100 | 2.9 | 35.8 | 16 | 40 or more | ○ | 0.19 | 0.12 |
| T26 | S01 | C0 | 27.8 | 3.0 | 0 | 0 | 97.0 | 100 | 3.0 | 38.2 | 56 | 0 | X | 0.16 | 0.11 |
| T27 | S01 | C1 | 33.9 | 0.5 | 0 | 0 | 99.5 | 100 | 0.5 | 38.1 | 28 | 0 | ○ | 0.19 | 0.11 |
| T28 | S01 | C2 | 33.3 | 0.4 | 0 | 0 | 99.6 | 100 | 0.4 | 37.1 | 26 | 8 | ○ | 0.19 | 0.11 |
| T29 | S01 | CH1 | 32.8 | 0.2 | 0 | 3 | 96.8 | 100 | 3.2 | 37.0 | 24 | 32 | ○ | 0.20 | 0.12 |
| T30 | S01 | CH2 | 27.2 | 3.6 | 0 | 0 | 96.4 | 100 | 3.6 | 38.6 | 70 | 0 | X | 0.14 | 0.11 |
| T31 | S01 | DH1 | 28.0 | 2.6 | 0 | 0 | 97.4 | 100 | 2.6 | 37.7 | 50 | 0 | X | 0.16 | 0.11 |
| T32 | S01 | D1 | 33.8 | 0.1 | 0 | 0 | 99.9 | 100 | 0.1 | 35.7 | 12 | 0 | ○ | 0.19 | 0.11 |
| T33 | S01 | D2 | 34.0 | 0.1 | 0 | 0 | 99.9 | 100 | 0.1 | 35.9 | 14 | 2 | ○ | 0.19 | 0.11 |

TABLE 20-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T34 | S01 | D3 | 33.2 | 0.2 | 0 | 0.5 | 99.3 | 100 | 0.7 | 36.1 | 20 | 12 | ○ | 0.19 | 0.11 |
| T35 | S01 | DH2 | 33.4 | 0.2 | 0 | 1.5 | 98.3 | 100 | 1.7 | 36.8 | 18 | 28 | ○ | 0.19 | 0.11 |

TABLE 21

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T19 | S01 | A10 | 126 | ○ | — | 26 | 18 | ○ | 28.3 | 630 | 763 | 0.06 |
| T20 | S01 | B1 | 126 | ○ | — | 32 | 22 | ○ | 27.7 | 635 | 767 | 0.10 |
| T21 | S01 | B2 | 126 | ○ | — | 36 | 26 | ○ | 27.5 | 635 | 766 | 0.11 |
| T22 | S01 | B3 | 127 | ○ | — | 30 | 18 | ○ | 28.2 | 636 | 769 | 0.09 |
| T23 | S01 | BH1 | 126 | ○ | — | 32 | 20 | | 27.5 | 635 | 766 | |
| T24 | S01 | BH2 | 124 | ○ | — | 78 | 48 | ○ | 24.4 | 604 | 728 | 0.34 |
| T25 | S01 | BH3 | 125 | ○ | — | 82 | 52 | ○ | 23.4 | 602 | 723 | 0.36 |
| T26 | S01 | C0 | 116 | ○ | ○ | 102 | 72 | ○ | 26.4 | 541 | 669 | — |
| T27 | S01 | C1 | 120 | ○ | — | 38 | 26 | ○ | 32.3 | 564 | 706 | 0.10 |
| T28 | S01 | C2 | 121 | ○ | — | 42 | 28 | ○ | 33.0 | 564 | 708 | 0.12 |
| T29 | S01 | CH1 | 121 | ○ | — | 80 | 50 | ○ | 27.5 | 546 | 677 | 0.33 |
| T30 | S01 | CH2 | — | ○ | — | 114 | 78 | ○ | 24.5 | 564 | 688 | — |
| T31 | S01 | DH1 | 117 | ○ | — | 90 | 62 | ○ | 27.9 | 544 | 676 | 0.31 |
| T32 | S01 | D1 | 123 | ○ | — | 20 | 14 | ○ | 34.1 | 565 | 711 | 0.06 |
| T33 | S01 | D2 | 123 | ○ | — | 28 | 18 | ○ | 33.5 | 565 | 710 | 0.10 |
| T34 | S01 | D3 | 123 | ○ | — | 48 | 30 | ○ | 32.0 | 561 | 703 | 0.18 |
| T35 | S01 | DH2 | 121 | ○ | — | 72 | 50 | ○ | 30.2 | 550 | 687 | 0.31 |

TABLE 22

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T36 | S01 | D4 | 33.0 | 0.7 | 0 | 0 | 99.3 | 100 | 0.9 | 38.0 | 36 | 0 | Δ | 0.18 | 0.11 |
| T37 | S01 | D5 | 33.3 | 0.5 | 0 | 0 | 99.5 | 100 | 0.5 | 37.5 | 32 | 0 | ○ | 0.19 | 0.11 |
| T38 | S01 | DH3 | 33.1 | 1.1 | 0 | 2.2 | 96.7 | 100 | 3.3 | 40.5 | 34 | 28 | ○ | 0.18 | 0.11 |
| T39 | S01 | DH4 | 32.5 | 1.4 | 0 | 0 | 98.6 | 100 | 1.4 | 39.6 | 40 | 0 | Δ | 0.17 | 0.11 |
| T40 | S01 | D6 | 32.7 | 1.4 | 0 | 0 | 98.6 | 100 | 1.4 | 39.8 | 30 | 0 | Δ | 0.17 | 0.11 |
| T41 | S01 | DH5 | 30.8 | 2.3 | 0 | 0 | 97.7 | 100 | 2.3 | 39.9 | 44 | 0 | Δ | 0.16 | 0.11 |
| T42 | S01 | EH1, E2 | 27.6 | 2.8 | 0 | 0 | 97.2 | 100 | 2.8 | 37.6 | 54 | 0 | X | 0.16 | 0.11 |
| T43 | S01 | E1, E3 | 33.8 | 0.5 | 0 | 0 | 99.5 | 100 | 0.5 | 38.0 | 22 | 0 | ○ | 0.19 | 0.11 |
| T44 | S01 | FH1 | 27.9 | 2.7 | 0 | 0 | 97.3 | 100 | 2.7 | 37.8 | 52 | 0 | X | 0.16 | 0.11 |
| T45 | S01 | F1 | 33.4 | 0.2 | 0 | 0 | 99.8 | 100 | 0.2 | 36.1 | 16 | 0 | ○ | 0.19 | 0.11 |
| T46 | S01 | F2 | 33.9 | 0.4 | 0 | 0 | 99.6 | 100 | 0.4 | 37.7 | 20 | 0 | ○ | 0.19 | 0.11 |
| T47 | S01 | FH2 | 33.1 | 0.5 | 0 | 2.5 | 97.0 | 100 | 3.0 | 38.7 | 24 | 30 | ○ | 0.19 | 0.12 |
| T48 | S01 | A11 | 34.0 | 0.1 | 0 | 0 | 99.9 | 100 | 0.1 | 35.9 | 16 | 0 | ○ | 0.19 | 0.11 |
| T49 | S01 | A12 | 33.7 | 0.1 | 0 | 0 | 99.9 | 100 | 0.1 | 35.6 | 16 | 0 | ○ | 0.19 | 0.11 |
| T50 | S01 | D7 | 33.5 | 0.5 | 0 | 0 | 99.5 | 100 | 0.5 | 37.7 | 30 | 0 | ○ | 0.19 | 0.11 |
| T151 | S01 | D8 | 33.0 | 1.1 | 0 | 0 | 98.9 | 100 | 1.1 | 39.3 | 38 | 0 | ○ | 0.18 | 0.11 |
| T152 | S01 | F5 | 34.0 | 0.6 | 0 | 0 | 99.4 | 100 | 0.6 | 38.6 | 26 | 0 | ○ | 0.19 | 0.11 |

TABLE 23

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T36 | S01 | D4 | 125 | ○ | — | 60 | 36 | ○ | 32.1 | 550 | 692 | 0.18 |
| T37 | S01 | D5 | 120 | ○ | — | 40 | 26 | ○ | 32.8 | 556 | 699 | 0.10 |
| T38 | S01 | DH3 | 116 | ○ | — | 84 | 52 | ○ | 26.6 | 536 | 665 | 0.38 |
| T39 | S01 | DH4 | 120 | ○ | — | 74 | 48 | ○ | 29.6 | 551 | 687 | 0.19 |
| T40 | S01 | D6 | 120 | ○ | — | 66 | 38 | ○ | 29.5 | 545 | 681 | 0.20 |
| T41 | S01 | DH5 | 116 | ○ | — | 90 | 58 | ○ | 27.8 | 549 | 681 | 0.28 |

TABLE 23-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T42 | S01 | EH1, E2 | 116 | ○ | ○ | 98 | 68 | ○ | 27.4 | 542 | 673 | 0.33 |
| T43 | S01 | E1, E3 | 121 | ○ | — | 32 | 22 | ○ | 32.4 | 564 | 706 | 0.10 |
| T44 | S01 | FH1 | 116 | ○ | — | 112 | 64 | ○ | 27.6 | 547 | 678 | 0.32 |
| T45 | S01 | F1 | 122 | ○ | — | 26 | 18 | ○ | 34.0 | 568 | 714 | 0.07 |
| T46 | S01 | F2 | 118 | ○ | — | 40 | 24 | ○ | 32.6 | 567 | 710 | 0.11 |
| T47 | S01 | FH2 | 119 | ○ | — | 96 | 58 | ○ | 27.5 | 542 | 673 | 0.34 |
| T48 | S01 | A11 | 129 | ○ | — | 32 | 22 | ○ | 21.4 | 680 | 796 | 0.09 |
| T49 | S01 | A12 | 127 | ○ | — | 24 | 22 | ○ | 28.6 | 635 | 769 | 0.07 |
| T50 | S01 | D7 | 120 | ○ | — | 42 | 32 | ○ | 33.0 | 557 | 701 | — |
| T151 | S01 | D8 | 118 | ○ | — | 68 | 38 | ○ | 30.1 | 557 | 694 | — |
| T152 | S01 | F5 | 118 | ○ | — | 38 | 30 | ○ | 32.2 | 568 | 710 | — |

TABLE 24

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T51 | S02 | AH1 | 38.2 | 3.2 | 0 | 0 | 96.8 | 100 | 3.2 | 48.9 | 58 | 0 | X | 0.21 | 0.14 |
| T52-1 | S02 | AH2 | 38.6 | 3.2 | 0 | 0 | 96.8 | 100 | 3.2 | 49.3 | 58 | 0 | X | 0.23 | 0.14 |
| T52-2 | S02 | AH3 | 38.0 | 3.3 | 0 | 0 | 96.7 | 100 | 3.3 | 48.9 | 72 | 0 | X | 0.21 | 0.14 |
| T53 | S02 | A1 | 47.2 | 0.1 | 0 | 0 | 99.9 | 100 | 0.1 | 49.1 | 16 | 0 | ○ | 0.28 | 0.14 |
| T54 | S02 | A2 | 46.5 | 0.2 | 0 | 0 | 99.8 | 100 | 0.2 | 49.2 | 18 | 0 | ○ | 0.27 | 0.14 |
| T55 | S02 | A3 | 47.3 | 0.1 | 0 | 0 | 99.9 | 100 | 0.1 | 49.2 | 12 | 2 | ○ | 0.28 | 0.14 |
| T56 | S02 | A4 | 46.8 | 0.1 | 0 | 0.5 | 99.4 | 100 | 0.6 | 48.9 | 16 | 12 | ○ | 0.28 | 0.14 |
| T57 | S02 | AH3 | 46.0 | 0.1 | 0 | 1.8 | 98.1 | 100 | 1.9 | 48.8 | 16 | 24 | ○ | 0.28 | 0.14 |
| T58 | S02 | AH4 | 45.2 | 0.2 | 0 | 5.0 | 94.8 | 100 | 5.2 | 50.4 | 20 | 40 or more | ○ | 0.29 | 0.15 |
| T59 | S02 | A5 | 46.3 | 0.2 | 0 | 0 | 99.8 | 100 | 0.2 | 49.0 | 18 | 0 | ○ | 0.27 | 0.14 |
| T60 | S02 | A6 | 44.6 | 0.9 | 0 | 0 | 99.1 | 100 | 0.9 | 50.3 | 38 | 0 | Δ | 0.26 | 0.14 |
| T61 | S02 | AH5 | 43.5 | 0.9 | 0 | 0 | 99.1 | 100 | 0.9 | 49.2 | 42 | 0 | ○ | 0.26 | 0.14 |
| T62 | S02 | AH6 | 43.0 | 1.2 | 0 | 0 | 98.8 | 100 | 1.2 | 49.6 | 44 | 0 | Δ | 0.25 | 0.14 |
| T63 | S02 | AH7 | 45.1 | 1.0 | 0 | 0 | 99.0 | 100 | 1.0 | 51.1 | 36 | 0 | ○ | 0.26 | 0.14 |
| T64 | S02 | A7 | 46.0 | 0.7 | 0 | 0 | 99.3 | 100 | 0.7 | 51.0 | 34 | 0 | ○ | 0.26 | 0.14 |
| T65 | S02 | A8 | 46.2 | 0.3 | 0 | 0 | 99.7 | 100 | 0.3 | 49.5 | 26 | 0 | ○ | 0.27 | 0.14 |
| T66 | S02 | AH8 | 46.8 | 0.5 | 0 | 2.4 | 97.1 | 100 | 2.9 | 52.2 | 34 | 40 or more | ○ | 0.27 | 0.14 |

TABLE 25

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T51 | S02 | AH1 | 111 | ○ | ○ | 100 | 64 | ○ | 17.1 | 556 | 659 | 0.38 |
| T52-1 | S02 | AH2 | 110 | ○ | ○ | 108 | 78 | ○ | 18.3 | 556 | 663 | — |
| T52-2 | S02 | AH3 | 111 | ○ | — | 104 | 68 | — | 14.2 | 608 | 702 | — |
| T53 | S02 | A1 | 116 | ○ | — | 24 | 18 | ○ | 22.6 | 629 | 748 | 0.07 |
| T54 | S02 | A2 | 115 | ○ | — | 26 | 18 | — | 22.6 | 628 | 747 | 0.08 |
| T55 | S02 | A3 | 116 | ○ | — | 32 | 22 | — | 22.2 | 629 | 747 | 0.11 |
| T56 | S02 | A4 | 115 | ○ | — | 54 | 36 | ○ | 21.0 | 619 | 734 | 0.21 |
| T57 | S02 | AH3 | 115 | ○ | — | 64 | 38 | ○ | 19.5 | 604 | 714 | |
| T58 | S02 | AH4 | 113 | ○ | — | 98 | 56 | Δ | 15.5 | 575 | 674 | |
| T59 | S02 | A5 | 116 | ○ | — | 28 | 24 | ○ | 22.7 | 628 | 747 | 0.08 |
| T60 | S02 | A6 | 117 | ○ | — | 64 | 46 | ○ | 19.6 | 603 | 714 | 0.17 |
| T61 | 302 | AH5 | 114 | ○ | — | 72 | 46 | | 21.2 | 570 | 685 | |
| T62 | S02 | AH6 | 116 | ○ | — | 76 | 50 | ○ | 19.8 | 597 | 708 | |
| T63 | S02 | AH7 | 113 | ○ | — | 62 | 36 | — | 20.5 | 612 | 725 | 0.21 |
| T64 | S02 | A7 | 114 | ○ | — | 62 | 38 | — | 20.8 | 617 | 731 | 0.19 |
| T65 | S02 | A8 | 115 | ○ | — | 44 | 32 | — | 22.5 | 622 | 740 | 0.16 |
| T66 | S02 | AH8 | 113 | ○ | — | 88 | 60 | ○ | 18.1 | 597 | 703 | 0.39 |

TABLE 26

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T67 | S02 | A9 | 46.3 | 0.2 | 0 | 0 | 99.8 | 100 | 0.2 | 49.0 | 16 | 0 | ○ | 0.27 | 0.14 |
| T68 | S02 | AH9 | Extrusion not able to be Performed to End | | | | | | | | | | | | |
| T69 | S02 | A10 | 47.0 | 0.1 | 0 | 0 | 99.9 | 100 | 0.1 | 48.9 | 16 | 0 | ○ | 0.28 | 0.14 |
| T70 | S02 | B1 | 46.1 | 0.2 | 0 | 0 | 99.8 | 100 | 0.2 | 48.8 | 18 | 2 | ○ | 0.28 | 0.14 |
| T71 | S02 | B2 | 47.5 | 0.1 | 0 | 0 | 99.9 | 100 | 0.1 | 49.4 | 20 | 3 | ○ | 0.28 | 0.14 |
| T72 | S02 | B3 | 46.2 | 0.1 | 0 | 0 | 99.9 | 100 | 0.1 | 48.1 | 20 | 2 | ○ | 0.28 | 0.14 |
| T73 | S02 | BH1 | 46.6 | 0.2 | 0 | 0 | 99.8 | 100 | 0.2 | 49.3 | 18 | 0 | ○ | 0.27 | 0.14 |
| T74 | S02 | BH2 | 46.1 | 0.1 | 0 | 2.2 | 97.7 | 100 | 2.3 | 49.1 | 16 | 34 | ○ | 0.28 | 0.15 |
| T75 | S02 | BH3 | 45.7 | 0.1 | 0 | 3.0 | 96.9 | 100 | 3.1 | 49.1 | 20 | 40 or more | ○ | 0.28 | 0.15 |
| T76 | S02 | C0 | 37.9 | 3.3 | 0 | 0 | 96.7 | 100 | 3.3 | 48.8 | 62 | 0 | X | 0.21 | 0.14 |
| T77 | S02 | C1 | 46.6 | 0.4 | 0 | 0 | 99.6 | 100 | 0.4 | 50.4 | 24 | 0 | ○ | 0.27 | 0.14 |
| T78 | S02 | C2 | 45.7 | 0.4 | 0 | 0 | 99.6 | 100 | 0.4 | 49.5 | 26 | 8 | ○ | 0.27 | 0.14 |
| T79 | S02 | CH1 | 45.4 | 0.3 | 0 | 2.5 | 97.2 | 100 | 2.8 | 49.9 | 22 | 34 | ○ | 0.28 | 0.15 |
| T80 | S02 | DH1 | 38.0 | 3.2 | 0 | 0 | 96.8 | 100 | 3.2 | 48.7 | 54 | 0 | X | 0.21 | 0.14 |
| T81 | S02 | D1 | 46.8 | 0 | 0 | 0 | 100.0 | 100 | 0.0 | 46.8 | 0 | 0 | ○ | 0.28 | 0.14 |
| T82 | S02 | D2 | 47.2 | 0.1 | 0 | 0 | 99.9 | 100 | 0.1 | 49.1 | 14 | 2 | ○ | 0.28 | 0.14 |

TABLE 27

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T67 | S02 | A9 | 116 | ○ | — | 30 | 20 | ○ | 22.7 | 628 | 747 | 0.11 |
| T68 | S02 | AH9 | Extrusion not able to be Performed to End | | | | | | | | | |
| T69 | S02 | A10 | 117 | ○ | — | 24 | 16 | ○ | 18.2 | 648 | 755 | 0.07 |
| T70 | S02 | B1 | 117 | ○ | — | 32 | 20 | ○ | 18.2 | 653 | 759 | 0.10 |
| T71 | S02 | B2 | 117 | ○ | — | 30 | 22 | — | 17.9 | 654 | 760 | 0.12 |
| T72 | S02 | B3 | 117 | ○ | — | 34 | 18 | — | 18.4 | 654 | 761 | 0.11 |
| T73 | S02 | BH1 | 117 | ○ | — | 28 | 20 | — | 18.0 | 653 | 759 | — |
| T74 | S02 | BH2 | 115 | ○ | — | 66 | 42 | ○ | 15.6 | 625 | 724 | — |
| T75 | S02 | BH3 | 115 | ○ | — | 80 | 50 | ○ | 14.7 | 619 | 715 | 0.37 |
| T76 | S02 | C0 | 110 | ○ | ○ | 98 | 68 | ○ | 16.9 | 555 | 658 | — |
| T77 | S02 | C1 | 113 | ○ | — | 34 | 22 | — | 23.2 | 581 | 701 | 0.10 |
| T78 | S02 | C2 | 113 | ○ | — | 40 | 28 | — | 23.5 | 582 | 703 | 0.14 |
| T79 | S02 | CH1 | 113 | ○ | — | 76 | 44 | — | 20.6 | 556 | 670 | — |
| T80 | S02 | DH1 | 110 | ○ | — | 88 | 58 | — | 17.2 | 556 | 660 | 0.38 |
| T81 | S02 | D1 | 114 | ○ | — | 22 | 14 | ○ | 24.3 | 583 | 706 | 0.06 |
| T82 | S02 | D2 | 113 | ○ | — | 26 | 16 | — | 23.8 | 582 | 704 | 0.10 |

TABLE 28

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T83 | S02 | D3 | 46.6 | 0.2 | 0 | 0.4 | 99.4 | 100 | 0.6 | 49.5 | 16 | 14 | ○ | 0.28 | 0.14 |
| T84 | S02 | DH2 | 46.5 | 0.2 | 0 | 1.2 | 98.6 | 100 | 1.4 | 49.8 | 20 | 24 | ○ | 0.28 | 0.14 |
| T85 | S02 | D4 | 45.7 | 0.7 | 0 | 0 | 99.3 | 100 | 0.7 | 50.7 | 36 | 0 | ○ | 0.26 | 0.14 |
| T86 | S02 | D5 | 46.0 | 0.5 | 0 | 0 | 99.5 | 100 | 0.5 | 50.2 | 28 | 0 | ○ | 0.27 | 0.14 |
| T87 | S02 | DH3 | 45.6 | 0.7 | 0 | 2 | 97.3 | 100 | 2.7 | 51.6 | 34 | 30 | ○ | 0.27 | 0.14 |
| T88 | S02 | DH4 | 45.3 | 1.1 | 0 | 0 | 98.9 | 100 | 1.1 | 51.6 | 38 | 0 | ○ | 0.26 | 0.14 |
| T89 | S02 | D6 | 45.3 | 1.2 | 0 | 0 | 98.8 | 100 | 1.2 | 51.9 | 32 | 0 | ○ | 0.25 | 0.14 |
| T90 | S02 | DH5 | 44.0 | 2.1 | 0 | 0 | 97.9 | 100 | 2.1 | 52.7 | 46 | 0 | Δ | 0.23 | 0.14 |
| T91 | S02 | EH1, E2 | 38.0 | 3.0 | 0 | 0 | 97.0 | 100 | 3.0 | 48.4 | 50 | 0 | X | 0.21 | 0.15 |
| T92 | S02 | E1, E3 | 47.3 | 0.4 | 0 | 0 | 99.6 | 100 | 0.4 | 51.1 | 24 | 0 | ○ | 0.27 | 0.14 |
| T93 | S02 | FH1 | 37.5 | 2.8 | 0 | 0 | 97.2 | 100 | 2.8 | 47.5 | 44 | 0 | X | 0.22 | 0.15 |
| T94 | S02 | F1 | 47.5 | 0.1 | 0 | 0 | 99.9 | 100 | 0.1 | 49.4 | 14 | 0 | ○ | 0.28 | 0.14 |
| T95 | S02 | F2 | 46.9 | 0.3 | 0 | 0 | 99.7 | 100 | 0.3 | 50.2 | 22 | 0 | ○ | 0.27 | 0.14 |
| T96 | S02 | FH2 | 46.4 | 0.4 | 0 | 3.0 | 96.6 | 100 | 3.4 | 51.7 | 26 | 40 or more | ○ | 0.28 | 0.14 |
| T97 | S02 | D7 | 46.0 | 0.5 | 0 | 0 | 99.5 | 100 | 0.5 | 50.2 | 30 | 0 | ○ | 0.27 | 0.14 |
| T98 | S02 | F5 | 46.9 | 0.3 | 0 | 0 | 99.7 | 100 | 0.4 | 50.2 | 26 | 0 | ○ | 0.27 | 0.14 |

TABLE 29

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T83 | S02 | D3 | 113 | ○ | — | 46 | 32 | — | 22.2 | 579 | 697 | — |
| T84 | S02 | DH2 | 112 | ○ | — | 62 | 38 | ○ | 21.3 | 565 | 680 | 0.31 |
| T85 | S02 | D4 | 112 | ○ | — | 66 | 42 | | 22.0 | 570 | 687 | 0.16 |
| T86 | S02 | D5 | 112 | ○ | — | 52 | 34 | | 22.5 | 579 | 698 | 0.11 |
| T87 | S02 | DH3 | 111 | ○ | — | 82 | 52 | ○ | 19.4 | 556 | 667 | 0.35 |
| T88 | S02 | DH4 | 110 | ○ | — | 66 | 44 | ○ | 21.6 | 574 | 690 | — |
| T89 | S02 | D6 | 111 | ○ | — | 64 | 38 | | 21.4 | 572 | 688 | 0.19 |
| T90 | S02 | DH5 | 113 | ○ | — | 88 | 56 | ○ | 19.3 | 561 | 671 | 0.28 |
| T91 | S02 | EH1, E2 | 111 | ○ | ○ | 96 | 60 | ○ | 17.8 | 557 | 663 | 0.36 |
| T92 | S02 | E1, E3 | 112 | ○ | — | 36 | 24 | ○ | 22.9 | 581 | 701 | 0.10 |
| T93 | S02 | FH1 | 110 | ○ | — | 108 | 56 | ○ | 18.6 | 559 | 667 | 0.34 |
| T94 | S02 | F1 | 113 | ○ | — | 28 | 18 | ○ | 23.7 | 586 | 708 | 0.07 |
| T95 | S02 | F2 | 113 | ○ | — | 34 | 26 | — | 23.0 | 585 | 705 | — |
| T96 | S02 | FH2 | 111 | ○ | — | 100 | 52 | ○ | 17.5 | 560 | 665 | 0.40 |
| T97 | S02 | D7 | 112 | ○ | — | 44 | 34 | ○ | 22.4 | 579 | 698 | — |
| T98 | S02 | F5 | 113 | ○ | — | 36 | 28 | — | 23.3 | 584 | 705 | — |

TABLE 30

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T101 | S03 | AH1 | 33.7 | 2.9 | 0 | 0 | 97.1 | 100 | 2.9 | 43.9 | 54 | 0 | X | 0.10 | 0.12 |
| T102-1 | S03 | AH2 | 33.5 | 3.6 | 0 | 0 | 96.4 | 100 | 3.6 | 44.8 | 62 | 0 | X | 0.10 | 0.12 |
| T102-2 | S03 | AH3 | 33.7 | 3.0 | 0 | 0 | 97.0 | 100 | 3.0 | 44.0 | 54 | 0 | X | 0.11 | 0.12 |
| T103 | S03 | A1 | 39.8 | 0.1 | 0 | 0 | 99.9 | 100 | 0.1 | 41.7 | 14 | 0 | ○ | 0.13 | 0.12 |
| T104 | S03 | A2 | 40.1 | 0.2 | 0 | 0 | 99.8 | 100 | 0.2 | 42.8 | 18 | 0 | ○ | 0.13 | 0.12 |
| T105 | S03 | A3 | 39.5 | 0.1 | 0 | 0 | 99.9 | 100 | 0.1 | 41.4 | 16 | 4 | ○ | 0.13 | 0.12 |
| T106 | S03 | A4 | 39.2 | 0.1 | 0 | 0.8 | 99.1 | 100 | 0.9 | 41.5 | 20 | 18 | ○ | 0.13 | 0.12 |
| T107 | S03 | AH3 | 39.0 | 0.1 | 0 | 2.6 | 97.3 | 100 | 2.7 | 42.2 | 16 | 34 | ○ | 0.13 | 0.13 |
| T108 | S03 | AH4 | 36.5 | 0.2 | 0 | 5.5 | 94.3 | 100 | 5.7 | 41.9 | 18 | 40 or more | ○ | 0.14 | 0.13 |
| T109 | S03 | A5 | 39.8 | 0.3 | 0 | 0 | 99.7 | 100 | 0.3 | 43.0 | 22 | 0 | ○ | 0.13 | 0.12 |
| T110 | S03 | A6 | 37.8 | 1.2 | 0 | 0 | 98.8 | 100 | 1.2 | 44.4 | 38 | 0 | Δ | 0.12 | 0.12 |
| T111 | S03 | AH5 | 39.5 | 1.2 | 0 | 0 | 98.8 | 100 | 1.2 | 46.0 | 42 | 0 | Δ | 0.12 | 0.12 |
| T112 | S03 | AH6 | 37.4 | 1.4 | 0 | 0 | 98.6 | 100 | 1.4 | 44.5 | 44 | 0 | Δ | 0.12 | 0.12 |
| T113 | S03 | AH7 | 39.4 | 1.4 | 0 | 0 | 98.6 | 100 | 1.4 | 46.5 | 40 | 0 | ○ | 0.12 | 0.12 |
| T114 | S03 | A7 | 40.0 | 0.7 | 0 | 0 | 99.3 | 100 | 0.7 | 45.0 | 30 | 0 | ○ | 0.12 | 0.12 |
| T115 | S03 | A8 | 39.7 | 0.5 | 0 | 0 | 99.5 | 100 | 0.5 | 43.9 | 26 | 0 | ○ | 0.13 | 0.12 |
| T116 | S03 | AH8 | 38.3 | 0.6 | 0 | 2.7 | 96.7 | 100 | 3.3 | 44.3 | 16 | 40 or more | ○ | 0.13 | 0.13 |
| T117 | S03 | A9 | 39.8 | 0.3 | 0 | 0 | 99.7 | 100 | 0.3 | 43.0 | 24 | 0 | ○ | 0.13 | 0.12 |

TABLE 31

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T101 | S03 | AH1 | 114 | ○ | ○ | 106 | 62 | ○ | 21.0 | 548 | 662 | 0.37 |
| T102-1 | S03 | AH2 | 112 | ○ | ○ | 118 | 76 | ○ | 20.3 | 543 | 655 | — |
| T102-2 | S03 | AH3 | 114 | ○ | — | 108 | 66 | — | 16.3 | 596 | 697 | — |
| T103 | S03 | A1 | 120 | ○ | — | 26 | 18 | ○ | 27.6 | 617 | 748 | 0.09 |
| T104 | S03 | A2 | 119 | ○ | — | 32 | 24 | — | 27.1 | 616 | 746 | 0.10 |
| T105 | S03 | A3 | 121 | ○ | — | 38 | 32 | — | 26.3 | 617 | 745 | |
| T106 | S03 | A4 | 120 | ○ | — | 60 | 38 | — | 24.5 | 602 | 726 | 0.23 |
| T107 | S03 | AH3 | 119 | ○ | — | 78 | 44 | — | 23.6 | 587 | 709 | |
| T108 | S03 | AH4 | 118 | ○ | — | 100 | 60 | ○ | 19.2 | 561 | 671 | 0.49 |
| T109 | S03 | A5 | 119 | ○ | — | 36 | 24 | — | 27.0 | 615 | 745 | 0.11 |
| T110 | S03 | A6 | 118 | ○ | — | 70 | 42 | — | 28.9 | 590 | 724 | |
| T111 | S03 | AH5 | 116 | ○ | — | 80 | 44 | — | 24.1 | 555 | 678 | |
| T112 | S03 | AH6 | 119 | ○ | — | 76 | 52 | ○ | 24.4 | 598 | 722 | |
| T113 | S03 | AH7 | 117 | ○ | — | 76 | 46 | ○ | 23.5 | 607 | 728 | 0.22 |
| T114 | S03 | A7 | 117 | ○ | — | 52 | 36 | — | 25.5 | 612 | 738 | 0.15 |
| T115 | S03 | A8 | 118 | ○ | — | 40 | 30 | — | 26.3 | 614 | 742 | |

TABLE 31-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T116 | S03 | AH8 | 118 | ○ | — | 76 | 44 | ○ | 21.8 | 583 | 699 | 0.44 |
| T117 | S03 | A9 | 119 | ○ | — | 34 | 24 | ○ | 27.0 | 615 | 745 | 0.11 |

TABLE 32

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T118 | S03 | AH9 | Extrusion not able to be Performed to End | | | | | | | | | | | | |
| T119 | S03 | A10 | 40.5 | 0.1 | 0 | 0 | 99.9 | 100 | 0.1 | 42.4 | 14 | 0 | ○ | 0.13 | 0.12 |
| T120 | S03 | B1 | 39.0 | 0.2 | 0 | 0 | 99.8 | 100 | 0.2 | 41.7 | 18 | 2 | ○ | 0.13 | 0.12 |
| T121 | S03 | B2 | 39.4 | 0.2 | 0 | 0 | 99.8 | 100 | 0.2 | 42.1 | 20 | 4 | ○ | 0.13 | 0.12 |
| T122 | S03 | B3 | 38.6 | 0.1 | 0 | 0 | 99.9 | 100 | 0.1 | 40.5 | 16 | 3 | ○ | 0.13 | 0.12 |
| T123 | S03 | BH1 | 40.0 | 0.2 | 0 | 0 | 99.8 | 100 | 0.2 | 42.7 | 18 | 0 | ○ | 0.13 | 0.12 |
| T124 | S03 | BH2 | 38.5 | 0.2 | 0 | 2.4 | 97.4 | 100 | 2.6 | 42.4 | 18 | 30 | ○ | 0.13 | 0.13 |
| T125 | S03 | BH3 | 38.2 | 0.1 | 0 | 2.8 | 96.9 | 100 | 2.9 | 41.5 | 16 | 40 or more | ○ | 0.13 | 0.13 |
| T126 | S03 | C0 | 33.7 | 3.0 | 0 | 0 | 97.0 | 100 | 3.0 | 44.0 | 56 | 0 | X | 0.11 | 0.12 |
| T127 | S03 | C1 | 40.2 | 0.6 | 0 | 0 | 99.4 | 100 | 0.6 | 44.8 | 28 | 0 | ○ | 0.12 | 0.12 |
| T128 | S03 | C2 | 39.6 | 0.5 | 0 | 0 | 99.5 | 100 | 0.5 | 43.8 | 24 | 8 | ○ | 0.13 | 0.12 |
| T129 | S03 | CH1 | 39.0 | 0.5 | 0 | 3 | 96.5 | 100 | 3.5 | 44.7 | 26 | 32 | ○ | 0.13 | 0.12 |
| T130 | S03 | CH2 | 33.5 | 3.8 | 0 | 0 | 96.2 | 100 | 3.8 | 45.2 | 70 | 0 | X | 0.09 | 0.12 |
| T131 | S03 | DH1 | 33.8 | 2.6 | 0 | 0 | 97.4 | 100 | 2.6 | 43.5 | 50 | 0 | X | 0.10 | 0.12 |
| T132 | S03 | D1 | 39.5 | 0.1 | 0 | 0 | 99.9 | 100 | 0.1 | 41.4 | 12 | 0 | ○ | 0.13 | 0.12 |
| T133 | S03 | D2 | 40.2 | 0.1 | 0 | 0 | 99.9 | 100 | 0.1 | 42.1 | 14 | 3 | ○ | 0.13 | 0.12 |
| T134 | S03 | D3 | 39.0 | 0.2 | 0 | 0.5 | 99.3 | 100 | 0.7 | 41.9 | 20 | 16 | ○ | 0.13 | 0.12 |

TABLE 33

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T118 | S03 | AH9 | Extrusion not able to be Performed to End | | | | | | | | | |
| T119 | S03 | A10 | 121 | ○ | — | 28 | 18 | ○ | 22.2 | 631 | 749 | 0.09 |
| T120 | S03 | B1 | 121 | ○ | — | 32 | 22 | | 22.1 | 636 | 753 | 0.12 |
| T121 | S03 | B2 | 121 | ○ | — | 38 | 26 | ○ | 21.4 | 636 | 752 | |
| T122 | S03 | B3 | 123 | ○ | — | 34 | 20 | — | 22.1 | 637 | 754 | |
| T123 | S03 | BH1 | 121 | ○ | — | 34 | 22 | — | 21.6 | 636 | 752 | — |
| T124 | S03 | BH2 | 123 | ○ | — | 68 | 42 | — | 19.0 | 607 | 716 | — |
| T125 | S03 | BH3 | 124 | ○ | — | 76 | 46 | ○ | 18.6 | 605 | 713 | 0.39 |
| T126 | S03 | C0 | 115 | ○ | ○ | 104 | 70 | ○ | 21.8 | 547 | 664 | — |
| T127 | S03 | C1 | 116 | ○ | — | 38 | 26 | ○ | 27.1 | 570 | 700 | 0.14 |
| T128 | S03 | C2 | 116 | ○ | — | 44 | 30 | ○ | 27.7 | 571 | 703 | — |
| T129 | S03 | CH1 | 117 | ○ | — | 72 | 44 | ○ | 22.4 | 552 | 670 | — |
| T130 | S03 | CH2 | — | ○ | — | 118 | 80 | — | — | — | — | — |
| T131 | S03 | DH1 | 115 | ○ | — | 96 | 62 | ○ | 23.5 | 550 | 671 | 0.34 |
| T132 | S03 | D1 | 118 | ○ | — | 28 | 16 | ○ | 29.2 | 571 | 706 | 0.09 |
| T133 | S03 | D2 | 118 | ○ | — | 32 | 20 | — | 28.6 | 571 | 705 | — |
| T134 | S03 | D3 | 117 | ○ | — | 50 | 34 | — | 26.7 | 567 | 697 | — |

TABLE 34

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T135 | S03 | DH2 | 38.8 | 0.1 | 0 | 1.6 | 98.3 | 100 | 1.7 | 41.5 | 16 | 26 | ○ | 0.13 | 0.12 |
| T136 | S03 | D4 | 37.7 | 0.8 | 0 | 0 | 99.2 | 100 | 0.9 | 43.1 | 34 | 0 | Δ | 0.12 | 0.12 |
| T137 | S03 | D5 | 39.3 | 0.6 | 0 | 0 | 99.4 | 100 | 0.6 | 43.9 | 28 | 0 | ○ | 0.13 | 0.12 |
| T138 | S03 | DH3 | 38.6 | 0.9 | 0 | 2.2 | 96.9 | 100 | 3.1 | 45.4 | 30 | 28 | ○ | 0.12 | 0.12 |
| T139 | S03 | DH4 | 39.9 | 1.4 | 0 | 0 | 98.6 | 100 | 1.4 | 47.0 | 36 | 0 | Δ | 0.12 | 0.12 |
| T140 | S03 | D6 | 37.4 | 1.3 | 0 | 0 | 98.7 | 100 | 1.3 | 44.2 | 34 | 0 | Δ | 0.12 | 0.12 |
| T141 | S03 | DH5 | 36.6 | 2.4 | 0 | 0 | 97.6 | 100 | 2.4 | 45.9 | 44 | 0 | Δ | 0.11 | 0.12 |

TABLE 34-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T142 | S03 | D8 | 39.0 | 1.0 | 0 | 0 | 99.0 | 100 | 1.0 | 45.0 | 38 | 0 | ○ | 0.12 | 0.12 |
| T143 | S03 | EH1, E2 | 33.7 | 2.8 | 0 | 0 | 97.2 | 100 | 2.8 | 43.8 | 54 | 0 | X | 0.11 | 0.12 |
| T144 | S03 | E1, E3 | 40.3 | 0.5 | 0 | 0 | 99.5 | 100 | 0.5 | 44.5 | 26 | 0 | ○ | 0.13 | 0.12 |
| T145 | S03 | FH1 | 35.2 | 2.7 | 0 | 0 | 97.3 | 100 | 2.7 | 45.1 | 52 | 0 | X | 0.11 | 0.12 |
| T146 | S03 | F1 | 40.2 | 0.2 | 0 | 0 | 99.8 | 100 | 0.2 | 42.9 | 14 | 0 | ○ | 0.13 | 0.12 |
| T147 | S03 | F2 | 39.7 | 0.4 | 0 | 0 | 99.6 | 100 | 0.4 | 43.5 | 26 | 0 | ○ | 0.13 | 0.12 |
| T148 | S03 | FH2 | 38.7 | 0.5 | 0 | 2.4 | 97.1 | 100 | 2.9 | 44.1 | 24 | 34 | ○ | 0.13 | 0.12 |
| T149 | S03 | A11 | 40.5 | 0.1 | 0 | 0 | 99.9 | 100 | 0.1 | 42.4 | 14 | 0 | ○ | 0.13 | 0.12 |
| T150 | S03 | A12 | 39.8 | 0.1 | 0 | 0 | 99.9 | 100 | 0.1 | 41.7 | 14 | 0 | ○ | 0.13 | 0.12 |

TABLE 35

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T135 | S03 | DH2 | 118 | ○ | — | 68 | 42 | — | 25.5 | 553 | 679 | — |
| T136 | S03 | D4 | 120 | ○ | — | 62 | 40 | — | 26.2 | 558 | 686 | — |
| T137 | S03 | D5 | 117 | ○ | — | 52 | 34 | ○ | 27.5 | 564 | 695 | — |
| T138 | S03 | DH3 | 117 | ○ | ○ | 82 | 52 | ○ | 23.8 | 546 | 668 | — |
| T139 | S03 | DH4 | 118 | ○ | — | 66 | 38 | | 24.7 | 542 | 666 | — |
| T140 | S03 | D6 | 119 | ○ | — | 68 | 38 | ○ | 26.6 | 547 | 676 | — |
| T141 | S03 | DH5 | 118 | ○ | — | 98 | 58 | ○ | 22.7 | 554 | 674 | — |
| T142 | S03 | D8 | 116 | ○ | — | 66 | 38 | — | 26.3 | 564 | 692 | — |
| T143 | S03 | EH1, E2 | 115 | ○ | ○ | 100 | 64 | — | 22.8 | 548 | 668 | — |
| T144 | S03 | E1, E3 | 116 | ○ | — | 42 | 26 | — | 27.4 | 568 | 699 | 0.13 |
| T145 | S03 | FH1 | 119 | ○ | — | 114 | 64 | — | 22.4 | 553 | 671 | 0.35 |
| T146 | S03 | F1 | 117 | ○ | — | 32 | 18 | — | 28.5 | 575 | 708 | 0.10 |
| T147 | S03 | F2 | 117 | ○ | — | 42 | 24 | — | 28.5 | 573 | 707 | — |
| T148 | S03 | FH2 | 116 | ○ | — | 94 | 62 | ○ | 24.0 | 546 | 668 | — |
| T149 | S03 | A11 | 123 | ○ | — | 28 | 18 | | 16.8 | 684 | 786 | 0.12 |
| T150 | S03 | A12 | 121 | ○ | — | 28 | 16 | ○ | 25.0 | 638 | 763 | — |

TABLE 36

| Test No. | Alloy No. | Step No. | Wear Resistance: Amsler Abrasion Test | Wear Resistance: Ball-On-Disk Abrasion Test |
|---|---|---|---|---|
| T26 | S01 | C0 | Δ | ○ |
| T27 | S01 | C1 | ◎ | ○ |
| T28 | S01 | C2 | ○ | Δ |
| T29 | S01 | CH1 | Δ | Δ |
| T42 | S01 | EH1, E2 | Δ | ○ |
| T43 | S01 | E1, E3 | ◎ | ○ |
| T76 | S02 | C0 | ○ | ○ |
| T77 | S02 | C1 | ◎ | ◎ |
| T79 | S02 | CH1 | ○ | Δ |

TABLE 36-continued

| Test No. | Alloy No. | Step No. | Wear Resistance: Amsler Abrasion Test | Wear Resistance: Ball-On-Disk Abrasion Test |
|---|---|---|---|---|
| T91 | S02 | EH1, E2 | ○ | ○ |
| T92 | S02 | E1, E3 | ◎ | ◎ |
| T126 | S03 | C0 | ○ | ○ |
| T127 | S03 | C1 | ◎ | ◎ |
| T129 | S03 | CH1 | ○ | Δ |
| T143 | S03 | EH1, E2 | ○ | ○ |
| T144 | S03 | E1, E3 | ◎ | ◎ |

TABLE 37

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T201 | S11 | EH1, E2 | 38.8 | 1.8 | 0 | 0 | 98.2 | 100 | 1.8 | 46.8 | 48 | 0 | X | 0.19 | 0.11 |
| T202 | S11 | E1, E3 | 47.5 | 0.2 | 0 | 0 | 99.8 | 100 | 0.2 | 50.2 | 18 | 0 | ○ | 0.22 | 0.10 |
| T203 | S11 | FH1 | 39.0 | 1.7 | 0 | 0 | 98.3 | 100 | 1.7 | 46.8 | 48 | 0 | X | 0.19 | 0.11 |
| T204 | S11 | F1 | 47.5 | 0.06 | 0 | 0 | 99.9 | 100 | 0.06 | 49.0 | 16 | 0 | ○ | 0.23 | 0.10 |
| T205 | S11 | F2 | 47.0 | 0.4 | 0 | 0 | 99.6 | 100 | 0.4 | 50.8 | 26 | 0 | ○ | 0.22 | 0.10 |

TABLE 37-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T206 | S12 | F3 | 34.8 | 0.7 | 0 | 0 | 99.3 | 100 | 0.7 | 39.8 | 34 | 0 | ○ | 0.31 | 0.11 |
| T207 | S12 | F4 | 34.8 | 0.9 | 0 | 0 | 99.1 | 100 | 0.9 | 40.5 | 34 | 0 | ○ | 0.30 | 0.11 |
| T208 | S13 | EH1, E2 | 29.8 | 3.5 | 0 | 0 | 96.5 | 100 | 3.5 | 41.0 | 64 | 0 | X | 0.16 | 0.12 |
| T209 | S13 | E1, E3 | 35.7 | 0.3 | 0 | 0 | 99.7 | 100 | 0.3 | 39.0 | 16 | 0 | ○ | 0.21 | 0.13 |
| T210 | S13 | FH1 | 30.0 | 3.3 | 0 | 0 | 96.7 | 100 | 3.3 | 40.9 | 54 | 0 | X | 0.16 | 0.12 |
| T211 | S13 | F1 | 36.0 | 0.2 | 0 | 0 | 99.8 | 100 | 0.2 | 38.7 | 16 | 0 | ○ | 0.21 | 0.13 |
| T212 | S13 | F2 | 35.0 | 0.5 | 0 | 0 | 99.5 | 100 | 0.5 | 39.2 | 30 | 0 | ○ | 0.20 | 0.13 |
| T213 | S13 | FH2 | 34.0 | 0.6 | 0 | 2.5 | 96.9 | 100 | 3.1 | 39.9 | 38 | 30 | ○ | 0.21 | 0.13 |
| T214 | S14 | EH1 | 30.2 | 5.8 | 0 | 0 | 94.2 | 100 | 5.8 | 44.6 | 116 | 0 | X | 0.09 | 0.15 |
| T215 | S14 | E1 | 36.6 | 1.0 | 0 | 0 | 99.0 | 100 | 1.0 | 42.6 | 34 | 0 | ○ | 0.16 | 0.15 |
| T216 | S15 | EH1, E2 | 30.3 | 1.5 | 0 | 0 | 98.5 | 100 | 1.5 | 37.7 | 40 | 0 | X | 0.07 | 0.09 |
| T217 | S15 | E1 | 35.2 | 0.09 | 0 | 0 | 99.9 | 100 | 0.09 | 37.0 | 16 | 0 | ○ | 0.09 | 0.08 |
| T218 | S16 | EH1 | 28.3 | 5.0 | 0 | 0 | 95.0 | 100 | 5.0 | 41.7 | 84 | 0 | X | 0.19 | 0.11 |
| T219 | S16 | E1 | 35.3 | 1.1 | 0 | 0 | 98.9 | 100 | 1.1 | 41.6 | 34 | 0 | ○ | 0.29 | 0.11 |
| T220 | S16 | FH1 | 28.5 | 4.5 | 0 | 0 | 95.5 | 100 | 4.5 | 41.2 | 94 | 0 | X | 0.20 | 0.11 |
| T221 | S16 | F1 | 36.5 | 0.9 | 0 | 0 | 99.1 | 100 | 0.9 | 42.2 | 30 | 0 | ○ | 0.29 | 0.11 |
| T222 | S17 | EH1 | 26.6 | 5.3 | 0 | 0 | 94.7 | 100 | 5.3 | 40.4 | 88 | 0 | X | 0.20 | 0.11 |
| T223 | S17 | E1 | 33.5 | 0.6 | 0 | 0 | 99.4 | 100 | 0.6 | 38.1 | 34 | 0 | ○ | 0.32 | 0.11 |

TABLE 38

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T201 | S11 | EH1, E2 | 114 | ○ | ○ | 88 | 46 | ○ | 19.1 | 561 | 670 | 0.26 |
| T202 | S11 | E1, E3 | 115 | ○ | — | 34 | 20 | ○ | 23.0 | 589 | 709 | 0.12 |
| T203 | S11 | FH1 | 114 | ○ | — | 88 | 46 | | 19.6 | 563 | 674 | — |
| T204 | S11 | F1 | 115 | ○ | — | 32 | 20 | | 22.8 | 596 | 715 | — |
| T205 | S11 | F2 | 115 | ○ | — | 44 | 20 | | 23.3 | 592 | 713 | — |
| T206 | S12 | F3 | 117 | ○ | — | 48 | 30 | ○ | 30.5 | 563 | 701 | 0.13 |
| T207 | S12 | F4 | 116 | ○ | — | 52 | 32 | ○ | 29.7 | 562 | 698 | 0.15 |
| T208 | S13 | EH1, E2 | 118 | ○ | ○ | 110 | 72 | | 24.0 | 524 | 646 | |
| T209 | S13 | E1, E3 | 121 | ○ | — | 32 | 20 | | 31.7 | 555 | 696 | |
| T210 | S13 | FH1 | 118 | ○ | — | 100 | 62 | ○ | 23.3 | 520 | 641 | 0.36 |
| T211 | S13 | F1 | 121 | ○ | — | 26 | 16 | ○ | 30.0 | 562 | 699 | 0.13 |
| T212 | S13 | F2 | 121 | ○ | — | 46 | 30 | ○ | 29.6 | 556 | 692 | 0.18 |
| T213 | S13 | FH2 | 119 | ○ | — | 80 | 58 | ○ | 25.0 | 532 | 657 | 0.32 |
| T214 | S14 | EH1 | 105 | ○ | ○ | 126 | 88 | ○ | 14.0 | 522 | 616 | — |
| T215 | S14 | E1 | 112 | ○ | — | 58 | 36 | ○ | 24.8 | 560 | 684 | 0.25 |
| T216 | S15 | EH1, E2 | 124 | ○ | ○ | 100 | 64 | ○ | 29.8 | 552 | 688 | — |
| T217 | S15 | E1 | 126 | ○ | — | 62 | 38 | ○ | 32.8 | 567 | 710 | 0.14 |
| T218 | S16 | EH1 | 109 | ○ | ○ | 128 | 88 | ○ | 18.9 | 527 | 636 | 0.57 |
| T219 | S16 | E1 | 114 | ○ | — | 56 | 32 | ○ | 28.8 | 559 | 693 | 0.18 |
| T220 | S16 | FH1 | 110 | ○ | — | 120 | 82 | ○ | 20.4 | 531 | 644 | — |
| T221 | S16 | F1 | 114 | ○ | — | 52 | 32 | ○ | 28.9 | 566 | 700 | — |
| T222 | S17 | EH1 | 111 | ○ | ○ | 130 | 92 | — | 19.0 | 525 | 634 | — |
| T223 | S17 | E1 | 118 | ○ | — | 44 | 32 | — | 32.2 | 561 | 703 | 0.10 |

TABLE 39

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T224 | S18 | EH1, E2 | 33.8 | 4.6 | 0 | 0 | 95.4 | 100 | 4.6 | 46.7 | 90 | 0 | X | 0.10 | 0.13 |
| T225 | S18 | E1, E3 | 42.0 | 0.6 | 0 | 0 | 99.4 | 100 | 0.6 | 46.6 | 28 | 0 | ○ | 0.15 | 0.13 |
| T226 | S19 | EH1 | 33.5 | 5.0 | 0 | 0 | 95.0 | 100 | 5.0 | 46.9 | 90 | 0 | X | 0.10 | 0.15 |

TABLE 39-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T227 | S19 | E1 | 42.0 | 0.9 | 0 | 0 | 99.1 | 100 | 0.9 | 47.7 | 32 | 0 | ○ | 0.15 | 0.15 |
| T228 | S19 | F1 | 42.5 | 0.7 | 0 | 0 | 99.3 | 100 | 0.7 | 47.5 | 28 | 0 | ○ | 0.15 | 0.15 |
| T229 | S20 | EH1 | 34.6 | 5.9 | 0 | 0 | 94.1 | 100 | 5.9 | 49.2 | 116 | 0 | X | 0.18 | 0.10 |
| T230 | S20 | E1 | 44.0 | 0.5 | 0 | 0 | 99.5 | 100 | 0.5 | 48.2 | 16 | 0 | ○ | 0.31 | 0.10 |
| T231 | S21 | EH1 | 42.2 | 3.3 | 0 | 0 | 96.7 | 100 | 3.3 | 53.1 | 48 | 0 | X | 0.21 | 0.21 |
| T232 | S21 | E1 | 52.7 | 0.3 | 0 | 0 | 99.7 | 100 | 0.3 | 56.0 | 24 | 0 | ○ | 0.27 | 0.17 |
| T233 | S22 | F3 | 47.0 | 0.2 | 0 | 0 | 99.8 | 100 | 0.2 | 49.7 | 16 | 0 | ○ | 0.27 | 0.13 |
| T234 | S22 | F4 | 46.5 | 0.3 | 0 | 0 | 99.7 | 100 | 0.3 | 49.8 | 22 | 0 | ○ | 0.27 | 0.13 |
| T235 | S23 | E1 | 44.5 | 0.2 | 0 | 0 | 99.8 | 100 | 0.2 | 47.2 | 16 | 0 | ○ | 0.32 | 0.09 |
| T236 | S24 | EH1 | 32.7 | 4.5 | 0 | 0 | 95.5 | 100 | 4.5 | 45.4 | 72 | 0 | X | 0.19 | 0.11 |
| T237 | S24 | E1 | 41.4 | 0.4 | 0 | 0 | 99.6 | 100 | 0.4 | 45.2 | 24 | 0 | ○ | 0.30 | 0.11 |
| T238 | S24 | FH1 | 33.0 | 4.0 | 0 | 0 | 96.0 | 100 | 4 | 45.0 | 82 | 0 | X | 0.19 | 0.11 |
| T239 | S24 | F1 | 42.0 | 0.5 | 0 | 0 | 99.5 | 100 | 0.5 | 46.2 | 22 | 0 | ○ | 0.29 | 0.11 |
| T240 | S25 | EH1 | 34.7 | 2.9 | 0 | 0 | 97.1 | 100 | 2.9 | 44.9 | 55 | 0 | X | 0.22 | 0.09 |
| T241 | S25 | E1 | 42.8 | 0.4 | 0 | 0 | 99.6 | 100 | 0.4 | 46.6 | 20 | 0 | ○ | 0.28 | 0.09 |
| T242 | S25 | FH1 | 35.0 | 2.5 | 0 | 0 | 97.5 | 100 | 2.5 | 44.5 | 48 | 0 | X | 0.23 | 0.10 |
| T243 | S25 | F1 | 43.0 | 0.1 | 0 | 0 | 99.9 | 100 | 0.1 | 45.1 | 16 | 0 | ○ | 0.29 | 0.09 |
| T244 | S25 | F2 | 42.5 | 0.2 | 0 | 0 | 99.8 | 100 | 0.2 | 45.2 | 18 | 0 | ○ | 0.29 | 0.09 |
| T245 | S25 | FH2 | 41.5 | 0.6 | 0 | 2 | 97.4 | 100 | 2.6 | 47.1 | 30 | 24 | ○ | 0.28 | 0.09 |

TABLE 40

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T224 | S18 | EH1, E2 | 107 | ○ | ○ | 122 | 90 | Δ | 13.9 | 490 | 583 | 0.64 |
| T225 | S18 | E1, E3 | 113 | ○ | — | 48 | 32 | ○ | 24.9 | 554 | 679 | 0.22 |
| T226 | S19 | EH1 | 106 | ○ | ○ | 122 | 90 | Δ | 13.9 | 488 | 581 | — |
| T227 | S19 | E1 | 112 | ○ | — | 52 | 34 | ○ | 24.9 | 552 | 677 | 0.24 |
| T228 | S19 | F1 | 113 | ○ | — | 48 | 30 | ○ | 25.0 | 558 | 683 | — |
| T229 | S20 | EH1 | 104 | ○ | ○ | 128 | 80 | — | 13.2 | 530 | 621 | 0.57 |
| T230 | S20 | E1 | 111 | ○ | — | 34 | 22 | — | 24.8 | 573 | 698 | 0.15 |
| T231 | S21 | EH1 | 116 | ○ | ○ | 100 | 66 | ○ | 15.9 | 550 | 650 | 0.34 |
| T232 | S21 | E1 | 119 | ○ | — | 34 | 22 | ○ | 16.8 | 572 | 674 | 0.11 |
| T233 | S22 | F3 | 114 | ○ | — | 28 | 16 | ○ | 24.2 | 583 | 706 | 0.12 |
| T234 | S22 | F4 | 110 | ○ | ○ | 34 | 22 | ○ | 23.5 | 580 | 701 | 0.16 |
| T235 | S23 | E1 | 118 | ○ | — | 28 | 14 | — | 24.6 | 568 | 692 | 0.13 |
| T236 | S24 | EH1 | 109 | ○ | ○ | 114 | 98 | — | 12.9 | 522 | 612 | 0.50 |
| T237 | S24 | E1 | 116 | ○ | — | 34 | 18 | — | 26.0 | 568 | 695 | 0.13 |
| T238 | S24 | FH1 | 109 | ○ | — | 108 | 92 | — | 13.5 | 530 | 622 | — |
| T239 | S24 | F1 | 116 | ○ | — | 32 | 24 | — | 25.8 | 575 | 702 | 0.11 |
| T240 | S25 | EH1 | 112 | ○ | ○ | 100 | 62 | — | 21.3 | 554 | 669 | — |
| T241 | S25 | E1 | 114 | ○ | — | 26 | 16 | — | 25.5 | 575 | 702 | — |
| T242 | S25 | FH1 | 113 | ○ | — | 102 | 56 | ○ | 23.0 | 560 | 680 | |
| T243 | S25 | F1 | 116 | ○ | — | 24 | 14 | ○ | 26.3 | 588 | 716 | 0.06 |
| T244 | S25 | F2 | 116 | ○ | — | 28 | 18 | ○ | 26.0 | 588 | 715 | |
| T245 | S25 | FH2 | 113 | ○ | — | 74 | 52 | ○ | 23.2 | 558 | 678 | 0.30 |

TABLE 41

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T246 | S26 | F3 | 47.6 | 0.1 | 0 | 0 | 99.9 | 100 | 0.1 | 49.5 | 15 | 0 | ○ | 0.19 | 0.10 |
| T247 | S27 | E1 | 44.9 | 0.05 | 0 | 0 | 100 | 100 | 0.05 | 46.2 | 0 | 0 | ○ | 0.13 | 0.13 |
| T248 | S28 | E1 | 47.2 | 0.03 | 0 | 0 | 100 | 100 | 0.03 | 48.2 | 0 | 0 | ○ | 0.10 | 0.12 |
| T249 | S29 | EH1 | 38.8 | 2.8 | 0 | 0 | 97.2 | 100 | 2.8 | 48.8 | 54 | 0 | X | 0.22 | 0.13 |
| T250 | S29 | E1 | 48.0 | 0.2 | 0 | 0 | 99.8 | 100 | 0.2 | 50.7 | 22 | 0 | ○ | 0.28 | 0.13 |
| T251 | S30 | E1 | 61.0 | 0.1 | 0 | 0 | 99.9 | 100 | 0.1 | 62.9 | 15 | 0 | ○ | 0.17 | 0.13 |
| T252-1 | S31 | E1 | 25.3 | 1.3 | 0 | 0 | 98.7 | 100 | 1.3 | 32.1 | 38 | 0 | Δ | 0.16 | 0.13 |
| T253 | S31 | F1 | 25.5 | 1.0 | 0 | 0 | 99.0 | 100 | 1.0 | 31.5 | 34 | 0 | Δ | 0.17 | 0.13 |
| T254 | S32 | EH1, E2 | 19.5 | 6.6 | 0 | 0 | 93.4 | 100 | 6.6 | 34.9 | 120 | 0 | X | 0.10 | 0.13 |

TABLE 41-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T255 | S32 | E1, E3 | 26.5 | 1.2 | 0 | 0 | 98.8 | 100 | 1.2 | 33.1 | 36 | 0 | ○ | 0.19 | 0.13 |
| T256 | S32 | FH1 | 20.0 | 6.0 | 0 | 0 | 94.0 | 100 | 6.0 | 34.7 | 136 | 0 | X | 0.11 | 0.13 |
| T257 | S32 | F1 | 26.5 | 1.0 | 0 | 0 | 99.0 | 100 | 1.0 | 32.5 | 34 | 0 | ○ | 0.19 | 0.13 |
| T258 | S32 | F2 | 26.5 | 1.1 | 0 | 0 | 98.9 | 100 | 1.1 | 32.8 | 36 | 0 | ○ | 0.19 | 0.13 |
| T252-2 | S33 | E1 | 25.1 | 0.6 | 0 | 0 | 99.4 | 100 | 0.6 | 29.7 | 32 | 0 | Δ | 0.14 | 0.15 |
| T301 | S41 | EH1 | 31.5 | 1.7 | 0 | 0 | 98.3 | 100 | 1.7 | 39.3 | 50 | 0 | X | 0.11 | 0.12 |
| T302 | S41 | E1 | 39.7 | 0.2 | 0 | 0 | 99.8 | 100 | 0.2 | 42.4 | 22 | 0 | ○ | 0.13 | 0.12 |
| T303 | S41 | FH1 | 31.8 | 1.6 | 0 | 0 | 98.4 | 100 | 1.6 | 39.4 | 44 | 0 | X | 0.12 | 0.12 |
| T304 | S41 | F1 | 40.0 | 0.05 | 0 | 0 | 99.9 | 100 | 0.05 | 41.4 | 20 | 0 | ○ | 0.13 | 0.12 |
| T305 | S42 | E1 | 38.9 | 0.3 | 0 | 0 | 99.7 | 100 | 0.3 | 42.2 | 16 | 0 | ○ | 0.13 | 0.12 |
| T306 | S43 | E1 | 36.5 | 0.3 | 0 | 0 | 99.7 | 100 | 0.3 | 39.6 | 16 | 0 | ○ | 0.27 | 0.17 |
| T307 | S44 | E1 | 33.8 | 0.2 | 0 | 0 | 99.8 | 100 | 0.2 | 36.5 | 16 | 0 | ○ | 0.20 | 0.13 |
| T308 | S45 | F3 | 40.3 | 0.2 | 0 | 0 | 99.8 | 100 | 0.2 | 43.0 | 16 | 0 | ○ | 0.14 | 0.14 |

TABLE 42

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T246 | S26 | F3 | 114 | ○ | — | 24 | 14 | ○ | 23.4 | 586 | 707 | 0.06 |
| T247 | S27 | E1 | 115 | ○ | — | 34 | 28 | — | 24.2 | 585 | 708 | 0.05 |
| T248 | S28 | E1 | 119 | ○ | — | 56 | 36 | — | 24.4 | 583 | 707 | 0.05 |
| T249 | S29 | EH1 | 112 | ○ | ○ | 102 | 60 | — | 19.8 | 556 | 667 | 0.33 |
| T250 | S29 | E1 | 115 | ○ | — | 30 | 22 | — | 25.5 | 581 | 708 | 0.14 |
| T251 | S30 | E1 | 120 | ○ | — | 54 | 32 | ○ | 15.9 | 598 | 697 | 0.05 |
| T252-1 | S31 | E1 | 127 | ○ | — | 64 | 46 | ○ | 38.8 | 540 | 696 | 0.14 |
| T253 | S31 | F1 | 129 | ○ | — | 58 | 40 | ○ | 41.3 | 546 | 707 | 0.12 |
| T254 | 332 | EH1, E2 | 113 | ○ | ○ | 122 | 100 | | 19.8 | 511 | 622 | — |
| T255 | S32 | E1, E3 | 124 | ○ | — | 62 | 44 | | 38.1 | 543 | 697 | 0.12 |
| T256 | S32 | FH1 | 113 | ○ | — | 140 | 92 | ○ | 21.9 | 520 | 637 | — |
| T257 | S32 | F1 | 124 | ○ | — | 58 | 40 | ○ | 39.2 | 551 | 708 | — |
| T258 | S32 | F2 | 124 | ○ | — | 62 | 42 | ○ | 38.7 | 547 | 703 | — |
| T252-2 | S33 | E1 | 130 | ○ | — | 60 | 44 | ○ | 45.8 | 541 | 710 | 0.16 |
| T301 | S41 | EH1 | 122 | ○ | ○ | 100 | 66 | — | 28.8 | 545 | 679 | — |
| T302 | S41 | E1 | 124 | ○ | — | 32 | 22 | — | 29.5 | 572 | 708 | 0.16 |
| T303 | S41 | FH1 | 123 | ○ | — | 94 | 66 | ○ | 28.5 | 550 | 683 | 0.43 |
| T304 | S41 | F1 | 126 | ○ | — | 34 | 26 | — | 28.0 | 583 | 715 | 0.14 |
| T305 | S42 | E1 | 118 | ○ | — | 32 | 20 | — | 30.0 | 557 | 694 | 0.12 |
| T306 | S43 | E1 | 116 | ○ | — | 28 | 18 | — | 31.0 | 567 | 706 | 0.08 |
| T307 | S44 | E1 | 123 | ○ | — | 22 | 14 | ○ | 33.6 | 565 | 710 | — |
| T308 | S45 | F3 | 123 | ○ | — | 34 | 22 | ○ | 28.3 | 571 | 704 | 0.10 |

TABLE 43

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T501 | S101 | EH1 | 21.8 | 8.4 | 0 | 0 | 91.6 | 100 | 8.4 | 39.2 | 132 | 0 | X | 0.08 | 0.11 |
| T502 | S101 | E1 | 24.7 | 2.0 | 0 | 0 | 98.0 | 100 | 2.0 | 33.2 | 42 | 0 | Δ | 0.18 | 0.12 |
| T503 | S101 | FH1 | 22.5 | 8.0 | 0 | 0 | 92.0 | 100 | 8.0 | 39.5 | 126 | 0 | X | 0.10 | 0.11 |
| T504 | S101 | F1 | 25.0 | 1.8 | 0 | 0 | 98.2 | 100 | 1.8 | 33.0 | 38 | 0 | Δ | 0.18 | 0.12 |
| T505 | S102 | E1 | 25.3 | 2.3 | 0 | 0 | 97.7 | 100 | 2.3 | 34.4 | 54 | 0 | Δ | 0.21 | 0.16 |
| T506 | S103 | E1 (*1) | 35.4 | 7.6 | 0 | 0 | 92.4 | 100 | 7.6 | 51.9 | 140 | 0 | ○ | 0.13 | 0.14 |
| T507 | S104 | E1 (*1) | 32.5 | 0.04 | 0 | 0 | 100 | 100 | 0.04 | 33.6 | 0 | 0 | Δ | 0.15 | 0.16 |
| T508 | S105 | E1, E3 | 23.2 | 0.2 | 0 | 0 | 99.8 | 100 | 0.2 | 25.9 | 22 | 0 | X | 0.12 | 0.12 |
| T509 | S106 | EH1 | 42.8 | 0 | 0 | 0 | 100 | 100 | 0 | 42.8 | 0 | 0 | X | 0.00 | 0.00 |
| T510 | S106 | E1 | 50.1 | 0 | 0 | 0 | 100 | 100 | 0 | 50.1 | 0 | 0 | ○ | 0.00 | 0.00 |
| T511 | S107 | EH1 | 14.5 | 5.2 | 0 | 0 | 94.8 | 100 | 5.2 | 28.2 | 122 | 0 | X | 0.11 | 0.14 |

TABLE 43-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T512 | S107 | E1 | 17.2 | 1.8 | 0 | 0 | 98.2 | 100 | 1.8 | 25.2 | 52 | 0 | X | 0.17 | 0.14 |
| T513 | S108 | EH1 | 12.6 | 12.5 | 0 | 0 | 87.5 | 100 | 12.5 | 33.8 | 150 or more | 0 | X | 0.07 | 0.14 |
| T514 | S108 | E1 | 15.4 | 5.2 | 0 | 0 | 94.8 | 100 | 5.2 | 29.1 | 150 or more | 0 | X | 0.16 | 0.15 |
| T515 | S109 | E1, E3 | 51.4 | 0.4 | 0 | 0 | 99.6 | 100 | 0.4 | 55.2 | 34 | 0 | ○ | 0.30 | 0.25 |
| T516 | S110 | EH1 | 22.9 | 7.2 | 0 | 0 | 92.8 | 100 | 7.2 | 39.0 | 120 | 0 | X | 0.14 | 0.15 |
| T517 | S110 | E1 | 30.0 | 1.5 | 0 | 0 | 98.5 | 100 | 1.5 | 37.3 | 44 | 0 | Δ | 0.27 | 0.16 |
| T518 | S111 | EH1 | 24.5 | 6.4 | 0 | 0 | 93.6 | 100 | 6.4 | 39.7 | 104 | 0 | X | 0.22 | 0.11 |
| T519 | S111 | E1 | 32.4 | 2.0 | 0 | 0 | 98.0 | 100 | 2.0 | 40.9 | 46 | 0 | ○ | 0.37 | 0.11 |
| T520 | S111 | FH1 | 25.5 | 6.5 | 0 | 0 | 93.5 | 100 | 6.5 | 40.8 | 116 | 0 | X | 0.22 | 0.11 |
| T521 | S111 | F1 | 32.5 | 1.8 | 0 | 0 | 98.2 | 100 | 1.8 | 40.5 | 40 | 0 | ○ | 0.37 | 0.11 |
| T522 | S112 | F3 | 32.0 | 2.2 | 0 | 0 | 97.8 | 100 | 2.2 | 40.9 | 46 | 0 | ○ | 0.35 | 0.13 |
| T523 | S113 | E1 | 36.5 | 0.3 | 0 | 0 | 99.7 | 100 | 0.3 | 39.8 | 26 | 0 | ○ | 0.22 | 0.06 |

TABLE 44

| Test No. | Alloy No. | Step No. | Cutting Resistance (N) | Chip Shape | Hot Workability | Corrosion Test 1 (μM) | Corrosion Test 2 (μM) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T501 | S101 | EH1 | 106 | ○ | ○ | 136 | 100 | Δ | 13.1 | 493 | 583 | 0.93 |
| T502 | S101 | E1 | 122 | ○ | — | 96 | 60 | ○ | 35.1 | 518 | 666 | 0.29 |
| T503 | S101 | FH1 | 107 | ○ | ○ | 136 | 108 | Δ | 14.2 | 503 | 597 | — |
| T504 | S101 | F1 | 124 | ○ | — | 90 | 50 | ○ | 35.0 | 520 | 668 | 0.27 |
| T505 | S102 | E1 | 122 | ○ | — | 102 | 68 | ○ | 33.3 | 522 | 666 | 0.32 |
| T506 | S103 | E1 (*1) | 104 | ○ | ○ | 144 | 92 | Δ | 7.7 | 578 | 647 | 0.90 |
| T507 | S104 | E1 (*1) | 131 | Δ | ▲ | 48 | 30 | | 36.8 | 525 | 677 | 0.10 |
| T508 | S105 | E1, E3 | 139 | Δ | ▲ | 60 | 42 | ○ | 52.2 | 524 | 705 | 0.15 |
| T509 | S106 | EH1 | 125 | Δ | ○ | 98 | 58 | | 23.8 | 588 | 710 | 0.12 |
| T510 | S106 | E1 | 125 | ○ | — | 96 | 64 | Δ | 20.7 | 600 | 714 | 0.13 |
| T511 | S107 | EH1 | 124 | ○ | ▲ | 114 | 92 | ○ | 11.4 | 490 | 574 | 0.42 |
| T512 | S107 | E1 | 131 | Δ | — | 90 | 58 | ○ | 52.0 | 502 | 682 | 0.20 |
| T513 | S108 | EH1 | 108 | ○ | ○ | 154 | 116 | Δ | 7.3 | 486 | 554 | 0.42 |
| T514 | S108 | E1 | 116 | ○ | — | 132 | 104 | Δ | 10.2 | 496 | 576 | 0.20 |
| T515 | S109 | E1, E3 | 120 | Δ | — | 56 | 38 | ○ | 13.5 | 550 | 642 | 0.14 |
| T516 | S110 | EH1 | 107 | ○ | ○ | 140 | 102 | Δ | 15.5 | 498 | 596 | 0.60 |
| T517 | S110 | E1 | 118 | ○ | — | 90 | 54 | ○ | 28.6 | 538 | 672 | 0.27 |
| T518 | S111 | EH1 | 106 | ○ | ○ | 144 | 104 | Δ | 13.6 | 508 | 600 | 0.62 |
| T519 | S111 | E1 | 112 | ○ | — | 92 | 54 | ○ | 25.8 | 538 | 665 | 0.33 |
| T520 | S111 | FH1 | 106 | ○ | ○ | 130 | 90 | | 14.6 | 524 | 620 | — |
| T521 | S111 | F1 | 112 | ○ | — | 84 | 50 | | 26.0 | 548 | 675 | — |
| T522 | S112 | F3 | 112 | ○ | — | 90 | 54 | ○ | 24.0 | 540 | 662 | 0.30 |
| T523 | S113 | E1 | 121 | ○ | — | 82 | 60 | ○ | 30.4 | 556 | 694 | 0.14 |

TABLE 45

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T524 | S114 | E1, E3 | 33.1 | 0.1 | 0 | 0 | 99.9 | 100 | 0.1 | 35.0 | 20 | 0 | Δ | 0.05 | 0.16 |
| T525 | S115 | E1, E3 | 52.6 | 0.007 | 0 | 0 | 100 | 100 | 0.007 | 53.1 | 0 | 0 | ○ | 0.05 | 0.04 |
| T526 | S116 | F3 | 27.4 | 0.2 | 0 | 0 | 99.8 | 100 | 0.2 | 30.1 | 22 | 0 | X | 0.03 | 0.01 |
| T527 | S117 | E1 | 33.8 | 0.2 | 0 | 0 | 99.8 | 100 | 0.2 | 36.5 | 26 | 0 | Δ | 0.04 | 0.00 |
| T528 | S118 | E1 (*1) | 11.4 | 7.2 | 0 | 0 | 92.8 | 100 | 7.2 | 27.5 | 150 or more | 0 | X | 0.10 | 0.11 |
| T529 | S119 | E1 (*1) | 11.8 | 8.5 | 0 | 0 | 91.5 | 100 | 8.5 | 29.3 | 150 or more | 0 | X | 0.16 | 0.13 |
| T530 | S120 | EH1, E2 | 0.0 | 20.3 | 5 | 0 | 74.7 | 95 | 20.3 | 27.0 | 150 or more | 0 | X | 0.00 | 0.14 |

TABLE 45-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T531 | S120 | E1, E3 | 13.0 | 10.0 | 0 | 0 | 90.0 | 100 | 10.0 | 32.0 | 150 or more | 0 | X | 0.11 | 0.14 |
| T532 | S121 | F3 | 66.2 | 0.1 | 0 | 0 | 99.9 | 100 | 0.1 | 68.1 | 14 | 0 | ○ | 0.19 | 0.13 |
| T533 | S122 | EH1, E2 | 58.8 | 1.0 | 0 | 0 | 99.0 | 100 | 1.0 | 64.8 | 24 | 0 | X | 0.25 | 0.13 |
| T534 | S122 | E1, E3 | 69.8 | 0.01 | 0 | 0 | 100 | 100 | 0.01 | 70.4 | 0 | 0 | ○ | 0.26 | 0.12 |
| T535 | S122 | FH1 | 60.0 | 0.8 | 0 | 0 | 99.2 | 100 | 0.8 | 65.4 | 26 | 0 | X | 0.25 | 0.13 |
| T536 | S122 | F1 | 69.6 | 0.01 | 0 | 0 | 100 | 100 | 0.01 | 70.2 | 0 | 0 | ○ | 0.26 | 0.12 |
| T537 | S123 | EH1 | 22.1 | 3.3 | 0 | 0 | 96.7 | 100 | 3.3 | 33.0 | 86 | 0 | X | 0.16 | 0.09 |
| T538 | S123 | E1, E3 | 24.8 | 0.1 | 0 | 0 | 99.9 | 100 | 0.1 | 26.7 | 34 | 0 | X | 0.23 | 0.09 |
| T539 | S123 | FH1 | 22.8 | 2.8 | 0 | 0 | 97.2 | 100 | 2.8 | 32.8 | 70 | 0 | X | 0.16 | 0.09 |
| T540 | S123 | F1 | 25.8 | 0.1 | 0 | 0 | 99.9 | 100 | 0.1 | 27.7 | 34 | 0 | Δ | 0.23 | 0.09 |
| T541 | S124 | E1, E3 | 30.4 | 0.06 | 0 | 0 | 99.9 | 100 | 0.06 | 31.8 | 36 | 0 | Δ | 0.16 | 0.06 |
| T542 | S125 | EH1 | 20.4 | 4.4 | 0 | 0 | 95.6 | 100 | 4.4 | 33.0 | 92 | 0 | X | 0.07 | 0.07 |
| T543 | S125 | E1 | 25.6 | 1.1 | 0 | 0 | 98.9 | 100 | 1.1 | 31.9 | 44 | 0 | X | 0.08 | 0.07 |
| T544 | S125 | F1 | 25.4 | 1.1 | 0 | 0 | 98.9 | 100 | 1.1 | 31.7 | 44 | 0 | X | 0.08 | 0.07 |
| T545 | S126 | FH1 | 23.5 | 6.8 | 0 | 0 | 93.2 | 100 | 6.8 | 39.1 | 150 or more | 0 | X | 0.16 | 0.11 |
| T546 | S126 | F1 | 31.7 | 1.7 | 0 | 0 | 98.3 | 100 | 1.7 | 39.5 | 38 | 0 | ○ | 0.29 | 0.11 |
| T547 | S127 | E1 | 46.2 | 1.3 | 0 | 0 | 98.7 | 100 | 1.3 | 53.0 | 36 | 0 | ○ | 0.26 | 0.10 |

TABLE 46

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T524 | S114 | E1, E3 | 128 | ○ | — | 72 | 42 | ○ | 34.6 | 542 | 689 | 0.12 |
| T525 | S115 | E1, E3 | 125 | ○ | — | 82 | 52 | ○ | 20.9 | 591 | 706 | — |
| T526 | S116 | F3 | 135 | Δ | — | 92 | 66 | Δ | 46.2 | 528 | 698 | 0.12 |
| T527 | S117 | E1 | 130 | ○ | — | 90 | 60 | Δ | 34.2 | 536 | 682 | 0.12 |
| T528 | S118 | E1 (*1) | 119 | ○ | Δ | 144 | 120 | Δ | 9.6 | 476 | 553 | 0.92 |
| T529 | S119 | E1 (*1) | 115 | ○ | Δ | 164 | 106 | Δ | 6.8 | 474 | 539 | 0.78 |
| T530 | S120 | EH1, E2 | 122 | ○ | Δ | 190 | 150 | X | 3.2 | 468 | 513 | 2.20 |
| T531 | S120 | E1, E3 | 109 | ○ | — | 160 | 128 | Δ | 5.2 | 495 | 552 | 0.65 |
| T532 | S121 | F3 | 128 | ○ | — | 30 | 12 | ○ | 13.8 | 605 | 698 | 0.13 |
| T533 | S122 | EH1, E2 | 117 | ○ | ○ | 44 | 22 | | 14.2 | 602 | 697 | — |
| T534 | S122 | E1, E3 | 132 | Δ | — | 24 | 12 | | 12.9 | 618 | 708 | |
| T535 | S122 | FH1 | 118 | ○ | ○ | 40 | 20 | ○ | 14.4 | 610 | 705 | 0.14 |
| T536 | S122 | F1 | 132 | Δ | — | 24 | 14 | ○ | 12.5 | 628 | 716 | 0.10 |
| T537 | S123 | EH1 | 124 | Δ | ▲ | 118 | 78 | | 37.9 | 518 | 672 | — |
| T538 | S123 | E1, E3 | 133 | Δ | — | 52 | 40 | | 51.5 | 520 | 699 | 0.07 |
| T539 | S123 | FH1 | 125 | Δ | — | 120 | 80 | ○ | 38.0 | 523 | 677 | 0.44 |
| T540 | S123 | F1 | 133 | Δ | — | 54 | 34 | ○ | 48.2 | 530 | 704 | 0.07 |
| T541 | S124 | E1, E3 | 134 | X | — | 102 | 68 | ○ | 17.8 | 522 | 627 | 0.07 |
| T542 | S125 | EH1 | 130 | ○ | ○ | 158 | 122 | ○ | 13.5 | 468 | 560 | 0.54 |
| T543 | S125 | E1 | 136 | Δ | — | 106 | 72 | | 18.6 | 525 | 633 | |
| T544 | S125 | F1 | 135 | Δ | — | 100 | 70 | ○ | 18.3 | 522 | 629 | 0.21 |
| T545 | S126 | FH1 | 109 | ○ | ○ | 130 | 100 | Δ | 16.1 | 504 | 604 | 0.77 |
| T546 | S126 | F1 | 113 | ○ | — | 78 | 52 | ○ | 35.0 | 520 | 668 | 0.26 |
| T547 | S127 | E1 | 112 | ○ | — | 72 | 42 | — | 15.6 | 558 | 657 | 0.30 |

TABLE 47

| Test No. | Alloy No. | Step No. | Wear Resistance | |
|---|---|---|---|---|
| | | | Amsler Abrasion Test | Ball-On-Disk Abrasion Test |
| T201 | S11 | EH1, E2 | ○ | ○ |
| T202 | S11 | E1, E3 | ◎ | ○ |
| T208 | S13 | EH1, E2 | ○ | ○ |
| T209 | S13 | E1, E3 | ◎ | ○ |
| T214 | S14 | EH1 | ○ | ○ |
| T215 | S14 | E1 | ◎ | ◎ |
| T224 | S18 | EH1, E2 | ○ | ○ |
| T225 | S18 | E1, E3 | ◎ | ◎ |
| T254 | S32 | EH1, E2 | ○ | ○ |
| T255 | S32 | E1, E3 | ○ | ◎ |
| T508 | S105 | E1, E3 | Δ | Δ |
| T515 | S109 | E1, E3 | ○ | Δ |
| T524 | S114 | E1, E3 | ○ | Δ |
| T525 | S115 | E1, E3 | ○ | Δ |
| T530 | S120 | EH1, E2 | ○ | Δ |
| T531 | S120 | E1, E3 | ◎ | Δ |
| T533 | S122 | EH1, E2 | ○ | ○ |
| T534 | S122 | E1, E3 | ◎ | Δ |
| T538 | S123 | E1, E3 | ○ | Δ |
| T541 | S124 | E1, E3 | Δ | Δ |

The above-described experiment results are summarized as follows.

1) It was able to be verified that, by satisfying the composition according to the embodiment, the composition relational expressions f1 and f2, the requirements of the metallographic structure, and the metallographic structure relational expressions f3, f4, f5, and f6, excellent machinability can be obtained with addition of a small amount of Pb, and a hot extruded material or a hot forged material having excellent hot workability and excellent corrosion resistance in a harsh environment and having high strength and excellent impact resistance, wear resistance, and high temperature properties can be obtained (for example, Alloys No. S01, S02, and 13 and Steps No. A1, C1, D1, E1, F1, and F3).

2) It was able to be verified that addition of Sb and As further improves corrosion resistance under harsh conditions (Alloys No. S41 to S45).

3) It was able to be verified that the cutting resistance further lowers by addition of Bi (Alloy No. S43).

4) It was able to be verified that corrosion resistance, machinability, and strength are improved when 0.08 mass % or higher of Sn and 0.07 mass % or higher of P are contained in κ phase (for example, Alloys No. S01, S02, and S13).

5) It was able to be verified that, due to the presence of elongated acicular κ phase, that is, κ1 phase in α phase, strength increases, the strength index increases, excellent machinability is maintained, and corrosion resistance is improved (for example, Alloys No. S01, S02, and 13).

6) When the Cu content was low, the amount of γ phase increased, and machinability was excellent. However, corrosion resistance, impact resistance, and high temperature properties deteriorated. Conversely, when the Cu content was high, machinability deteriorated. In addition, impact resistance also deteriorated (for example, Alloys No. 5119, 5120, and S122).

7) When the Sn content was higher than 0.28 mass %, the area ratio of γ phase was higher than 1.5%. Therefore, machinability was excellent, but corrosion resistance, impact resistance, and high temperature properties deteriorated (Alloy No. S111). On the other hand, when the Sn content was lower than 0.07 mass %, the dezincification corrosion depth in a harsh environment was large (Alloys No. 5114 to S117). When the Sn content was 0.1 mass % or higher, the properties were further improved (Alloys No. S26, S27, and S28).

8) When the P content was high, impact resistance deteriorated. In addition, cutting resistance was slightly high. On the other hand, when the P content was low, the dezincification corrosion depth in a harsh environment was large (Alloys No. S109, S113, and S115).

9) It was able to be verified that, even if inevitable impurities are contained to the extent contained in alloys manufactured in the actual production, there is not much influence on the properties (Alloys No. S01, S02, and S03). It is presumed that, when Fe is added such that the content thereof was outside of the composition range according to the embodiment, or is the composition of the boundary value but higher than the limit of the inevitable impurities, an intermetallic compound of Fe and Si or an intermetallic compound of Fe and P is formed. As a result, the Si concentration and the P concentration became lower than the level required to be effective, and corrosion resistance deteriorated, and machinability slightly deteriorated due to the formation of the intermetallic compound (Alloys No. S124 and S125).

10) When the value of the composition relational expression f1 was low, even when the contents of Cu, Si, Sn, and P were in the composition ranges, the dezincification corrosion depth in a harsh environment was large (Alloys No. S110, S101, and S126).

11) When the value of the composition relational expression f1 was low, the amount of γ phase increased, and machinability was excellent. However, corrosion resistance, impact resistance, and high temperature properties deteriorated. When the value of the composition relational expression f1 was high, the amount of κ phase increased, and machinability, hot workability, and impact resistance deteriorated (Alloys No. S109, S104, S125, and S121).

12) When the value of the composition relational expression f2 was low, machinability was excellent. However, hot workability, corrosion resistance, impact resistance, and high temperature properties deteriorated. When the value of the composition relational expression f2 was high, hot workability deteriorated, and there was a problem in hot extrusion. In addition, machinability deteriorated (Alloys No. S104, S105, S103, S118, S119, S120, and S123).

13) When the proportion of γ phase in the metallographic structure was higher than 1.5%, or the length of the long side of γ phase was longer than 40 μm, machinability was excellent, but corrosion resistance, impact resistance, and high temperature properties deteriorated. In particular, when the proportion of γ phase was high, the selective corrosion of γ phase in the dezincification corrosion test in a harsh environment occurred (Alloys No. S101, S110, and S126). When the proportion of γ phase was 0.8% or lower and the length of the long side of γ phase was 30 μm or less, corrosion resistance, impact resistance, and high temperature properties were excellent (Alloys No. S01 and S11).

When the area ratio of μ phase was higher than 2%, the length of the long side of μ phase was longer than 25 μm, corrosion resistance, impact resistance, and high temperature properties deteriorated. In the dezincification corrosion test in a harsh environment, grain boundary corrosion or selective corrosion of μ phase occurred (Alloy No. S01 and Steps No. AH4, BH3, and DH2). When the proportion of μ phase was 1% or lower and the length of the long side of γ phase was 15 μm or less, corrosion resistance, impact resistance, and high temperature properties were excellent (Alloys No. S01 and S11).

When the area ratio of κ phase was higher than 65%, machinability and impact resistance deteriorated. On the other hand, when the area ratio of κ phase was lower than 25%, machinability deteriorated (Alloys No. S122 and S105).

14) When the value of the metallographic structure relational expression f5=(γ)+(μ) was higher than 2.5%, or the value of f3=(α)+(κ) was lower than 97%, corrosion resistance, impact resistance, and high temperature properties deteriorated. When the metallographic structure relational expression f5 was 1.5% or lower, corrosion resistance, impact resistance, and high temperature properties were improved (Alloys No. S1, Steps No. AH2 and A1, and Alloys No. S103 and S23).

When the value of the metallographic structure relational expression $f6=(\kappa)+6\times(\gamma)^{1/2}+0.5\times(\mu)$ was higher than 70 or was lower than 27, machinability deteriorated (Alloys No. S105 and 122 and Steps No. E1 and F1). When the value of f6 was 32 to 62, machinability was further improved (Alloys No. S01 and S11).

When the area ratio of γ phase was higher than 1.5%, cutting resistance was low and the shapes of many chips were also excellent irrespective of the value of the metallographic structure relational expression f6 (for example, Alloys No. S103 and S112).

15) When the amount of Sn in κ phase was lower than 0.08 mass %, the dezincification corrosion depth in a harsh environment was large, and the corrosion of κ phase occurred. In addition, cutting resistance was slightly high, and chip partibility was poor in some cases (Alloys No. S114 to S117). When the amount of Sn in κ phase was higher than 0.11 mass %, corrosion resistance and machinability were excellent (Alloys No. S26, S27, and S28).

16) When the amount of P in κ phase was lower than 0.07 mass %, the dezincification corrosion depth in a harsh environment was large, and the corrosion of κ phase occurred. (Alloys No. S113, S115, and S116)

17) When the area ratio of γ phase was 1.5% or lower, the Sn concentration and the P concentration in κ phase were higher than the amount of Sn and the amount of P in the alloy. As the area ratio of γ phase decreased, the Sn concentration and the P concentration in κ phase became increasingly higher compared with the amount of Sn and the amount of P in the alloy. Conversely, when the area ratio of γ phase was high, the Sn concentration in κ phase was lower than the amount of Sn in the alloy. In particular, when the area ratio of γ phase was about 10%, the Sn concentration in κ phase was about half of the amount of Sn in the alloy (Alloys No. S01, S02, S03, S14, S101, and S108). In addition, for example, in Alloy No. S20, when the area ratio of γ phase decreased from 5.9% to 0.5%, the Sn concentration in α phase increased from 0.13 mass % to 0.18 mass % by 0.05 mass %, and the Sn concentration in κ phase increased from 0.22 mass % to 0.31 mass % by 0.09 mass %. This way, the increase in the Sn concentration in κ phase was more than the increase in the Sn concentration in α phase. Due to an increase in the amount of γ phase, an increase in the amount of Sn distributed in κ phase, and the presence of a large amount of acicular κ phase in α phase, the cutting resistance increased by 7 N, but excellent machinability was maintained, the dezincification corrosion depth decreased to about ¼ due to the strengthening of corrosion resistance of κ phase, the impact value decreased to about ½, the high temperature creep decreased to ⅓, the tensile strength was improved by 43 N/mm$^2$, and the strength index increased by 77.

18) When the requirements of the composition and the requirements of the metallographic structure were satisfied, the tensile strength was 530 N/mm$^2$ or higher, and the creep strain after holding the material at 50° C. for 100 hours in a state where a load corresponding to 0.2% proof stress at room temperature was applied was 0.3% or lower (for example, Alloys No. S103 and S112).

19) When all the requirements of the composition and metallographic structure were satisfied, the Charpy impact test value of the U-notched specimen was 14 J/cm$^2$ or higher. In the hot extruded material or the forged material on which cold working was not performed, the Charpy impact test value of the U-notched specimen was 17 J/cm$^2$ or higher. In addition, the strength index was also higher than 670 (for example, Alloys No. S01, S02, S13, and S14).

When the amount of Si was about 2.95%, acicular κ phase started to be present in α phase, and when the amount of Si was about 3.1%, acicular κ phase significantly increased. The relational expression f2 affected the amount of acicular κ phase (for example, Alloys No. S31, S32, S101, S107, and S108).

As the amount of acicular κ phase increased, machinability, tensile strength, and high temperature properties were improved. It is presumed that increase in acicular κ phase leads to strengthening of α phase and improvement of chip partibility (for example, Alloys No. S02, S13, S23, S31, S32, S101, S107, and S108).

In the test method according to ISO 6509, an alloy including about 3% or higher of β phase, an alloy including about 5% or higher of γ phase, or an alloy not including P or including 0.01% of P were evaluated as fail (evaluation: Δ, X). However, an alloy including 3% to 5% of γ phase and about 3% of μ phase was evaluated as pass (evaluation: O). This shows that the corrosion environment adopted in the embodiment simulated a harsh environment (Alloys No. S14, S106, S107, S112, and S120).

Regarding wear resistance, an alloy including a large amount of acicular κ phase, about 0.10% to 0.25% of Sn, and about 0.1% to about 1.0% of γ phase was excellent irrespective of whether or not the alloy was lubricated (for example Alloys No. S14 and S18).

20) In the evaluation of the materials prepared using the mass-production facility and the materials prepared in the laboratory, substantially the same results were obtained (Alloys No. S01 and S02 and Steps No. C1, C2, E1, and F1).

21) Regarding Manufacturing Conditions:

When the hot extruded material, the extruded and drawn material, or the hot forged product was held in a temperature range of 510° C. to 575° C. for 20 minutes or more, or was cooled in a temperature range of 510° C. to 575° C. at an average cooling rate of 2.5° C./min or lower and then was cooled in a temperature range from 480° C. to 370° C. at an average cooling rate of 2.5° C./min or higher in the continuous furnace, the amount of γ phase significantly decreased, a material which scarcely has μ phase and has excellent corrosion resistance, high temperature properties, impact resistance, and mechanical strength was obtained.

When the heat treatment temperature was low in the step of performing the heat treatment on the hot worked material or the cold worked material, a decrease in the amount of γ phase was small, and corrosion resistance, impact resistance, and high temperature properties were poor. When the heat treatment temperature was high, crystal grains of α phase were coarsened, and the decrease in the amount of γ phase was small. Therefore, corrosion resistance and impact resistance were poor, machinability was also poor, and tensile strength was also low (Alloys No. S01, S02, and S03 and Steps No. A1, AH5, and AH6). In addition, when the heat treatment temperature was 520° C. and the holding time was short, a decrease in the amount of γ phase was small. When the expression (T−500)×t (wherein if T was 540° C. or higher, T was set as 540) representing the relation between the heat treatment time (t) and the heat treatment temperature (T) was 800 or higher, a decrease in the amount of γ phase was larger (Steps No. A5, A6, D1, D4, F1).

When the average cooling rate in a temperature range from 470° C. to 380° C. in the process of cooling after the heat treatment was low, μ phase was present, corrosion resistance, impact resistance, and high temperature properties were poor, and tensile strength was also low (Alloys No. S01, S02, and S03 and Steps No. A1 to A4, AH8, DH2, and DH3).

When the temperature of the hot extruded material was low, the proportion of γ phase after the heat treatment was low, and corrosion resistance, impact resistance, tensile strength, and high temperature properties were excellent. (Alloys No. S01, S02, and S03 and Steps No. A1 and A9)

As the heat treatment method, by increasing the temperature to a temperature range of 575° C. to 620° C. once and adjusting the average cooling rate in a temperature range from 575° C. to 510° C. in the process of cooling, excellent corrosion resistance, impact resistance, and high temperature properties were obtained. It was able to be verified that, with the continuous heat treatment method, the properties also improved (Alloys No. S01, S02, and S03 and Steps No. A1, A7, A8, and D5).

In the heat treatment, when the temperature is increased up to 635° C., the length of the long side of γ phase increased, corrosion resistance was poor, and strength was low. Even when the material was heated and held at 500° C. for a long period of time, the decrease in the amount of γ phase was small (Alloys No. S01, S02, and S03 and Steps No. AH5 and AH6).

By controlling the average cooling rate in a temperature range from 575° C. to 510° C. to be 1.5° C./min in the process of cooling after hot forging, a forged product in which the proportion of γ phase after hot forging was low was obtained (Alloys No. S01, S02, and S03 and Step No. D6).

Even when the continuously cast rod was used as a material for hot forging, as in the case of the extruded material, excellent properties were obtained (Alloys No. S01, S02, and S03 and Steps No. F3 and F4).

Due to the appropriate heat treatment and the appropriate cooling conditions after hot forging, the amount of Sn and the amount of P in κ phase increased (Alloys No. S01, S02, and S03 and Steps No. A1, AH1, C0, C1, and D6).

The extruded material on which cold-worked was performed at a working ratio of about 5% or about 9% and then a predetermined heat treatment was performed, exhibited improved corrosion resistance, impact resistance, high temperature properties, and tensile strength compared to the hot extruded material. In particular, the tensile strength improved by about 70 N/mm$^2$ or about 90 N/mm$^2$, and the strength index also improved by about 90 (Alloys No. S01, S02, and S03 and Steps No. AH1, A1, and A12). By performing the heat treatment (annealing) on the cold worked material at a high temperature of 540° C., excellent machinability was maintained, and alloy having excellent corrosion resistance, high strength, excellent high temperature properties, and impact resistance was obtained.

When cold working was performed on the heat treated material at a cold working ratio of 5%, as compared to the extruded material, the tensile strength was improved by about 90 N/mm$^2$, the impact value was equivalent or higher, and corrosion resistance and high temperature properties were improved. When the cold working ratio was about 9%, the tensile strength was improved by about 140 N/mm$^2$, but the impact value was slightly low (Alloys No. S01, S02, and S03 and Steps No. AH1, A10, and A11).

It was verified that when a predetermined heat treatment was performed on the hot worked material, the amount of Sn in κ phase increased, and the amount of γ phase significantly decreased; however, excellent machinability was able to be secured (Alloys No. S01 and S02 and Steps No. AH1, A1, D7, C0, C1, EH1, E1, FH1, and F1).

When an appropriate heat treatment was performed, acicular κ phase was present in α phase (Alloys No. S01, S02, and S03 and Steps No. AH1, A1, D7, C0, C1, EH1, E1, FH1, and F1). It is presumed that, due to the presence of acicular κ phase in α phase, tensile strength and wear resistance were improved, machinability was excellent, and a significant decrease in the amount of γ phase was compensated for.

It was able to be verified that, when low-temperature annealing is performed after cold working or hot working, in the case where a heat treatment is performed by heating the material to 240° C. to 350° C. for 10 minutes to 300 minutes and satisfying $150 \leq (T-220) \times (t)^{1/2} \leq 1200$ (wherein the heating temperature is represented by T° C. and the heating time is represented by t min), a cold worked material or a hot worked material having excellent corrosion resistance in a harsh environment and having excellent impact resistance and high temperature properties can be obtained (Alloy No. S01 and Steps No. B1 to B3).

Regarding the samples obtained by performing Step No. AH9 on Alloys No. S01 to S03, extrusion was not able to be finished due to their high deformation resistance. Therefore, the subsequent evaluation was stopped.

In Step No. BH1, straightness was not corrected sufficiently, and low-temperature annealing was not performed appropriately, and there was a problem in quality.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging and the conditions in the heat treatment so that they fall in the appropriate ranges.

Example 2

Regarding an alloy according to Comparative Example of the embodiment, a Cu—Zn—Si copper alloy casting (Test No. T601/Alloy No. 5201) which had been used in a harsh water environment for 8 years was prepared. There was no detailed data on the water quality of the environment where the casting had been used and the like. Using the same method as in Example 1, the composition and the metallographic structure of Test No. T601 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T601 (Test No. T602/Alloy No. S202). Regarding the similar alloy casting (Test No. T602), the analysis of the composition and the metallographic structure, the evaluation (measurement) of the mechanical properties and the like, and the dezincification corrosion tests 1 to 3 were performed as described in Example 1. By comparing the corrosion of Test No. T601 which developed in actual water environment and that of Test No. T602 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T28/Alloy No. S01/Step No. C2) and the corroded state of Test No. T601 or the evaluation result (corroded state) of the dezincification corrosion test 1 of Test No. T602 to each other, the corrosion resistance of Test No. T28 was examined.

Test No. T602 was prepared using the following method.

Raw materials were dissolved to obtain substantially the same composition as that of Test No. T601 (Alloy No. S201), and the melt was cast into a mold having an inner diameter ϕ of 40 mm at a casting temperature of 1000° C. to prepare a casting. Next, the casting was cooled in the temperature range of 575° C. to 510° C. at an average cooling rate of about 20° C./min, and subsequently was cooled in the temperature range from 470° C. to 380° C. at an average cooling rate of about 15° C./min. As a result, a sample of Test No. T602 was prepared.

The analysis method of the composition and the metallographic structure, the measurement method of the mechanical properties and the like, and the methods of the dezincification corrosion tests 1 to 3 were as described in Example 1.

Figure 4A:
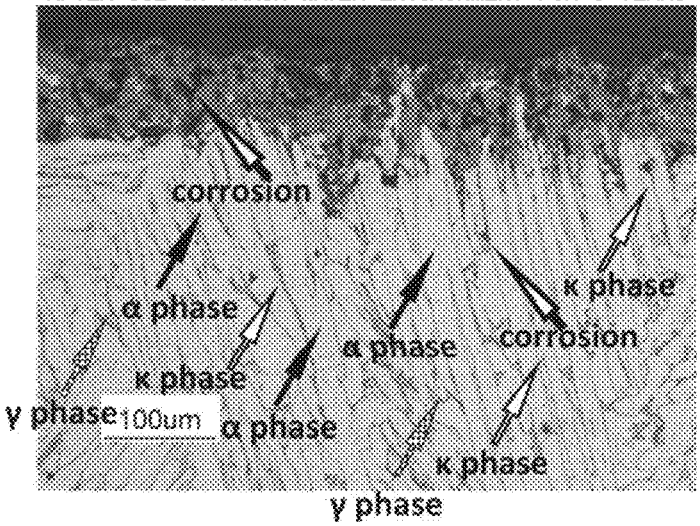
FIG. 4A is a metallographic micrograph of a cross-section of the alloy of Test No. T601 according to Example 2 after use in a harsh water environment for 8 years.
Figure 4B:
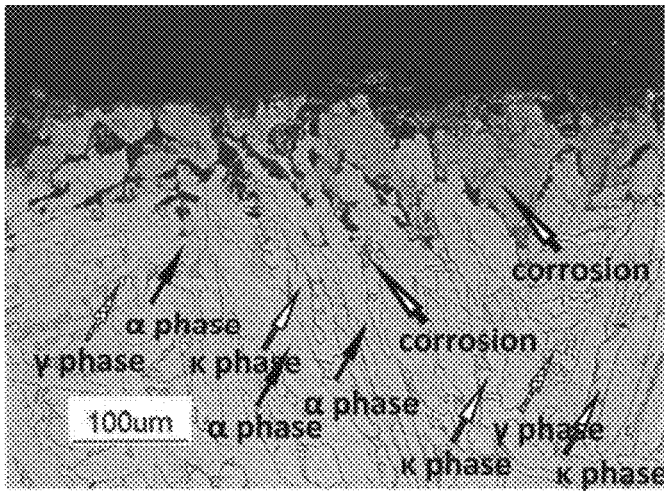
FIG. 4B is a metallographic micrograph of a cross-section of the alloy of Test No. T602 after dezincification corrosion test 1.
Figure 4C:
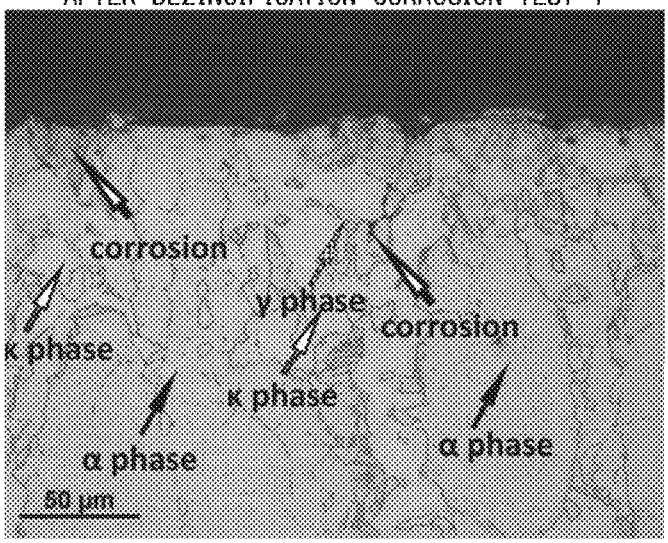
FIG. 4C is a metallographic micrograph of a cross-section of the alloy of Test No. T28 after dezincification corrosion test 1.

The obtained results are shown in Tables 48 to 50 and FIGS. 4A to 4C.

TABLE 48

| Alloy | Component Composition (mass %) | | | | | | | Composition Relational Expression | |
|---|---|---|---|---|---|---|---|---|---|
| No. | Cu | Si | Pb | Sn | P | Others | Zn | f1 | f2 |
| S201 | 75.4 | 3.01 | 0.037 | 0.01 | 0.04 | Fe: 0.02, Ni: 0.01, Ag: 0.02 | Balance | 77.8 | 62.4 |
| S202 | 75.4 | 3.01 | 0.033 | 0.01 | 0.04 | Fe: 0.02, Ni: 0.02, Ag: 0.02 | Balance | 77.8 | 62.4 |

TABLE 49

| Test No. | Alloy No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|
| T601 | S201 | 27.4 | 3.9 | 0 | 0 | 96.1 | 100 | 3.9 | 39.2 | 110 | 0 | X | 0.01 | 0.06 |
| T602 | S202 | 28.0 | 3.8 | 0 | 0 | 96.2 | 100 | 3.8 | 39.7 | 120 | 0 | X | 0.01 | 0.06 |

TABLE 50

| Test No. | Alloy No. | Maximum Corrosion Depth (μm) | Dezincification Corrosion Test 1 (μm) | Dezincification Corrosion Test 2 (μm) | Dezincification Corrosion Test 3 (ISO 6509) |
|---|---|---|---|---|---|
| T601 | S201 | 138 | | | |
| T602 | S202 | | 146 | 102 | O |

In the copper alloy casting used in a harsh water environment for 8 years (Test No. T601), at least the contents of Sn and P were out of the ranges of the embodiment.

FIG. 4A shows a metallographic micrograph of the cross-section of Test No. T601.

Test No. T601 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, corrosion occurred only in γ phase from a boundary portion of α phase and κ phase to the inside (a depth of about 40 μm from the corroded boundary between α phase and κ phase towards the inside: local corrosion of only γ phase).

FIG. 4B shows a metallographic micrograph of a cross-section of Test No. T602 after the dezincification corrosion test 1.

The maximum corrosion depth was 146 μm

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was uneven without being uniform. Roughly, corrosion occurred only in γ phase from a boundary portion of α phase and κ phase to the inside (the length of corrosion that locally occurred only to γ phase from the corroded boundary between α phase and κ phase was about 45 μm).

It was found that the corrosion shown in FIG. 4A occurred in the harsh water environment for 8 years and the corrosion shown in FIG. 4B occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T601 was slightly less than the maximum corrosion depth of Test No. T602 in the dezincification corrosion test 1. However, the maximum corrosion depth of Test No. T601 was slightly more than the maximum corrosion depth of Test No. T602 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T602 in the dezincification corrosion test 3 (the dezincification corrosion test according to ISO6509) was "O" (good). Therefore, the result of the dezincification corrosion test 3 did not match the corrosion result in the actual water environment.

The test time of the dezincification corrosion test 1 was 2 months, and the dezincification corrosion test 1 was an about 75 to 100 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T601 in the harsh water environment for 8 years, or in the corrosion results of Test No. T602 in the dezincification corrosion tests 1 and 2, not only α phase and κ phase on the surface but also γ phase were corroded. However, in the corrosion result of the dezincification corrosion test 3 (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

FIG. 4C shows a metallographic micrograph of a cross-section of Test No. T28 (Alloy No. S01/Step No. C2) after the dezincification corrosion test 1.

In the vicinity of the surface, about 40% of γ phase and κ phase exposed to the surface were corroded. However, the remaining κ phase and α phase were solid (were not corroded). The maximum corrosion depth was about 25 μm. Further, about 20 μm-deep selective corrosion of γ phase or β phase occurred toward the inside. It is presumed that the length of the long side of γ phase or β phase is one of the large factors that determine the corrosion depth.

In can be seen that, in the Test No. T28 of the embodiment shown in FIG. 4C, the corrosion of α phase and κ phase in the vicinity of the surface was significantly suppressed as compared to Tests No. T601 and T602 shown in FIGS. 4A and 4B. It is presumed that the progress of the corrosion was delayed by the aforementioned suppression. From the observation result of the corrosion form, the main reason why the corrosion of α phase and κ phase in the vicinity of the surface was significantly suppressed is presumed to be improved κ phase' corrosion resistance by Sn that is contained in κ phase.

INDUSTRIAL APPLICABILITY

The free-cutting copper alloy according to the present invention has excellent hot workability (hot extrudability and hot forgeability) and excellent corrosion resistance and machinability. Therefore, the free-cutting copper alloy according to the present invention is suitable for devices such as faucets, valves, or fittings for drinking water consumed by a person or an animal every day, in members for electrical uses, automobiles, machines and industrial plumbing such as valves, or fittings, or in devices and components that come in contact with liquid.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable for solenoid valves, control valves, various valves, radiator components, oil cooler components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

The invention claimed is:

1. A method of manufacturing a free-cutting copper alloy worked material, the method comprising:

any one or both of a cold working step and a hot working step; and an annealing step that is performed after the cold working step or the hot working step, wherein in the annealing step, the material is held at a temperature of 510° C. to 575° C. for 20 minutes to 8 hours or is cooled in a temperature range from 575° C. to 510° C. at an average cooling rate of 0.1° C./min to 2.5° C./min, subsequently the material is cooled in a temperature range from 470° C. to 380° C. at an average cooling rate of higher than 2.5° C./min and lower than 500° C./min, the manufactured free-cutting copper alloy worked material comprises:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.25 mass % of Pb; and a balance including Zn and inevitable impurities, a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.2 \leq f1=[Cu]+0.8\times[Si]-8.5\times[Sn]+[P]+0.5\times[Pb] \leq 80.3$$

and $$61.5 \leq f2=[Cu]-4.3\times[Si]-0.7\times[Sn]-[P]+0.5\times[Pb] \leq 63.3$$

are satisfied, in constituent phases of metallographic structure of the manufactured free-cutting copper alloy worked material, when an area ratio of a phase is represented by (α)%, an area ratio of β phase is represented by (β)%, an area ratio of γ phase is represented by (γ)%, an area ratio of K phase is represented by (κ)%, and an area ratio of μ phase is represented by (μ)%, the relations of $$25 \leq (\kappa) \leq 65,$$

$$0 \leq (\gamma) \leq 1.5,$$

$$0 \leq (\beta) \leq 0.2,$$

$$0 \leq (\mu) \leq 2.0,$$

$$97.0 \leq f3=(\alpha)+(\kappa),$$

$$99.4 \leq f4=(\alpha)+(\kappa)+(\gamma)+(\mu),$$

$$0 \leq f5=(\gamma)+(\mu) \leq 2.5, \text{ and}$$

$$27 \leq f6=(\kappa)+6\times(\gamma)^{1/2}+0.5\times(\mu) \leq 70$$

are satisfied, the length of the long side of γ phase is 30 μm or less, the length of the long side of μ phase is 25 μm or less, and κ phase is present in α phase.

2. A method of manufacturing a free-cutting copper alloy worked material, the method comprising:

a hot working step, wherein the material's temperature during hot working is 600° C. to 740° C., the hot working is ether one of hot extrusion or hot forging, when hot extrusion is performed as the hot working, the material is cooled in a temperature range from 470° C. to 380° C. at an average cooling rate of higher than 2.5° C./min and lower than 500° C./min in the process of cooling, and when hot forging is performed as the hot working, the material is cooled in a temperature range from 575° C. to 510° C. at an average cooling rate of 0.1° C./min to 2.5° C./min and subsequently is cooled in a temperature range from 470° C. to 380° C. at an average cooling rate of higher than 2.5° C./min and lower than 500° C./min in the process of cooling, the manufactured free-cutting copper alloy worked material comprises:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.25 mass % of Pb; and a balance including Zn and inevitable impurities, a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.2 \leq f1=[Cu]+0.8\times[Si]-8.5\times[Sn]+[P]+0.5\times[Pb] \leq 80.3$$

and $$61.5 \leq f2=[Cu]-4.3\times[Si]-0.7\times[Sn]-[P]+0.5\times[Pb] \leq 63.3$$

are satisfied, in constituent phases of metallographic structure of the manufactured free-cutting copper alloy worked material, when an area ratio of a phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$25 \leq (\kappa) \leq 65,$$

$$0 \leq (\gamma) \leq 1.5,$$

$$0 \leq (\beta) \leq 0.2,$$

$$0 \leq (\mu) \leq 2.0,$$

$$97.0 \leq f3=(\alpha)+(\kappa),$$

$$99.4 \leq f4=(\alpha)+(\kappa)+(\gamma)+(\mu),$$

$$0 \leq f5=(\gamma)+(\mu) \leq 2.5, \text{ and}$$

$$27 \leq f6=(\kappa)+6\times(\gamma)^{1/2}+0.5\times(\mu) \leq 70$$

are satisfied, the length of the long side of γ phase is 30 μm or less, the length of the long side of μ phase is 25 μm or less, and κ phase is present in a phase.

3. A method of manufacturing a free-cutting copper alloy worked material, the method comprising:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied, the manufactured free-cutting copper alloy worked material comprises:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.25 mass % of Pb; and a balance including Zn and inevitable impurities, a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.25 \leq f1 = [Cu] + 0.8 \times [Si] - 8.5 \times [Sn] + [P] + 0.5 \times [Pb] \leq 80.3 \text{ and}$$

$$61.5 \leq f2 = [Cu] - 4.3 \times [Si] - 0.7 \times [Sn] - [P] + 0.5 \times [Pb] \leq 63.3$$

are satisfied, in constituent phases of metallographic structure of the manufactured free-cutting copper alloy worked material, when an area ratio of a phase is represented by (α)%, an area ratio of β phase is represented by (β)%, an area ratio of γ phase is represented by (γ)%, an area ratio of K phase is represented by (κ)%, and an area ratio of μ phase is represented by (μ)%, the relations of $$25 \leq (\kappa) \leq 65,$$

$$0 \leq (\gamma) \leq 1.5,$$

$$0 \leq (\beta) \leq 0.2,$$

$$0 \leq (\mu) \leq 2.0,$$

$$97.0 \leq f3 = (\alpha) + (\kappa),$$

$$99.4 \leq f4 = (\alpha) + (\kappa) + (\gamma) + (\mu),$$

$$0 \leq f5 = (\gamma) + (\mu) \leq 2.5, \text{ and}$$

$$27 \leq f6 = (\kappa) + 6 \times (\gamma)^{1/2} + 0.5 \times (\mu) \leq 70$$

are satisfied, the length of the long side of γ phase is 30 μm or less, the length of the long side of μ phase is 25 μm or less, and κ phase is present in a phase.

4. The method of manufacturing a free-cutting copper alloy worked material according to claim 1, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.30 mass % of Bi.

5. The method of manufacturing a free-cutting copper alloy worked material according to claim 2, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.30 mass % of Bi.

6. The method of manufacturing a free-cutting copper alloy worked material according to claim 3, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.30 mass % of Bi.

* * * * *